United States Patent [19]

Kadota et al.

[11] Patent Number: 4,748,105

[45] Date of Patent: May 31, 1988

[54] RAPID BLEACH FIXING OF A SILVER HALIDE COLOR PHOTOGRAPHIC LIGHT-SENSITIVE MATERIAL USING AN ORGANIC ACID FERRIC COMPLEX

[75] Inventors: Shinzi Kadota, Hino; Shigeharu Koboshi, Sagamihara; Moeko Higuchi, Houya, all of Japan

[73] Assignee: Konisiroku Photo Industry Company, Ltd., Tokyo, Japan

[21] Appl. No.: 911,068

[22] Filed: Sep. 24, 1986

[30] Foreign Application Priority Data

Sep. 25, 1985 [JP] Japan ..... 60-213904
Nov. 13, 1985 [JP] Japan ..... 60-256382
Nov. 13, 1985 [JP] Japan ..... 60-256383

[51] Int. Cl.[4] ..... G03C 1/02; G03C 1/08; G03C 1/30; G03C 7/16

[52] U.S. Cl. ..... 430/393; 430/376; 430/377; 430/381; 430/383; 430/386; 430/387; 430/567

[58] Field of Search ..... 430/393, 376, 377, 381, 430/383, 567, 386, 387

[56] References Cited

U.S. PATENT DOCUMENTS 4,254,213 3/1981 Masuda et al. ..... 430/381
4,256,826 3/1981 Popp et al. ..... 430/393 X
4,292,401 9/1981 Itoh et al. ..... 430/393 X
4,374,922 2/1983 Ohbayashi et al. ..... 430/393 X
4,481,290 11/1984 Kishimoto et al. ..... 430/393 X
4,483,918 11/1984 Sakai et al. ..... 430/393 X
4,522,916 6/1985 Hirano ..... 430/381 X
4,556,630 12/1985 Furutachi et al. ..... 430/393 X
4,576,910 3/1986 Hirano et al. ..... 430/381 X

*Primary Examiner*—Mukund J. Shah
*Attorney, Agent, or Firm*—Finnegan, Henderson, Farabow, Garrett & Dunner

[57] ABSTRACT

A method of processing of a silver halide color photographic light-sensitive material is disclosed. The color photographic material to be processed comprises a support and photographic component layers including a blue-sensitive, green-sensitive and red-sensitive silver halide emulsion layers, and at least one of the photographic emulsion layers comprises a silver halide containing 0.5 to 25 mol % of silver iodide. The total thickness of the photographic component layers is from 8 to 25 μm and the swelling rate $T\frac{1}{2}$ of this layers is not more than 25 sec. At least one of the emulsion layers contains a specific coupler. The color photographic material is processed with a bleach-fixing solution containing an organic acid ferric complex after a developing treatment.

The processing by this invention provides high sensitivity and minimized cyan dye loss of the photographic material.

12 Claims, No Drawings

RAPID BLEACH FIXING OF A SILVER HALIDE COLOR PHOTOGRAPHIC LIGHT-SENSITIVE MATERIAL USING AN ORGANIC ACID FERRIC COMPLEX

FIELD OF THE INVENTION

This invention relates to a processing method of silver halide color photographic light-sensitive materials, and more particularly to a processing method of silver halide color photographic light-sensitive materials which have a rapid bleaching-fixing property for silver.

BACKGROUND OF THE INVENTION

In general, for the purpose to obtain a color image by processing a silver halide color photographic light-sensitive material having been exposed to light, it is necessary to treat the developed metallic silver with an agent having a bleaching ability after the color-developing process.

As the solution having bleaching ability, bleaching solution and bleach-fixing solution are known. The bleaching solution is used by combining with a succeeding fixing process in which the developed silver halide is fixed. The bleach-fixing solution is used for the purpose to carry out both the bleaching and fixing process in one stage.

In the treating procedure of silver halide color photographic light-sensitive materials the bleaching is carried out by using a solution containing an inorganic oxidizing agent such as potassium iron (III) cyanate (red prussiate) or a dichromate as the oxidizing agent to bleach the developed silver.

Such bleaching solutions containing an inorganic oxidizing agent have several serious weakpoints. Potassium iron (III) cyanate or a dichromate has a comparatively good bleaching ability for the developed silver but either of them is possibly produce cyanate ion or hexavalent chromium ion by photochemical decomposition and both of which are not preferable for environmental protection since they are harmful to human health. Moreover, oxidizing power of these oxidizing agents is too strong to let them coexist with a fixing agent (an agent to solubilize the developed silver halide such as a thiosulfate). Since then, it is almost impossible to apply these oxidizing agents for a bleach-fixing agent and is also difficult to simplify and shorten the treatment. And what is worse, the used solutions containing these oxidizing agents are difficult to reuse by reclamation and recirculation.

For the purpose to improve these short points and environmental hazards metal complex salts of organic acids such as an aminopolycarbonate metal complex have come to be used as oxidizing agents which are possible to simplify and shorten the process and, moreover, the reuse of waste solution is also possible. However, the bleaching speed of the developed silver (metallic silver) which is formed by the developing process is slow since the oxidizing power of these organic complexes is weak. For example, iron (III) ethylenediaminetetraacetate complex (it is assumed to have a strong bleaching power among metallic complexes of aminocarboxylic acids) is practically utilized as a bleaching solution or a bleaching-fixing solution. However, when they are applied for highly sensitive silver halide color photographic light-sensitive materials mainly composed from silver bromide or silver iodobromide emulsions, especially for a negative or a reversal color-photographic films containing silver iodide, their bleaching power and silver-removing power are not sufficient resulting the remaining of a trace amount of image silver after the prolonged treatment. This tendency is remarkable in case of bleach-fixing solutions in which an oxidizing agent, thiosulfate and sulfite are coexisting since the oxidation-reduction potential of the solution is lowered. Especially, the removal of silver is remarkably deficient in case of highly sensitive silver iodide-containing silver halide color photographic light-sensitive materials containing black colloidal silver for antihalation.

This phenomenon is more remarkably observed in case of newly-developed "core-shell emulsion" which is a kind of a silver iodide containing highly sensitive emulsion having fine grain and is very preferable for the porpose of resources conservation since silver is effectively used. This core-shell emulsion is a monodispersed emulsion which is made by using a precedent silver halide emulsion as the crystalline core on which the subsequently-developed precipitate is piled successively one after another—that is, prepared by intentionally controlling the composition or the environment of the precipitation. Above all, a core-shell type highly sensitive emulsion containing silver iodide in core and/or the shell has a very preferable photographic characteristics. But when it is applied for silver halide color photographic light-sensitive materials the bleaching and fixing abilities for developed silver and silver halide are very inferior.

That is to say, in the case of the developed silver of photographic silver halide emulsions which belongs to a core-shell emulsion containing not less than 0.5 mol% of silver halide both in the core and the shell, the sensitivity, granularity and covering power are superior but the bleaching power is remarkably inferior since the developed silver of color photographic light-sensitive materials is necessary to be bleached and its configuration is different from the conventional ones. Photographic sensitive materials using emulsions containing tabular type silver halide grains (for example, described in Japanese Patent Publication Open to Public Inspection Nos. 113930/1983, 113934/1983, 127921/1983 and 108532/1983) do not increase the spent amount of silver and do not worsen its picture quality due to its tabular nature even when the number of light quantum caught by silver halide grain increases. However, even in the case of these tubular type grains there is one short point that the bleaching quality of silver formed by development using a p-phenylene-diamine type color-developing agent.

The inventors found that even in the case of the highly sensitive fine-grain silver halide color photographic light-sensitive materials containing black colloidal silver as the anti-halation layer and, at least, three layers of silver halide emulsions all of which contain at least 0.5 mol% silver iodide the bleach-fixing agent containing an iron (III)-complex of organic acid can sufficiently desilver when the total amount of coated silver, the total thickness of photographic coated materials and the swelling velocity of binder ($T\frac{1}{2}$) are lower than the specific values, respectively.

There happened, however, another problem that the cyan dye loss is worsen due to the shortening of bleaching-fixing time. Since then, the developing of a treating procedure of silver-halide color photographic light-sensitive materials is demanded by which the above-mentioned silver halide color photographic light-sensitive materials can be bleached and fixed quickly and the cyan dye loss is not worsen.

SUMMARY OF THE INVENTION

The first object of this invention is to produce an excellent bleaching-fixing procedure applicable to highly-sensitive and fine grain type silver halide color photographic light-sensitive materials containing highly-sensitive silver iodide by which both the resources conservation and the super-high sensitivity are achievable. The second object of this invention is to make the rapid processing of highly-sensitive color photographic light-sensitive materials possible and to provide a processing procedure by using a bleach-fixing agent by which the worsening of cyan dye loss is made minimize.

The objects of the invention can be achieved by a method of processing a silver halide color photographic light-sensitive material comprising, a step of developing an imagewise exposed silver halide color photographic material which comprises a support and photographic component layers including a blue-sensitive, a green-sensitive and a red-sensitive silver halide photographic emulsion layers provided on one side of the support, at least one of the emulsion layers comprising a silver halide containing from 0.5 to 25 mol% of silver iodide, and at least one of the emulsion layers comprising at least one coupler selected from the couplers represented by the general formula [C I], the couplers represented by the general formula [C II] and polymerized couplers, and the total dry-thickness of the photographic component layers being from 8 to 25 μm, the swelling rate T ½ of the photographic component layers being not more than 25 sec., and a step of bleach-fixing the developed photographic material with a bleach-fixing solution containing an organic acid ferric complex:

General formula [CI]

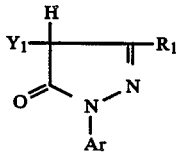

wherein Ar is a phenyl group which may be substituted, $Y_1$ is a group being capable of releasing upon the coupling reaction with an oxidized product of a color developing agent of an aromatic primary amine and $R_1$ is an anilino group, an ureido group and an acylamino group, these groups may be substituted:

General formula [CII]

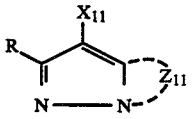

wherein $Z_{11}$ is a group of non-metalic atoms necessary to complete a nitrogen-containing heterocyclic ring which may be substituted, $X_{11}$ is a group being capable of releasing upon the coupling reaction with an oxidized product of a color developing agent of an aromatic primary amine and $R_{11}$ is a hydrogen atom or a substituent.

In this expalanation, the photographic component layers mean all of hydrophilic colloidal layers which are situated in the same side of the support on which at least three silver-halide emulsion layers (blue-, green- and red-sensitive ones of this invention) and participate to the formation of hotographic image. This is especially effective when an antihalation layer of black-colloidal silver is contained and it sometimes contains an under-coating layer, an intermediate layer (a simple intermediate layer, filter layer or ultraviolet absorbing layer), or a proctective layer.

More preferable enbodiment of the invention, prescriptions can also be given containing a bleach-accelerating agent (one of the materials having below-mentioned general formulas [I]-[VII]) in the prescribed bleach-fixing solution and/or in the pre-fixing solution which will be described afterwards.

General formula [I]

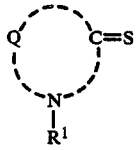

General formula [II]

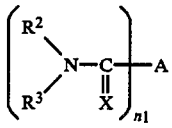

General formula [III]

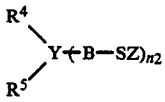

General formula [IV]

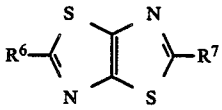

General formula [V]

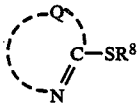

General formula [VI]

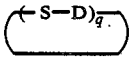

General formula [VII]

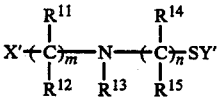

In the above formulas [I]-[VII],

Q: an atomic group necessary to compose a heterocycle containing at least one nitrogen atom (including a heterocycle attaching at least one five- or six-membered unsaturated ring by condensation).

A: a group of the following formulas

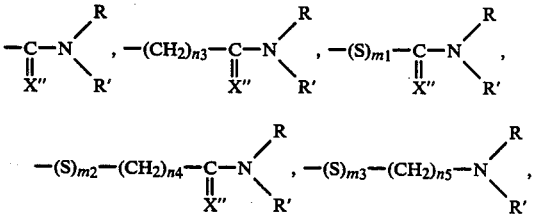

-continued

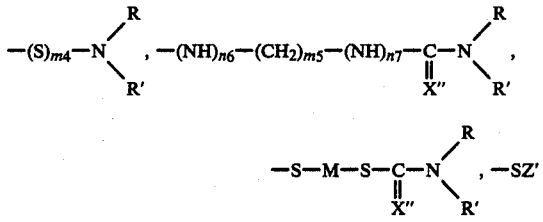

or a heterocyclic group of $n_1$-valency (including a heterocycle attaching at least one five- or six-membered unsaturated ring by condensation).

B: an alkylene group having a carbon number of one to six.

M: a bivalent metal atom

X and X'': a group =S, =O or =NR''

R'': a hydrogen atom, an alkyl group having a carbon number of one to six, a cycloalkyl group, aryl group, a heterocyclic group (including a heterocycle attaching at least one five- or six-membered unsaturated ring by condensation) or amino group.

Y: >N— or >CH—

Z: a hydrogen atom, an alkali-metal atom, ammonium group, amino group, a nitrogen-containing heterocyclic group, or

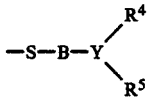

Z': same as Z or an alkyl group $R^1$: a hydrogen atom, an alkyl group having a carbon number of one to six, cycloalkyl group, aryl group, a heterocyclic group (including a heterocycle attaching at least one five- or six-membered unsaturated ring by condensation), or amino group.

$R^2$, $R^3$, $R^4$, $R^5$, R and R': respectively indicate any one of a hydrogen atom, an alkyl group having a carbon number one to six, hydroxyl group, carboxyl group, amino group, an acyl group having a carbon number one to three, allyl group, or alkenyl group. Except these, $R^4$ and $R^5$ can also indicate -B-SZ and, moreover, R and R', $R^2$, and $R^3$, $R^4$ and $R^5$ are possibly be bonded each other to form a heterocyclic group, (including a haterocycle attaching at least one five- or six-membered unsaturated ring by condensation).

$R^6$ and $R^7$: respectively indicate

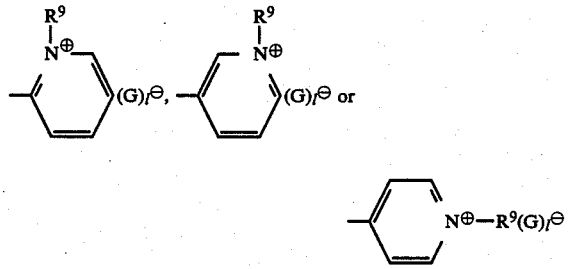

Where, $R^9$ indicates an alkyl group or $—(CH_2)n_8SO_3^{\ominus}$. And l is 0 or 1 when R is $—(CH_2)n_8SO_3^{\ominus}$. $G^{\ominus}$ is an anion; $m_1$–$m_4$ and $n_1$–$n_8$ indicates an integer from 1 to 6; $m_5$ indicates an integer from zero to 6.

$R^8$: a hydrogen atom, an alkali-metal atom,

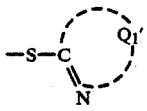

, or an alkyl group; where, Q' is the same as the above-mentioned Q.

D and q: D indicates a simple bonding, an alkylene group having a carbon number of 1–8, or vinylene group. q is an integer from 1 to 10. When the number of D is more than two, they may be the same or different to each other. The ring being formed with a sulfur atom may possibly be condensed with a five- or six-membered unsaturated ring.

X': —COOM', —OH, $—SO_3M'$, $—CONH_2$, $—SO_2NH_2$, $—NH_2$, —SH, —CN, $—CO_2R^{16}$, $—SO_2R^{16}$, $—OR^{16}$, $NR^{16}R^{17}$, $—SR^{16}$, $—SO_3R^{16}$, $—NHCOR^{16}$, $—NHSO_2R^{16}$, $—OCOR^{16}$, or $—SO_2R^{16}$.

Y':

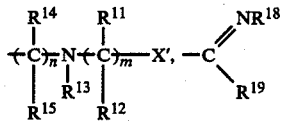

or a halogen atom.

m and n: an integer from 1 to 10

$R^{11}$, $R^{12}$, $R^{14}$, $R^{15}$, $R^{17}$, $R^{18}$: a hydrogen atom, a lower alkyl group, an acyl group or

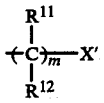

$R^{16}$: a lower alkyl group $R^{19}$: $—NR^{20}R^{21}$, $—OR^{22}$ or $—SR^{22}$ $R^{20}$, $R^{21}$: a hydrogen atom or a lower alkyl group $R^{22}$: an atomic group necessary to compose a ring combining with $R^{18}$.

$R^{20}$ or $R^{21}$ can compose a ring combining with $R^{18}$.

M': hydrogen atom or a cation

In the general formulas [I]–[VII] the following group can contain substituentes:

Amino, aryl, alkenyl and alkylene groups indicated as $R^1$, $R^2$, $R^3$, $R^4$, $R^5$, $R^8$, $R^9$, A, B, D, Z, Z', R, R'.

Heterocyclic residues formed by combining R and $R^1$, $R^2$ and $R^3$, $R^4$ and $R^5$, Q and Q'.

Examples of applicable substituents are a halogen atom, alkyl, aryl, alkenyl, cyclic alkyl, aralkyl, cyclic alkenyl, nitro, cyano, alkoxy, aryloxy, carboxy, alkoxycarbonyl, aryloxycarbonyl, sulfo, sulfamoyl, carbamoyl, acylamino, heterocyclic residue, arylsulfonyl, alkylsulfonyl, alkylamino, dialkylamino, anilino, N-alkylanilino, N-arylanilino, N-acylanilino and hydroxy groups.

Aforementioned alkyl groups indicated as $R^1$–$R^5$, $R^8$, $R^9$, Z', R and R' can also contain substituents whose examples are the same as the above except alkyl group.

The compounds indicated in the formulas [I] to [V] include their enolization products and their salts.

The inventors continued a strenuous research considering that the inferiority of recoloring of cyan dye is caused by the leuco-transition of the dye by action of the iron (II) ion abundantly generating during the rapid bleach-fixing treatment and that the amount of the generating iron (II) ion relates to the amount of silver in the photo sensitive material and elucidated that the green-sensitive silver halide emulsion layer has the worst desilvering property among the three sensitive silver-halide emulsion layers (blue-, green- and red-sensitive layers). That is to say, the reduction of the amount of silver contained in the green-sensitive silver halide emulsion layer which contains comparatively large amount of silver among three emulsion layers can help to reduce the amount of iron (II) ion in the emulsion layer and it is an effective means for the improvement of recoloring property of cyan dye.

From these background the inventors found that the inferiority of re-coloring of cyan dye is remarkably improved by using 2-equivalent magenta coupler which can effectively reduce the amount of silver contained in the green-sensitive silver halide emulsion layer (the amount of silver can be reduced to half theoretically). This efficiency is unexpectable from the ordinary reduction of silver amount which usually brings the change of photographic characteristics, especially the unavoidable disturbance in harmony. Moreover, the rapid bleach-fixing treatment is not disturbed at all which is the main purpose of this invention.

The most preferable results could be obtained under the conditions as that the film thickness of the photographic component layers is not larger than 22 μm (more preferably, not larger than 20 μm), the swelling rate of the photographic component layer (T ½) is not larger than 20 seconds (more preferably, smaller than 15 seconds), and the bleach-fixing accelerating agents and the organic acids composing the iron (III) complexes are as those mentioned below. The purpose of this invention has effectively been accomplished in this way.

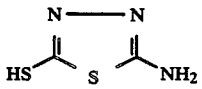
(1)

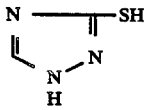
(2)

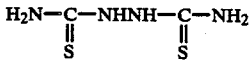
(3)

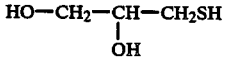
(4)

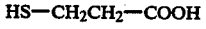
(5)

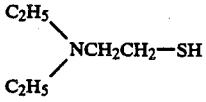
(6)

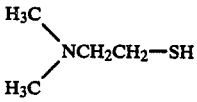
(7)

-continued

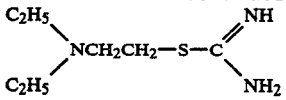
(8)

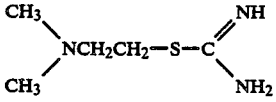
(9)

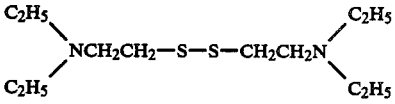
(10)

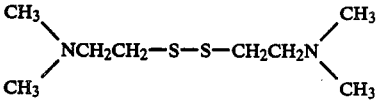
(11)

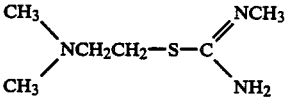
(12)

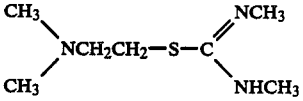
(13)

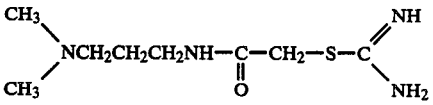
(14)

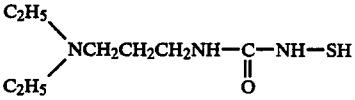
(15)

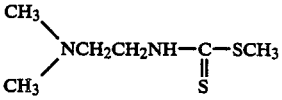
(16)

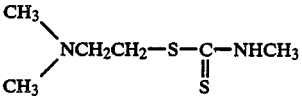
(17)

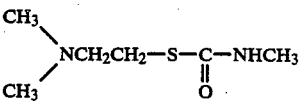
(18)

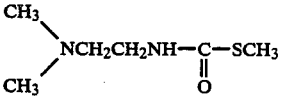
(19)

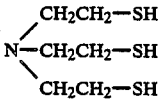
(20)

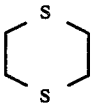
(21)

-continued (22)

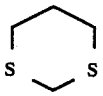

(23)

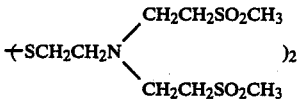

(24)

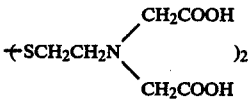

(25)

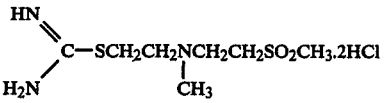

(26)

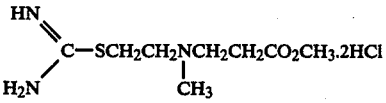

(27)

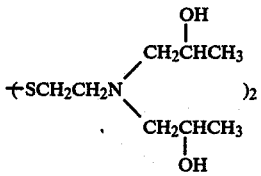

(28)

$HSCH_2CH_2NHCH_2CH_2OH$ (29)

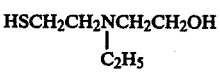

or (30)

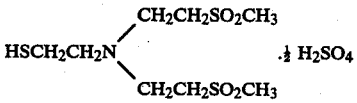

Organic acid (a) Diethylenetriaminepentaacetic acid
(b) Cyclohexanediaminotetraacetic acid
(c) Triethylenetetraminehexaacetic acid
(d) Glycoletherdiaminetetraacetic acid
(e) 1,2-Diaminopropanetetraacetic acid
(f) 1,3-Diaminopropane-2-oltetraacetic acid
(g) Ethylenediaminedi-o-hydroxyphenylacetic acid
(h) Ethylenediaminetetraacetic acid
(i) Nitrilotriacetic acid
(j) Iminodiacetic acid
(k) Methyliminodiacetic acid
(l) Hydroxyethyliminodiacetic acid
(m) Ethylenediaminetetrapropionic acid
(n) Dihydroxyethyl glycine
(o) Nitrotripropionic acid
(p) Ethylenediaminediacetic acid
(q) Ethylenediaminedipropionic acid As a very effective practice, the purpose of this invention is most effectively attained by applying a fixing treatment as the after-treatment of the color developing and as the pretreatment of the bleaching-fixing treatment. Hereafter, this fixing treatment is called as the pre-fixing treatment or pre-fixating and the solution used for it is called as the pre-fixing treatment solution or pre-fixing solution or, otherwise, the pre-fixing treatment bath or the pre-fixing bath.

DETAILED DESCRIPTION OF THE INVENTION

Detailed description should be followed about this invention.

Description starts from magenta dye-forming couplers used in this invention. General formula is as follows.

General formula [CI]

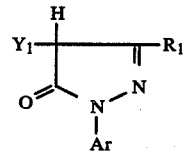

Ar: Phenyl group, or a substituted phenyl group. Kinds of substituentes are as follows: (two or more substituentes are possible in one phenyl group (Ar)).

halogen atom, alkyl, alkoxy, aryloxy, alkylcarbonyl, cyano, carbamoyl, sulfamoyl, sulfonyl, sulonamide or acylamino group.

Among various replaceable groups the most preferable one is a halogen atom, especially chlorine atom.

$Y_1$: A group which is released when a dye is formed by coupling with an oxidized product of aromatic primary amine color developing agent. Followings are the typical groups of groups applicable:

halogen atom, alkoxy group, aryloxy group, acyloxy group, arylthio group, alkylthio group,

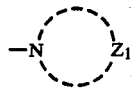

group ($Z_1$ is a group of atoms necessary to form a five- or six-membered heterocyclic ring by bonding nitrogen atom and another atom chosen from carbon, oxygen, nitrogen, or sulfur).

$R_1$: Acylamino group:

Anilino groups:

Ureido groups:

The most preferable type of compounds among those expressed by the general formula [CI] is the following one:

General formula [CIa]

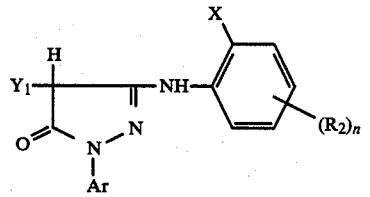

In this formula, $Y_1$ and Ar means the same as those in general formula [CI].

$X_1$: halogen atom, alkoxy group or alkyl group.

Actual examples are shown as follows:

Halogen atom: chlorine, bromine, fluorine

Alkoxyl group: methoxyl, ethoxy, butoxy, sec-butoxy, iso-pentyloxy groups, etc. That is, alkoxyl groups having carbon numbers 1 to 5 are preferable.

Alkyl group: methyl, ethyl, iso-propyl, butyl, t-butyl, t-pentyle groups, etc. That is, alkyl groups having carbon numbers 1 to 5 are preferable. The most preferable group is a halogen atom, especially chlorine.

$R_2$ represents a group substituable to the benzene ring. n is an integer of 1 or 2; when n is 2, two $R_2$'s should be the same or different. Examples of $R_2$ (a group substituable to the benzene ring) are as follows:

Halogen atome, $R_3$—, $R_3O$—, $R_3$—C(=O)—N($R_4$)—, $R_3SO_2N$($R_4$)—, $R_4OC(=O)N$($R_4$)—, $R_3COO$—, $R_3$—N($R_4$)—CO—, $R_3$—N($R_4$)$SO_2$—, $R_3O$—CO—, $R_3$—N($R_4$)—CON($R_5$)—,

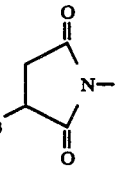

In the above, $R_3$, $R_4$ and $R_5$ should either be same or different among each other, and represents a hydrogen atom, an alkyl, alkenyl or aryl group containing or not containing substituent groups in it. More preferable ones are as follows:

$R_3CONH$—, $R_3SO_2NH$—, and

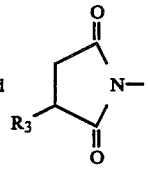

Actual examples of magenta couplers are shown below but not limited to them.

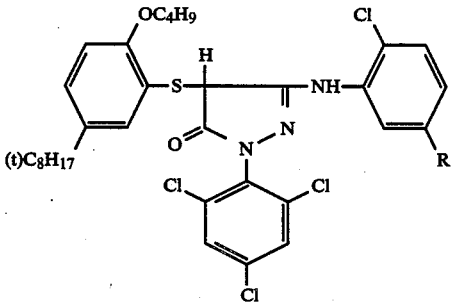

R in this formula represents following groups:

—$NHCOC_{13}H_{27}$ M-I-1

—$NHCOC_{14}H_{29}$ M-I-2

M-I-3

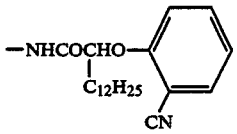

M-I-4

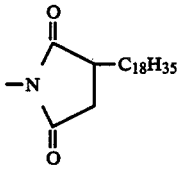

M-I-5

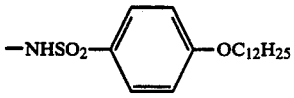

M-I-6

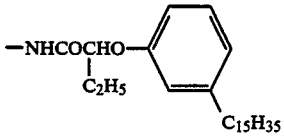

M-I-7

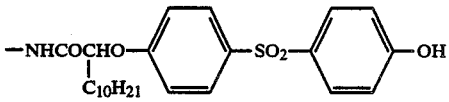

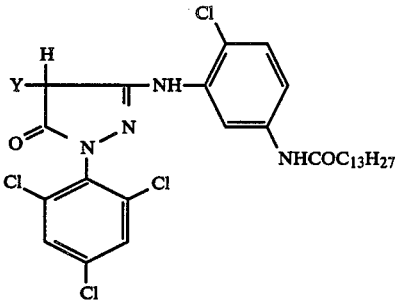

Y in this formula represents following groups:

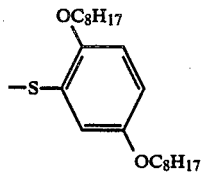

M-I-8

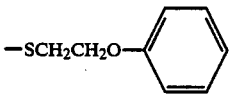

M-I-9

-continued
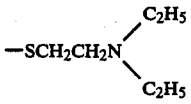
M-I-10
$-SC_{12}H_{25}$
M-I-11
$-SCH_2CO_2C_2H_5$
M-I-12
$-SCH_2COOH$
M-I-13
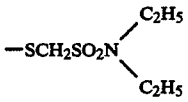
M-I-14
$-SCH_2CONH_2$
M-I-15
$-SCH_2CH_2OC_2H_5$
M-I-16
$-SCH_2CH_2OH$
M-I-17
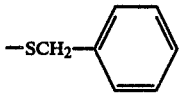
M-I-18
$-SCH_2CH_2NHSO_2CH_3$
M-I-19
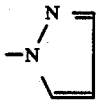
M-I-20
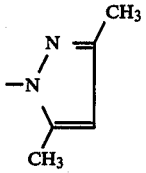
M-I-21
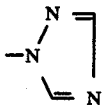
M-I-22
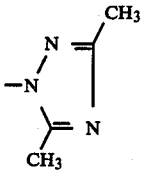
M-I-23
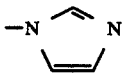
M-I-24
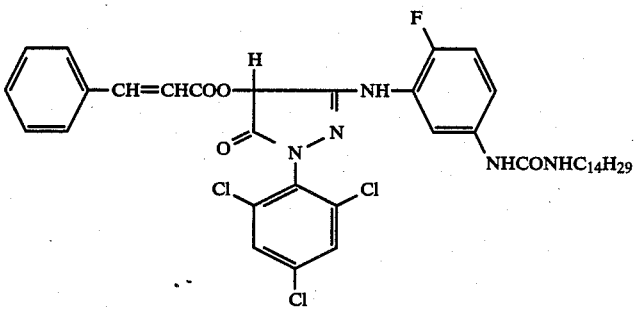
M-I-25
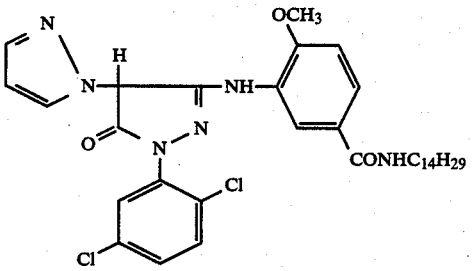
M-I-26
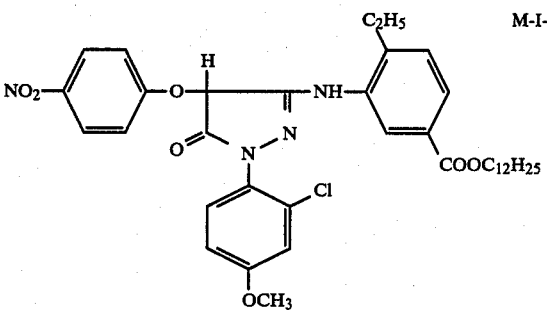
M-I-27

-continued
M-I-28
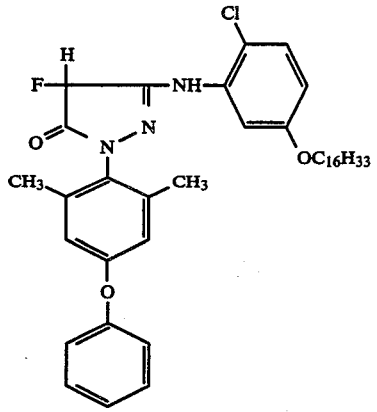
M-I-29
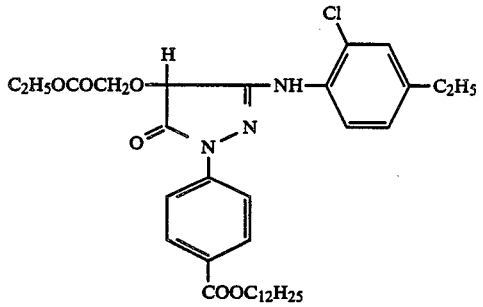
M-I-30
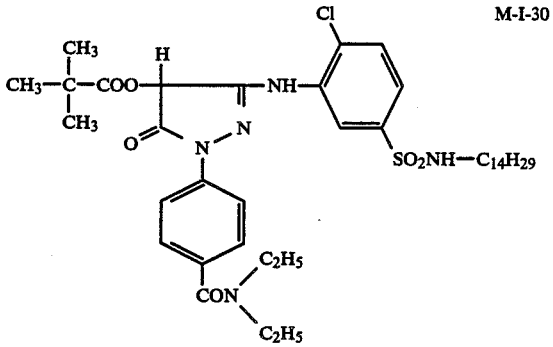
M-I-31
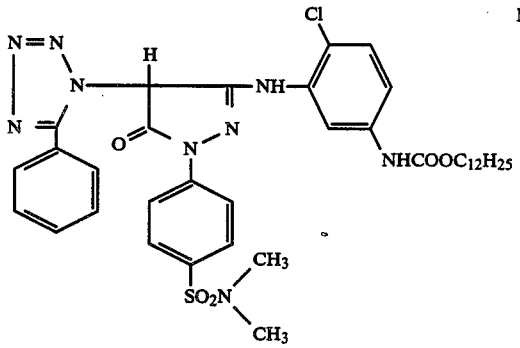
M-I-32
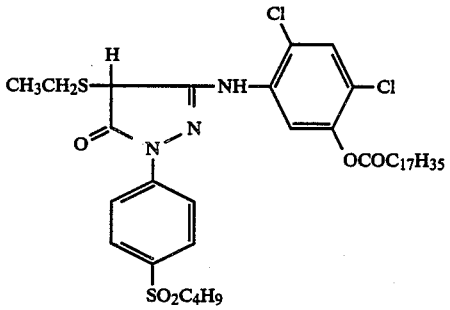
M-I-33
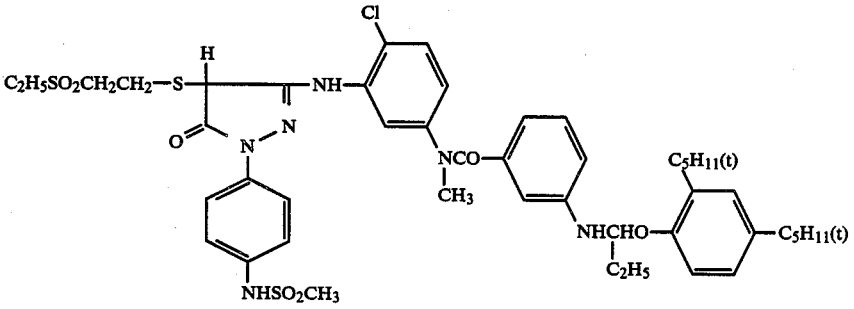

-continued
M-I-34
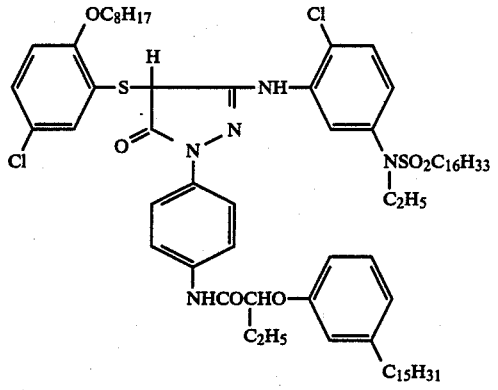
M-I-35
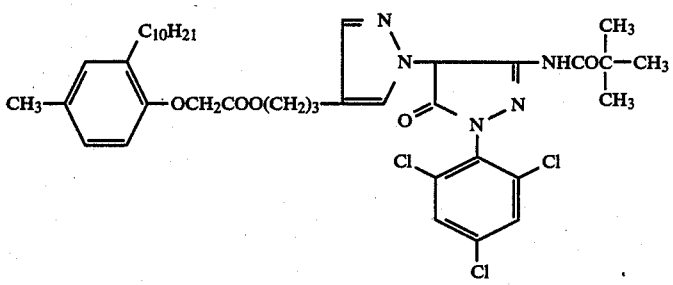
M-I-36
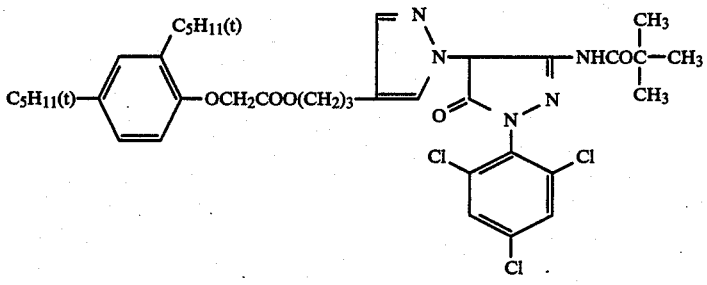
M-I-37
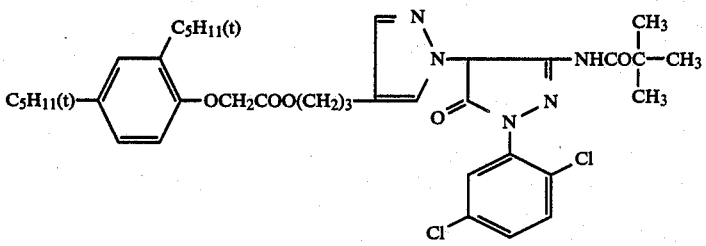
M-I-38
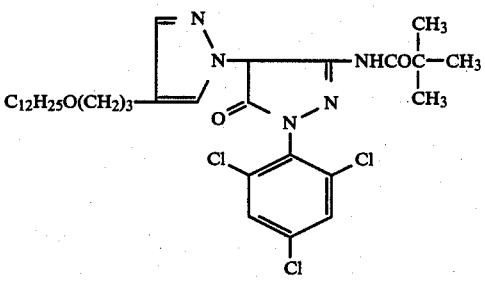
M-I-39
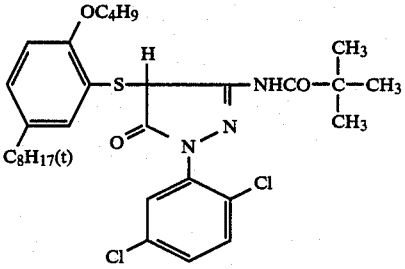

M-I-40

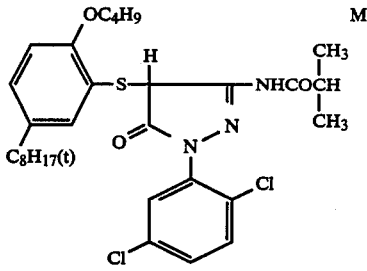

-continued

M-I-41

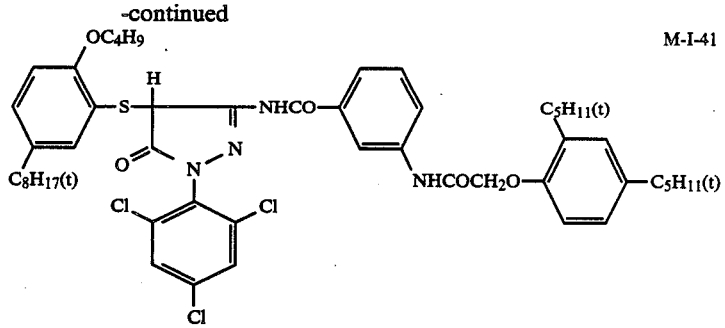

These magenta couplers used in this invention can be synthesized easily by using the method described in Japanese Patent O.P.I. Publication Nos. 380431/1981, 14837/1982, 204036/1982 and 14833/1983.

In this invention the magenta couplers represented by the general formula [CI] can be used by combining with other already known magenta couplers in a range which does not go against the purposes of this invention.

Moreover, non-color forming couplers used in this invention can be chosen from those described in British Pat. Nos. 861,138, 914,145 and 1,109,963, Japanese Patent Examined Publication No. 14033/1970, U.S. Pat. No. 3,580,722 and also described in "Mitteilungen aus den Forschning Laboratorie in der AGFA Leverkusen Vol. 4, pages 352–367 (1964)," etc.

Concentrations of a magenta coupler (general formula [CI]) applied in the silver halide emulsion layer are about 0.005–2 mol per mol of silver halide, and more preferably in a range 0.01–1 mol.

Magenta couplers represented by the general formula [CII] will be described hereafter.

General formula [CII]

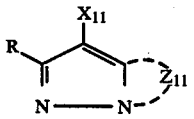

In this formula, $Z_{11}$ represents non-metallic atom groups necessary to compose a nitrogen-containing heterocyclic ring. Existence of substituents in the ring is allowable. $X_{11}$ represents a hydrogen atom or a substituente group which can be released by the reaction with an oxidized product of color-developing agent. $R_{11}$ represents a hydrogen atom or a substituent as follows:

Halogen atom, alkyl, cycloalkyl, alkenyl, cycloalkenyl, alkinyl, aryl, heterocylic, acyl, sulfonyl, sulfinyl, phosphonyl, carbamoyl, sulfamoyl, cyano, spiro-compound residue, bridged hydrocarbon residue, alkoxy, aryloxy, heterocylic oxy, siloxy, acyloxy, carbamoyloxy, amino, acylamino, sulfonamido, imido, ureido, sulfamoylamino, alkoxy-carbonylamino, aryloxy carbonylamino, alkoxycarbonyl, aryloxy carbonyl, alkylthio, arylthio, heterocyclicthio groups.

As substitutes detachable by reaction with oxidized product of color developing agent represented by $X_{11}$ in general formula [CII], various groups are substitutable by connection with a halogen atom (chlorine, bromine, or fluorine), carbon, oxygen, sulfur or nitrogen atom.

Nitrogen-containing heterocycles which are produced from $Z_{11}$ or $Z_{11}'$ are pyrazol, imidazol, triazol and tetrazol rings. All of them can take substituents mentioned above $R_{11}$.

When substitute groups shown in the general formulas [CII] and [CIIa]–[CII$_f$] (for example, $R_{11}$, $R_{12}$–$R_{18}$) have the part of this figure

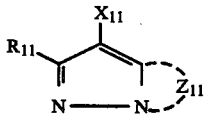

(wherein, $R_{11}$, $X_{11}$ and $Z_{11}$ is the same as $R_{11}$, $X_{11}$ and $Z_{11}$ in the general formula [CII]) so-called "bis-form" coupler is formed which is also included in this invention. The rings which are formed from $Z_{11}$ and $Z_{12}$ (mentioned later) can attach another ring (for example, 5–7-membered cycloalkene) by condensation. For example, $R_{15}$ and $R_{16}$ in the formula [CIId] and $R_{17}$ and $R_{18}$ in the formula [CIIe] can connect each other and can formed another ring (for example, 5–7-membered cycloalkene or benzene).

General formula [CII] can be represented as follows by paraphrasing in more detail; (general formulas [CIIa-]–[CIIf])

General formula [CIIa]

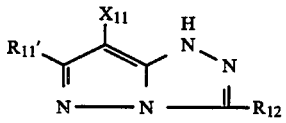

General formula [CIIb]

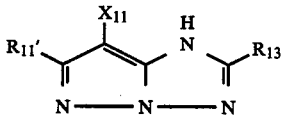

General formula [CIIc]

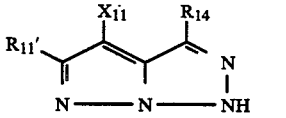

General formula [CIId]

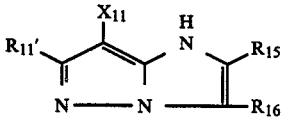

General formula [CIIe]

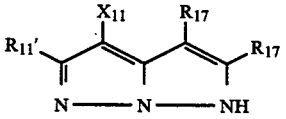

-continued

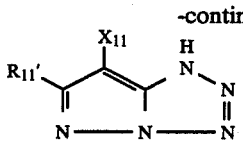

General formula [CIIf]

In these formulas [CIIa]-[CIIf], $R_{11}'$-$R_{18}$ and $X_{11}$ have the same meaning as aforementioned $R_{11}$ and $X_{11}$.

The preferable type one among compositions represented by [CII] is shown as:

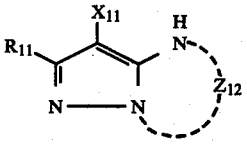

General formula [CIIg]

where, $R'_{11}$, $X_{11}$ and $Z_{12}$ are the same as $R_{11}$, $X_{11}$ and $Z_{11}$ in general formula [CII].

Among various magenta couplers represented by formulas [CIIa]-[CIIf], the especially preferable one is the magenta coupler represented by formula [CIIa].

A preferable coupler is obtained when the substituent on the heterocycle (that is, $R_{11}$ in the formula [CII] or $R_{11}'$ in formulas [CIIa]-[CIIg]) satisfies the conditions mentioned below.

A coupler is preferable when it satisfies condition 1. It is more preferable when it satisfies conditions 1 and 2. And moreover, it is most preferable when it satisfies conditions 1, 2 and 3.

Condition 1: The atom directly bonding to the heterocycle is carbon atom.

Condtion 2: This carbon atom has only one bonding with hydrogen atom or has no bonding with hydrogen atom.

Condition 3: All the bondings between this carbon atom and adjacent atoms are single bondage.

The most preferable substitute ($R_{11}$ or $R_{11}'$ in the above formulas) on the heterocycle is represented by general formula [CIIh].

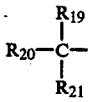

General formula [CIIh]

In this formula, $R_{19}$, $R_{20}$ and $R_{21}$ respectively represent following groups or atoms:

hydrogen atom, halogen atoms, alkyl, cycloalkyl, alkenyl, cycloalkenyl, alkinyl, aryl, heterocycle, acyl, sulfonyl, sulfinyl, phosphonyl, carbamoyl, sulfamoyl, cyano, spiro compound residue, bridged hydrocarbon residue, alkoxy, aryloxy, heterocyclic oxy, siloxy, acyloxy, carbamoyloxy, amino, acylamino, sulfonamido, imido, ureido, sulfamoylamino, alkoxy-carbonylamino, aryloxy-carbonylamino, alkoxycarbonyl, aryloxycarbonyl, alkylthio, arylthio and heterocyclic thio groups.

Among three positions ($R_{19}$, $R_{20}$ and $R_{21}$) two or more positions should not be occupied by a hydrogen atom.

Two of three groups can form a combination to form a saturated or unsaturated ring (form example, cycloalkane, cycloalkene or heterocycle). Moreover, another one group can combine with this ring to form a bridge-binding hydrocarbon residue.

Radicals represented by $R_{19}$-$R_{21}$ can contain substitutes. As actual examples of substitutes and groups the aforementioned examples of $R_{11}$ in general formula [CII] are applicable.

As actual examples of rings formed by binding $R_{19}$ and $R_{20}$ (or other pairs $R_{20}$ and $R_{21}$) or bridge-binding hydro-carbon residues by connecting $R_{19}$-$R_{21}$ and probable substitutes are cyclohexyl and cycloalkenyl groups and hetero-cyclic bridge-binding hydrocarbon residues which have been represented as $R_{11}$ in the formula [CII].

The most preferable group combinations in general formula [CIIh] are (i) two groups among $R_{19}$, $R_{20}$ and $R_{21}$ are alkyl groups;

(ii) one group is a hydrogen atom and the other two groups can combine and form a cycloalkyl with the basic carbon atom.

More preferable case among the combinations of (i) is that two groups among three are alkyls and the other one is a hydrogen atom or an alkyl group where alkyl or cycloalkyl can contain substituents whose actual examples are same as those in the case of $R_{11}$ in formula [CII].

Kind of groups whose existence is allowable as the substitute to the ring represented as $Z_{11}$ in general formula [CII] or [CIIg] and as $R_{12}$-$R_{18}$ in general formulas [CIIa]-[CIIf] may preferably be as follows:

General formula [CIIi]

$$-R_{31}-SO_2-R_{32}$$

where, $R_{31}$ is an alkylene and $R_{32}$ is an alkyl, cycloalkyl or aryl. $R_{31}$ is an alkylene whose carbon number should preferably be 2 or higher and should more preferably be 3 to 6. This alkylene can either be straight or branched-chain and can hold substituents whose actual examples are same as those indicated as allowable substitutes in the case of alkyls shown as $R_{11}$ in general formula [CII]. A preferable substituent is phenyl group.

Preferable examples of alkylenes shown as $R_{31}$ are as follows:

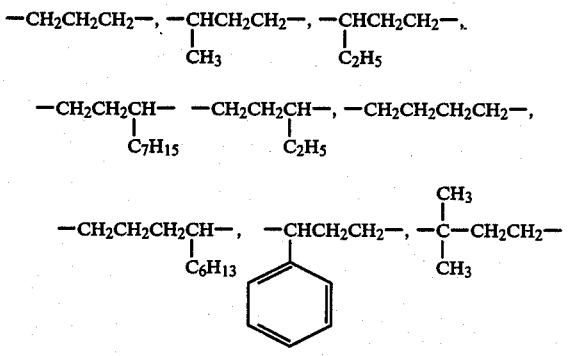

Alkyls shown as $R_{32}$ are either straight or branched chain, whose actual examples are:

methyl, ethyl, propyl, iso-propyl, butyl, 2-ethylhexyl, octyl, dodecyl, tetradecyl, hexadecyl, octadecyl, and 2-hexyldecyl groups.

Cycloalkyls shown as $R_{32}$ are preferably be 5 or 6-membered ring whose example is cyclohexyl group.

Alkyl and cycloalkyl shown as $R_{32}$ can hold substitutes whose examples are the same as those aforementioned as substituents for $R^1$.

Actual examples of aryl groups shown as $R_{32}$ are phenyl and naphthyl. These can hold substitutes.

Straight or branched chain alkyls and other substituents described as those for $R^1$. When two substituents exist in one molecule they should either be the same or different.

Among various compounds represented as general formula [CII], especially preferable ones are represented as general formula [CIIj].

General formula [CIIj]

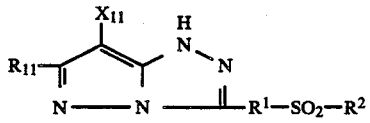

where, $R_{11}$ and $X_{11}$ are same as $R_{11}$ and $X_{11}$ in general formula [CII], and $R^1$ and $R^2$ are same as $R_{31}$ and $R_{32}$ in general formula [CIIi].

Actual compounds applicable in this invention are shown in the following. However, this invention is not limited to these compounds but includes polymer couplers whose pendant part has a chemical structure represented by general formula [CII] as clearly disclosed in Japanese Patent O.P.I. Publication No. 228252/1984.

(M-II-1)

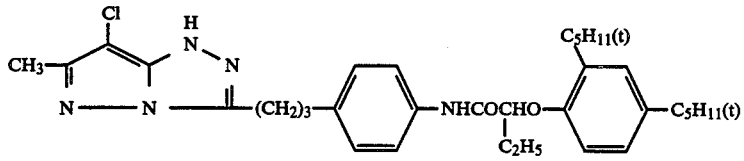

(M-II-2)

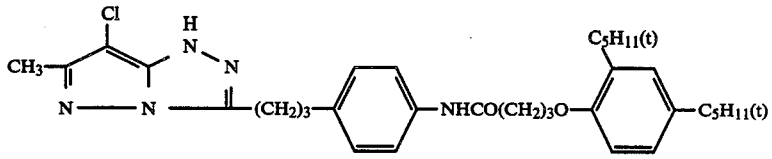

(M-II-3)

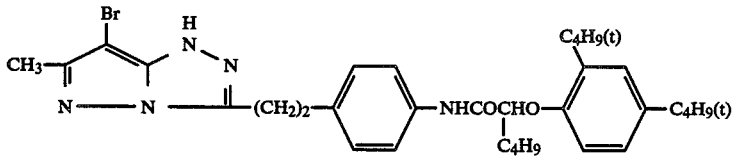

(M-II-4)

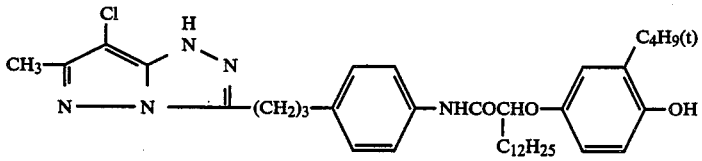

(M-II-5)

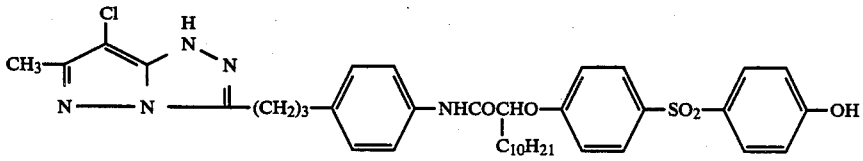

(M-II-6)

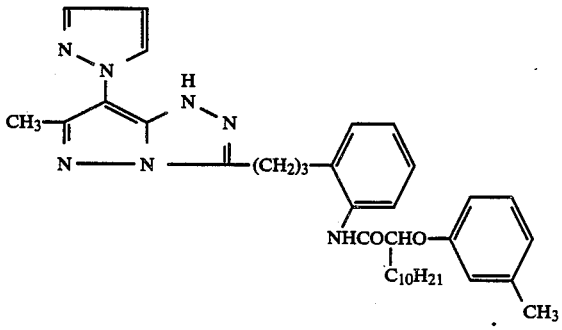

-continued
(M-II-7)
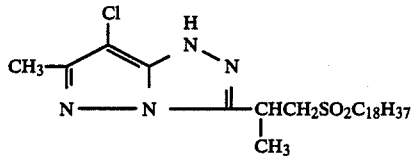
(M-II-8)
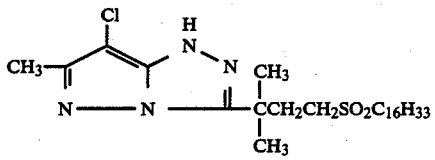
(M-II-9)
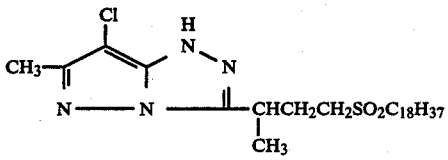
(M-II-10)
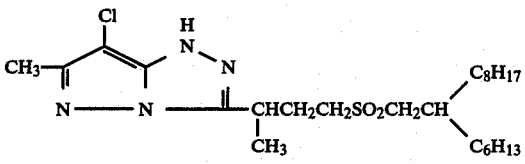
(M-II-11)
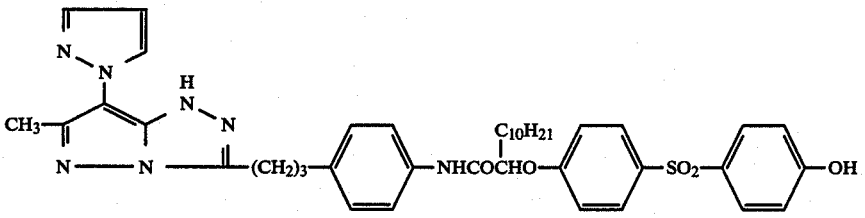
(M-II-12)
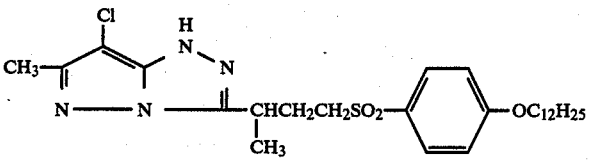
(M-II-13)
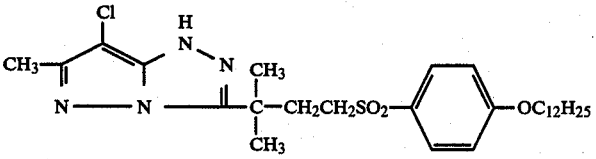
(M-II-14)
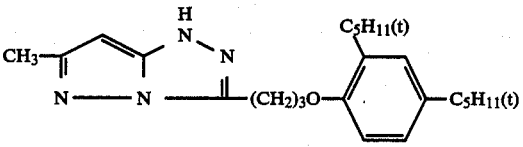
(M-II-15)
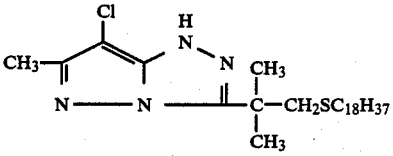

-continued
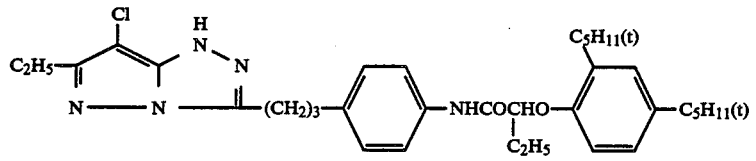
(M-II-16)
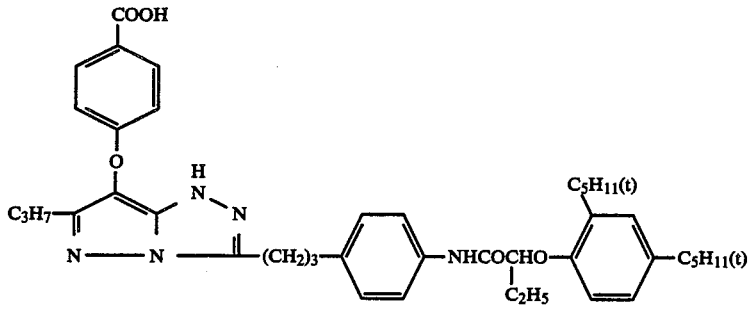
(M-II-17)
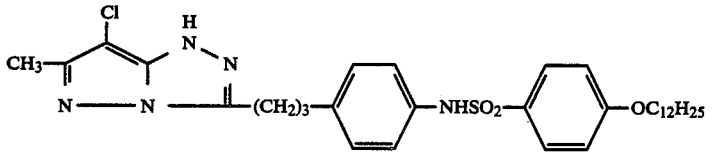
(M-II-18)
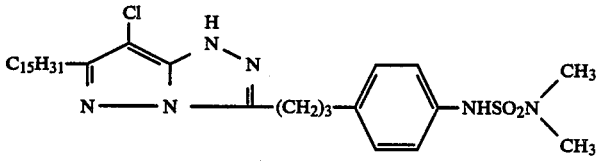
(M-II-19)
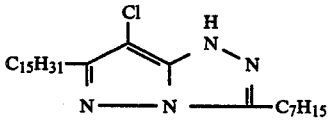
(M-II-20)
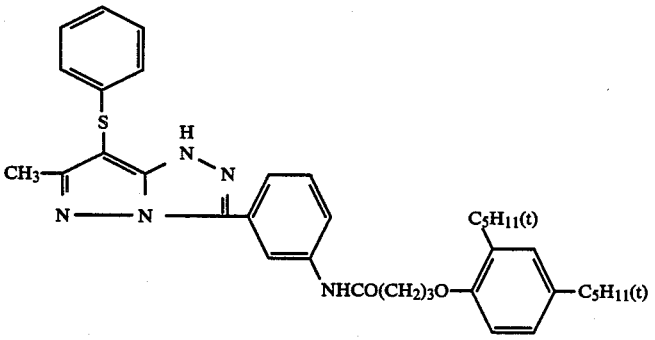
(M-II-21)
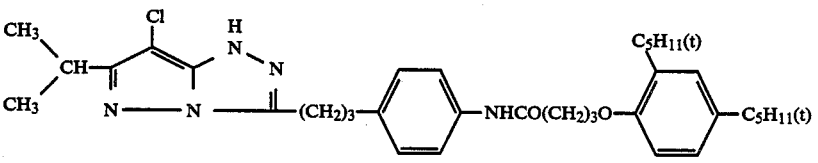
(M-II-22)
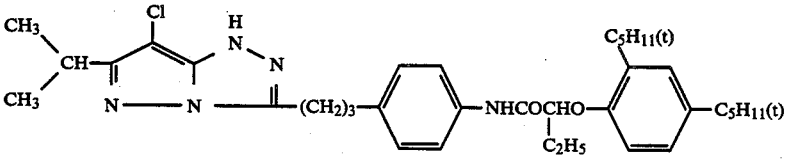
(M-II-23)

-continued
(M-II-24)
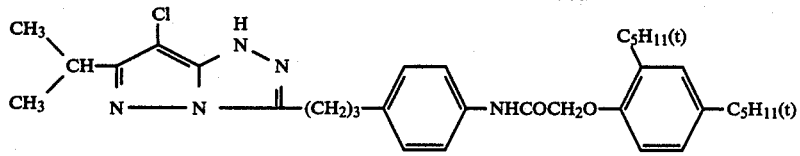
(M-II-25)
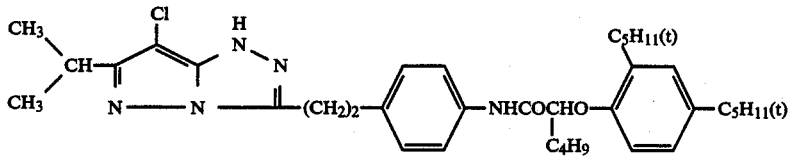
(M-II-26)
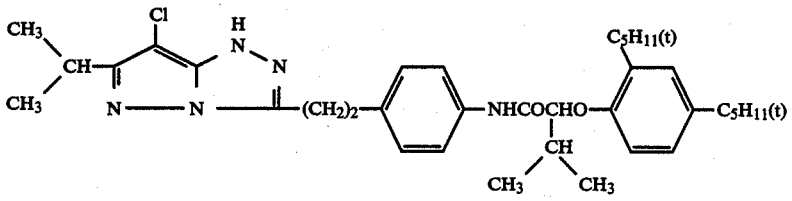
(M-II-27)
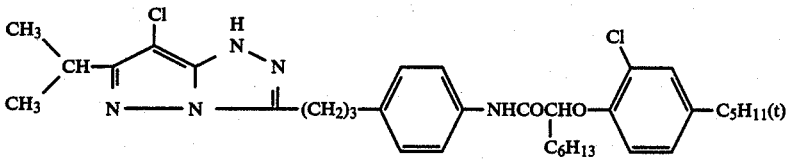
(M-II-28)
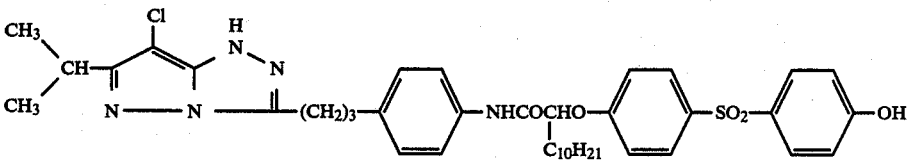
(M-II-29)
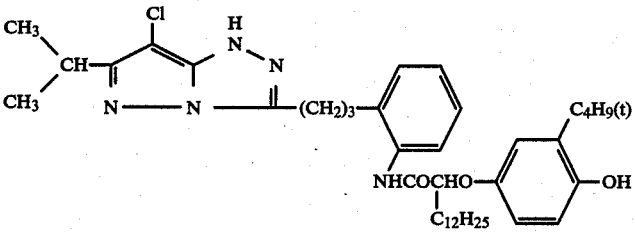
(M-II-30)
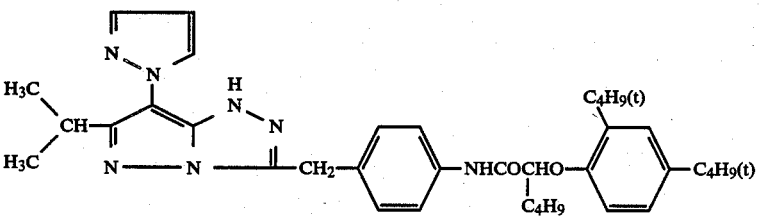
(M-II-31)
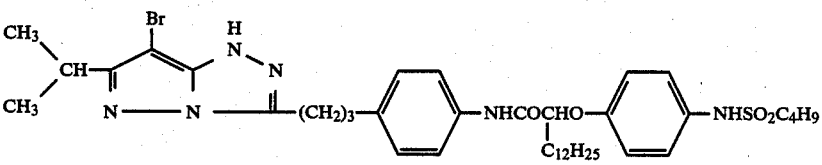
(M-II-32)
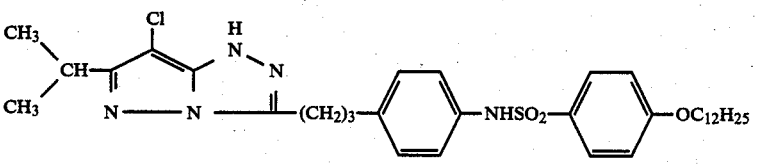

-continued
(M-II-33)
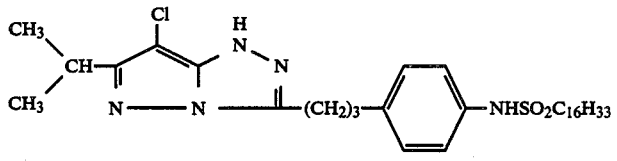
(M-II-34)
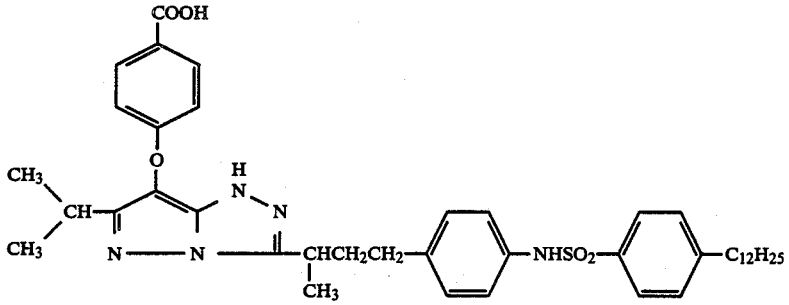
(M-II-35)
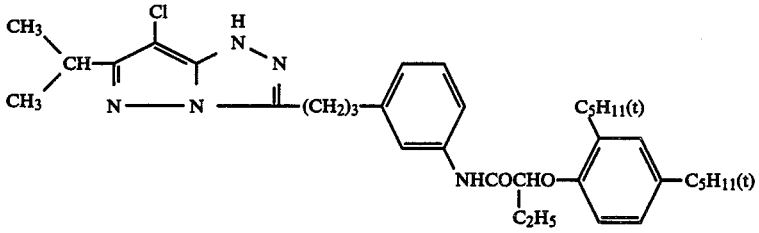
(M-II-36)
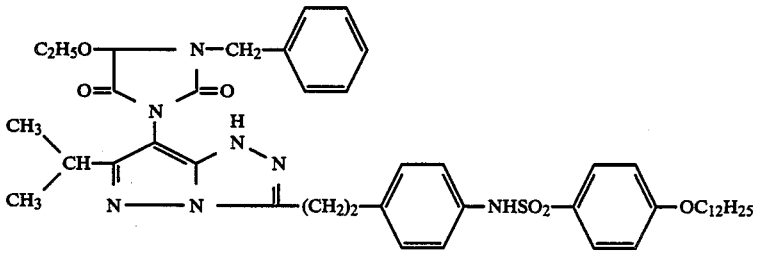
(M-II-37)
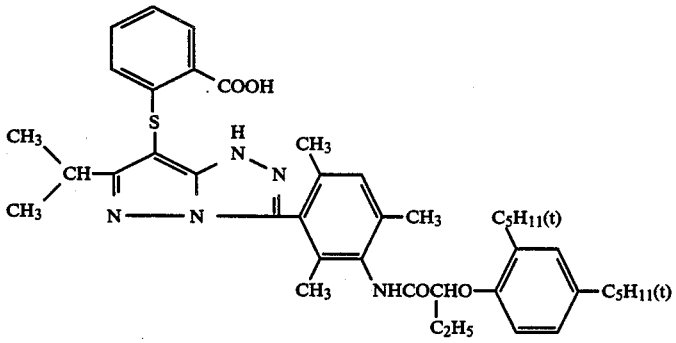
(M-II-38)
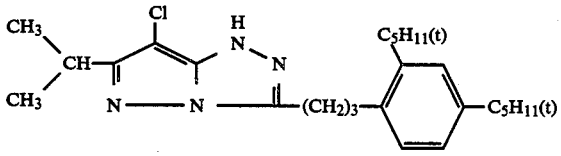

-continued
(M-II-39)
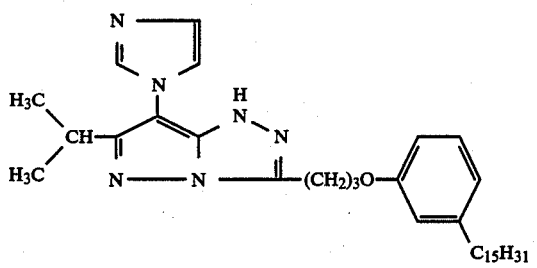
(M-II-40)
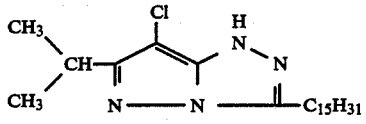
(M-II-41)
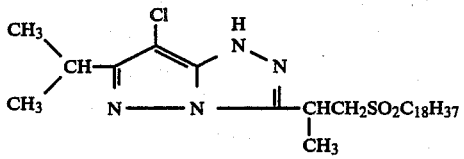
(M-II-42)
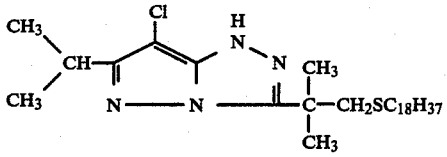
(M-II-43)
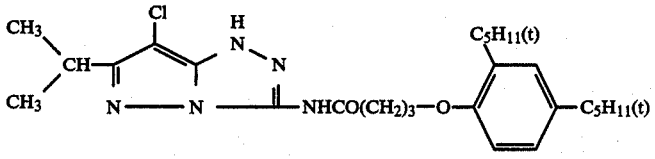
(M-II-44)
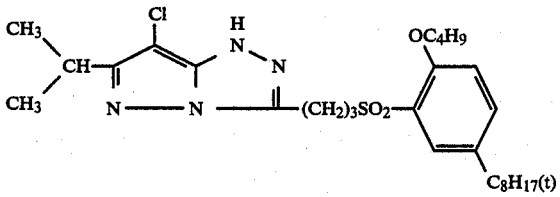
(M-II-45)
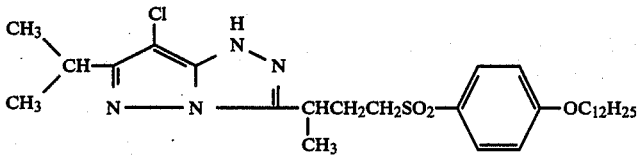
(M-II-46)
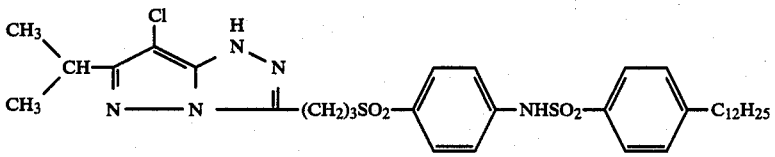
(M-II-47)
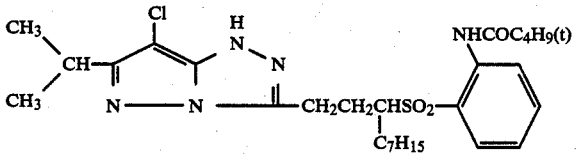

-continued
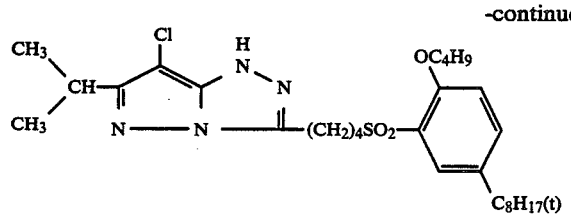
(M-II-48)
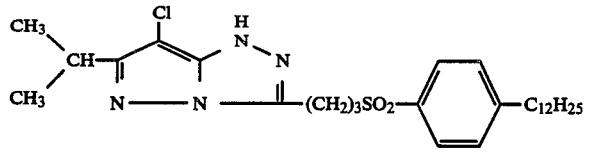
(M-II-49)
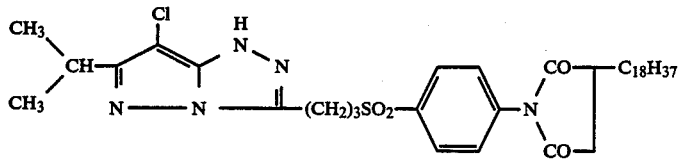
(M-II-50)
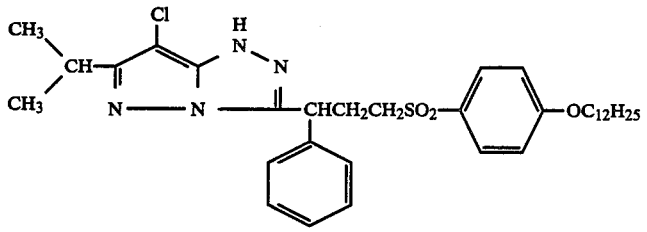
(M-II-51)
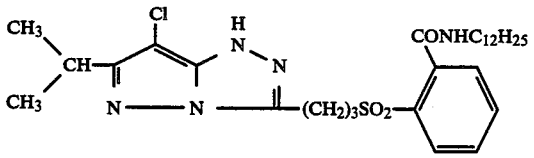
(M-II-52)
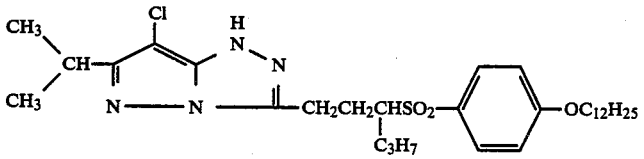
(M-II-53)
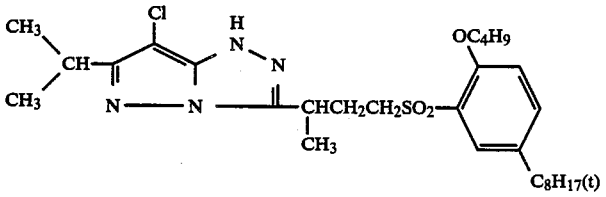
(M-II-54)
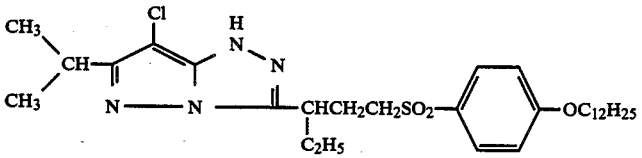
(M-II-55)
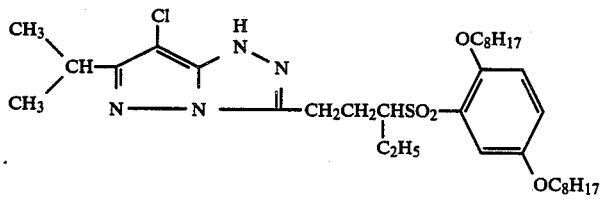
(M-II-56)

-continued
(M-II-57)
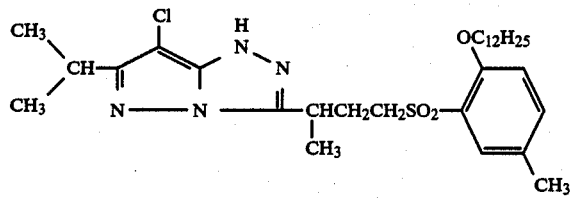
(M-II-58)
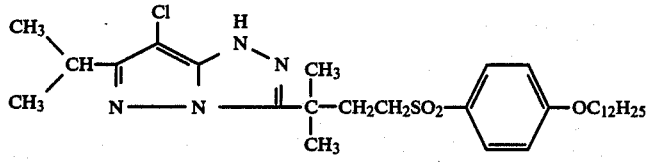
(M-II-59)
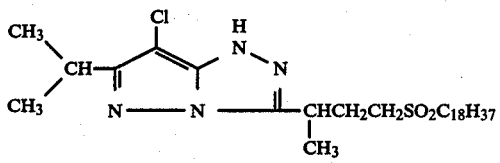
(M-II-60)
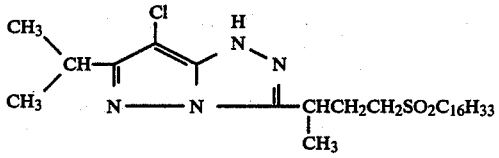
(M-II-61)
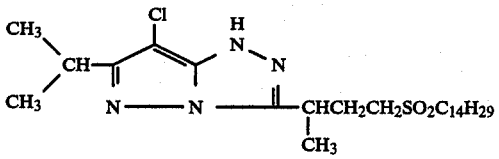
(M-II-62)
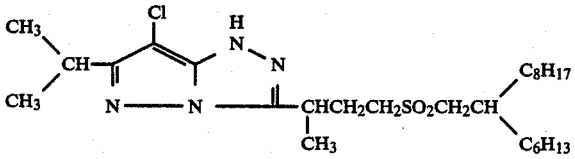
(M-II-63)
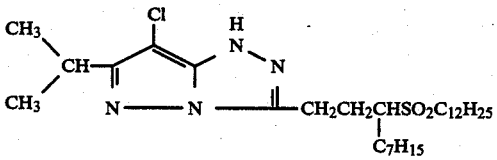
(M-II-64)
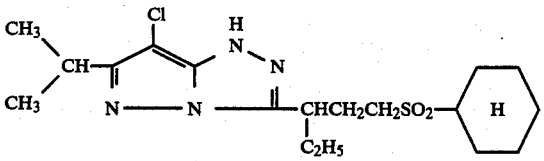
(M-II-65)
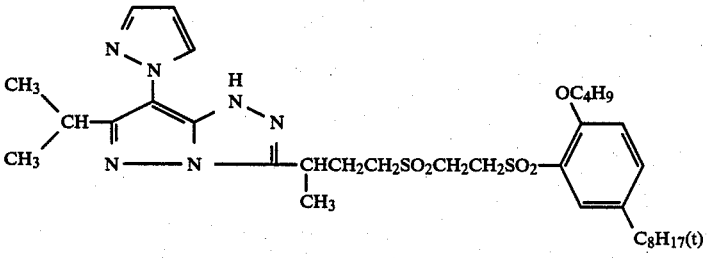

-continued
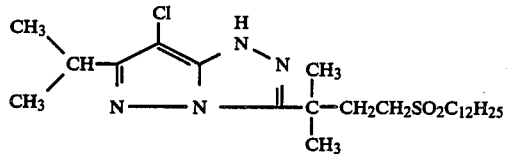
(M-II-66)
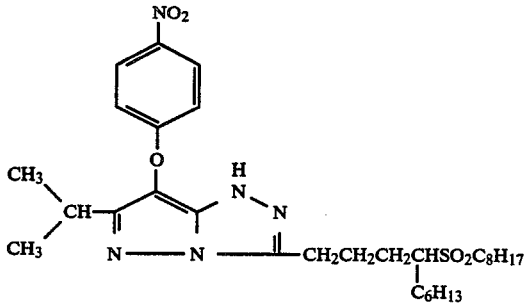
(M-II-67)
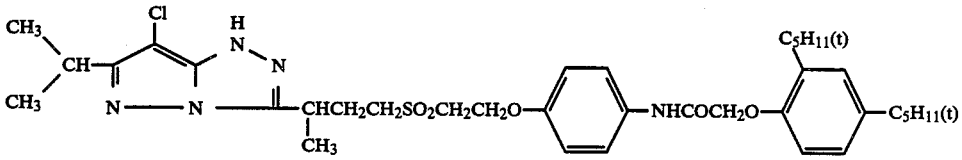
(M-II-68)
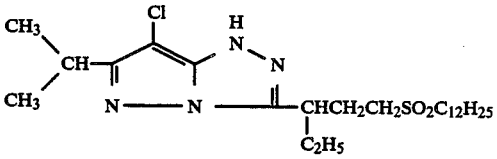
(M-II-69)
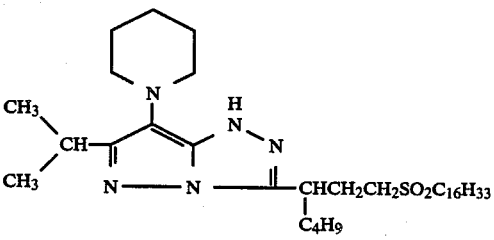
(M-II-70)
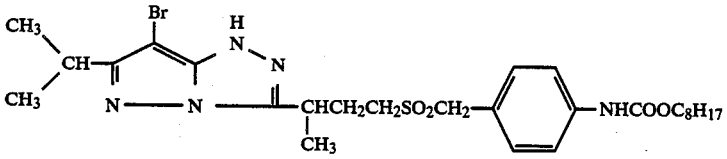
(M-II-71)
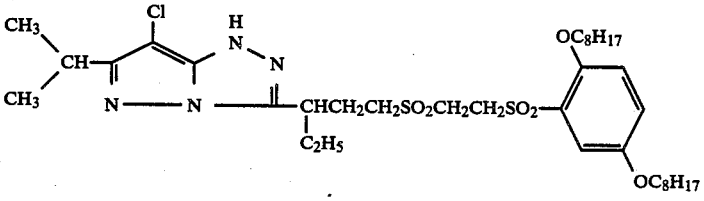
(M-II-72)

-continued
(M-II-73)
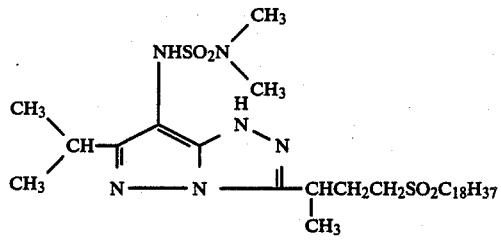
(M-II-74)
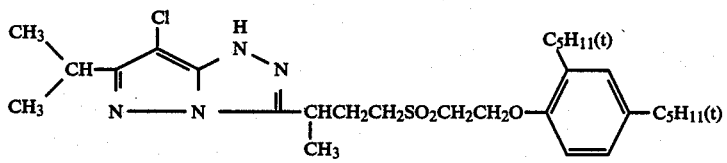
(M-II-75)
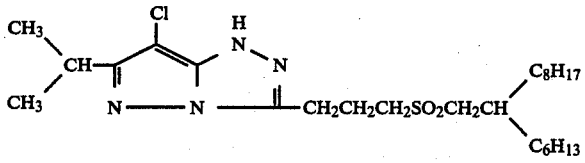
(M-II-76)
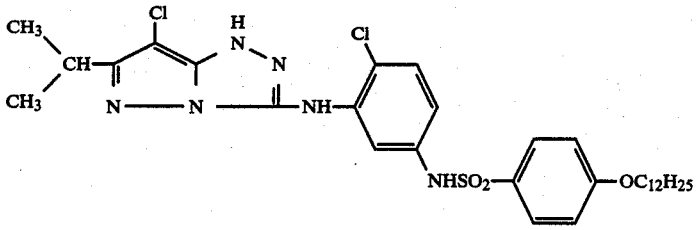
(M-II-77)
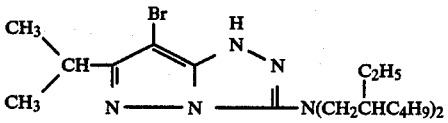
(M-II-78)
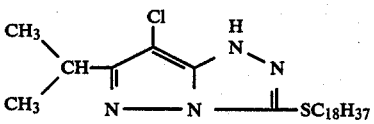
(M-II-79)
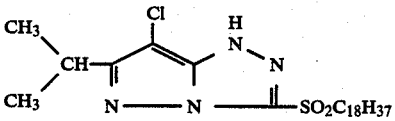
(M-II-80)
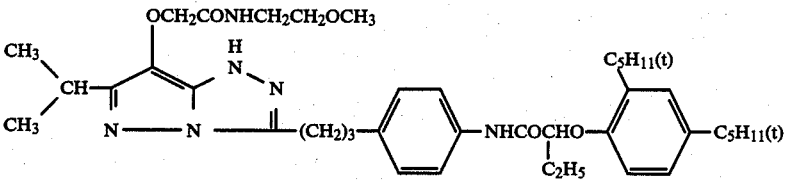
(M-II-81)
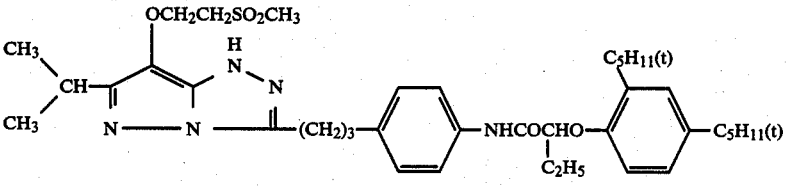

-continued
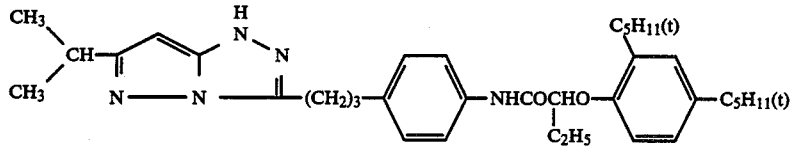
(M-II-82)
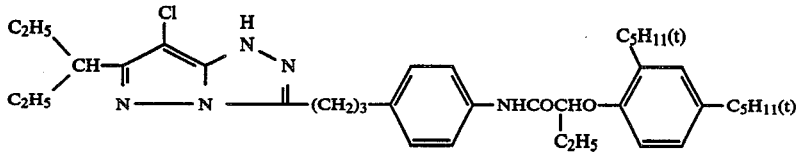
(M-II-83)
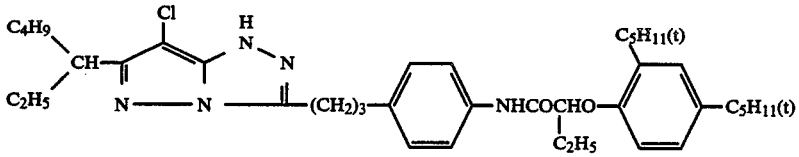
(M-II-84)
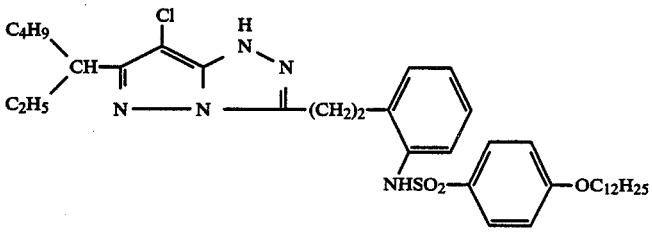
(M-II-85)
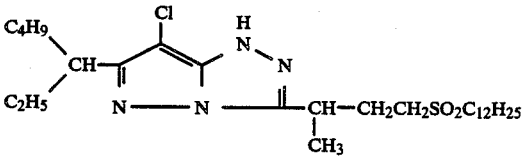
(M-II-86)
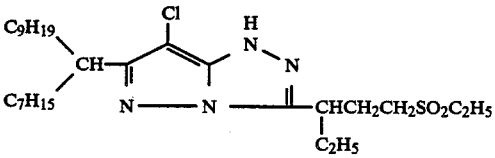
(M-II-87)
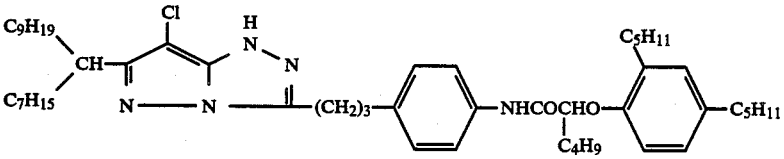
(M-II-88)
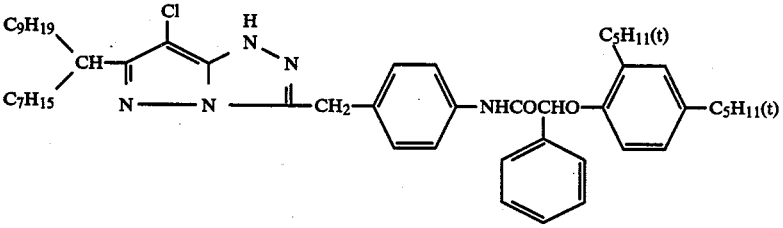
(M-II-89)
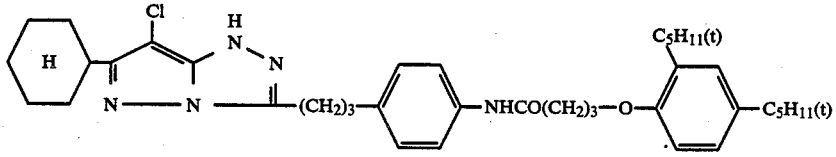
(M-II-90)

-continued
(M-II-91)
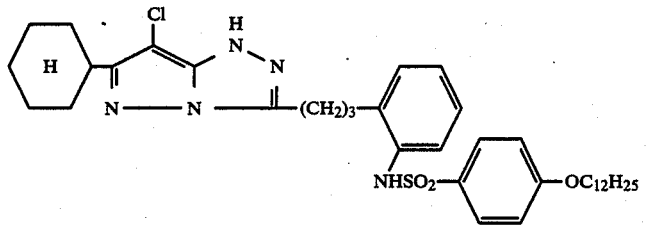
(M-II-92)
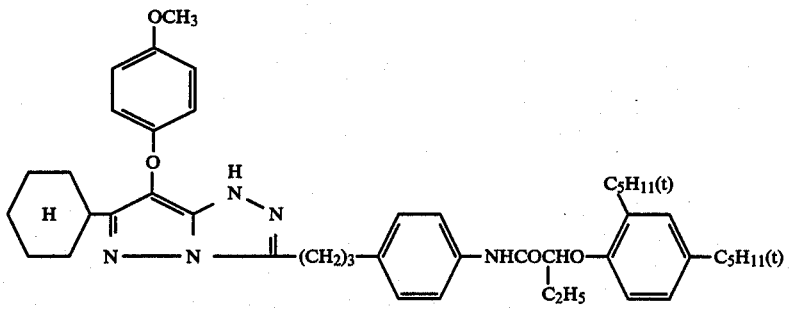
(M-II-93)
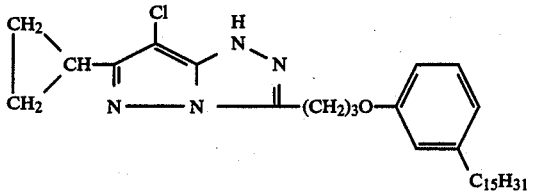
(M-II-94)
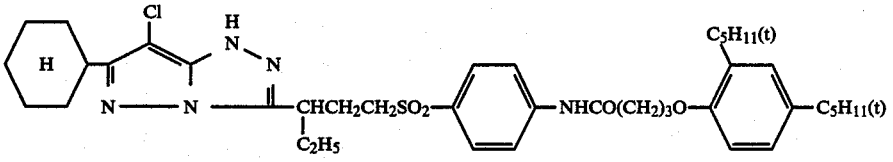
(M-II-95)
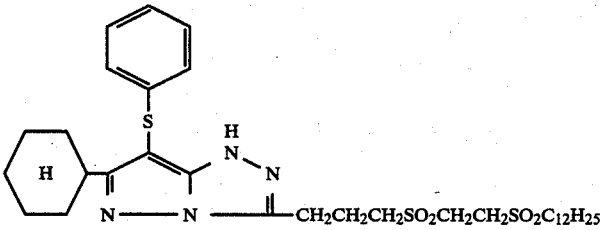
(M-II-96)
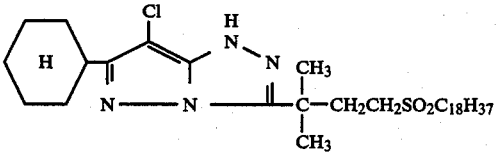
(M-II-97)
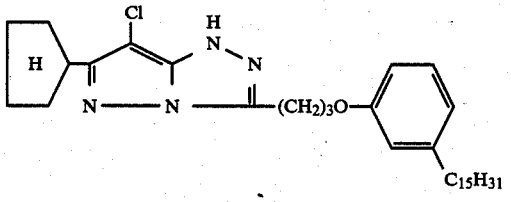

-continued
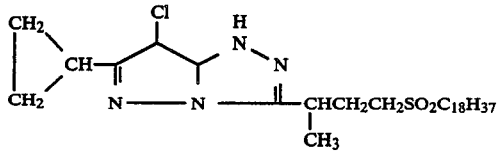
(M-II-98)
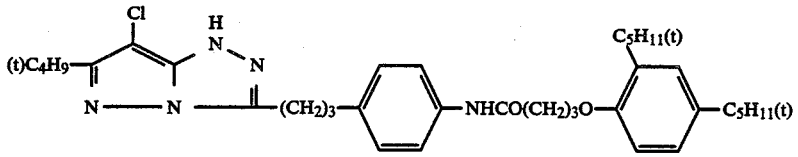
(M-II-99)
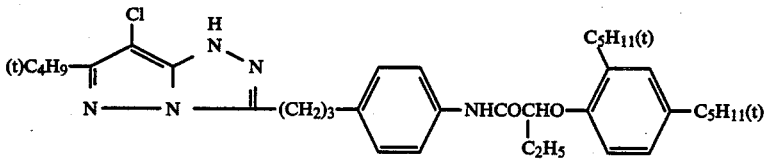
(M-II-100)
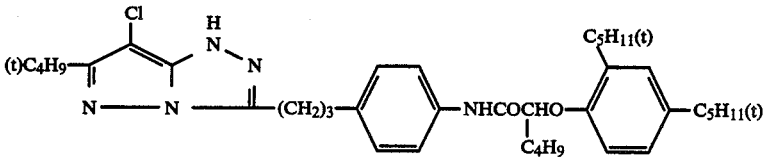
(M-II-101)
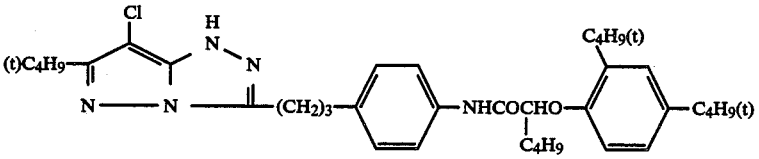
(M-II-102)
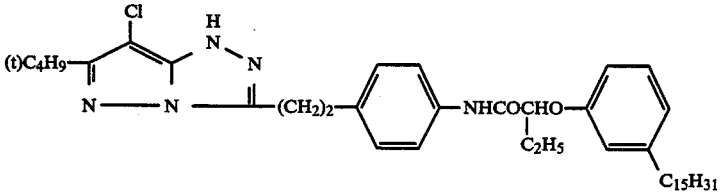
(M-II-103)
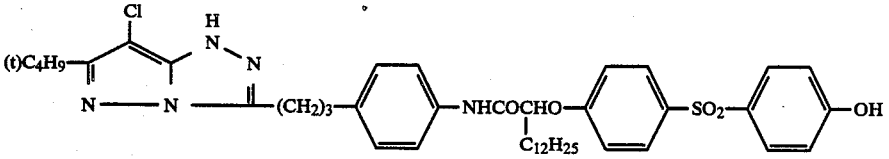
(M-II-104)
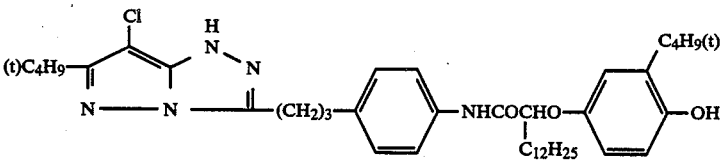
(M-II-105)
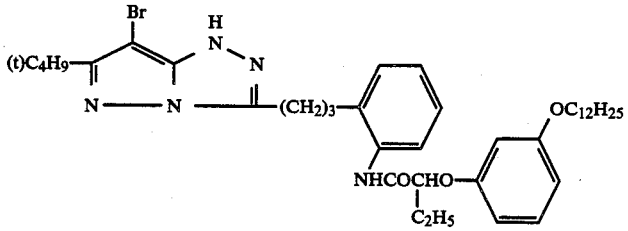
(M-II-106)

-continued
(M-II-107)
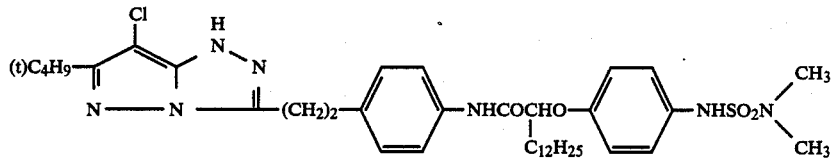
(M-II-108)
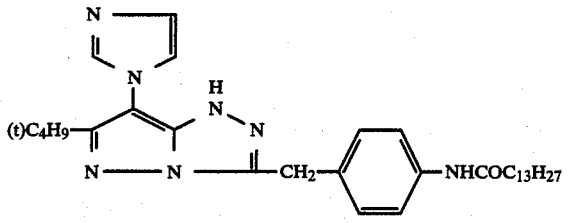
(M-II-109)
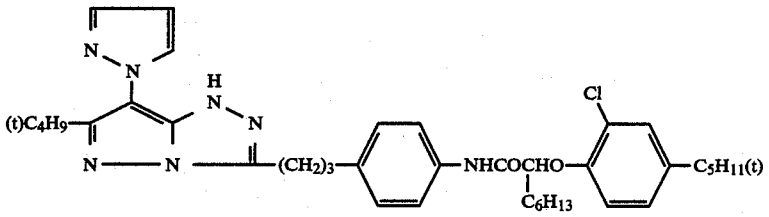
(M-II-110)
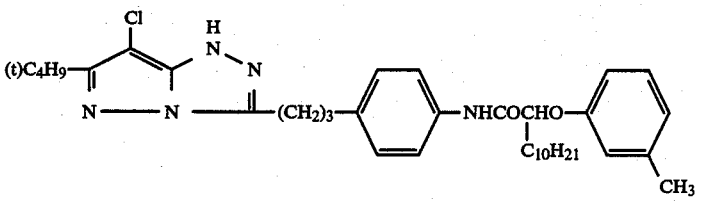
(M-II-111)
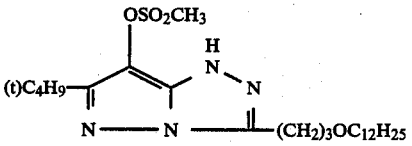
(M-II-112)
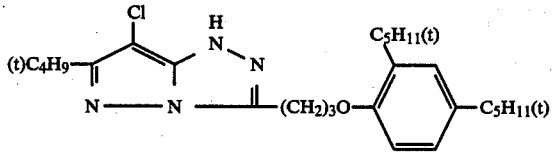
(M-II-113)
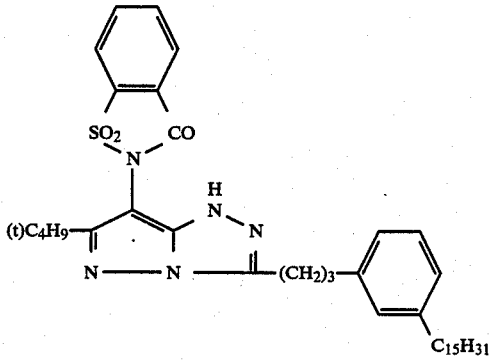

-continued
(M-II-114)
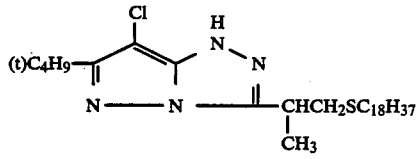
(M-II-115)
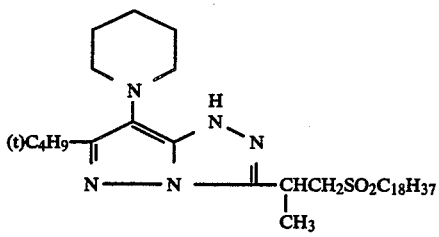
(M-II-116)
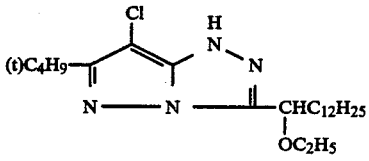
(M-II-117)
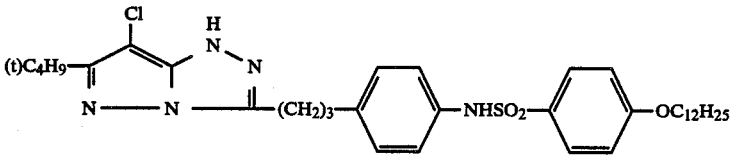
(M-II-118)
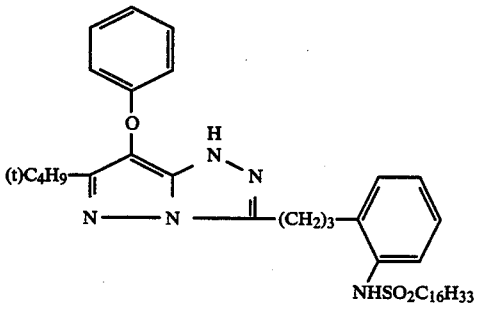
(M-II-119)
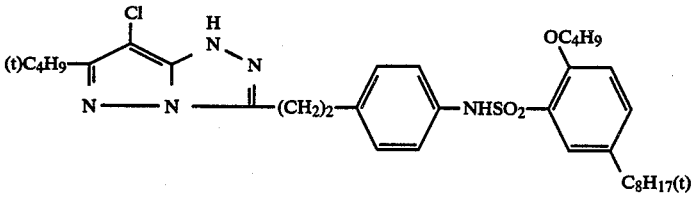
(M-II-120)
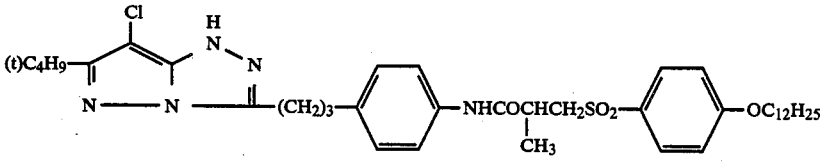
(M-II-121)
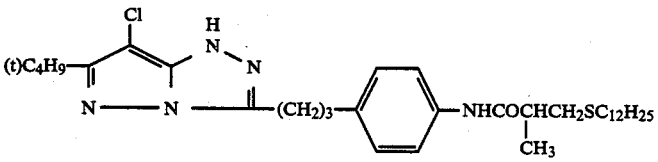

-continued
(M-II-122)
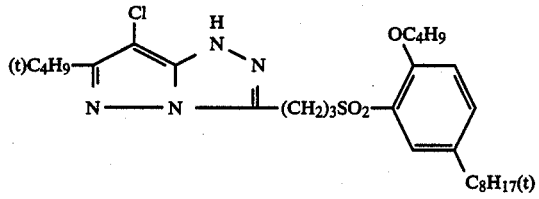
(M-II-123)
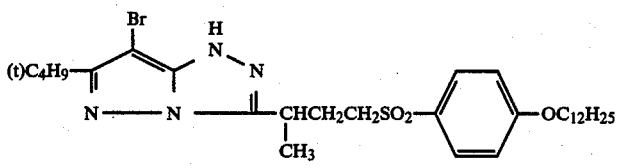
(M-II-124)
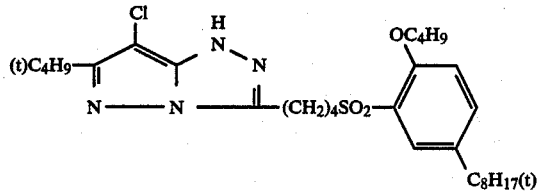
(M-II-125)
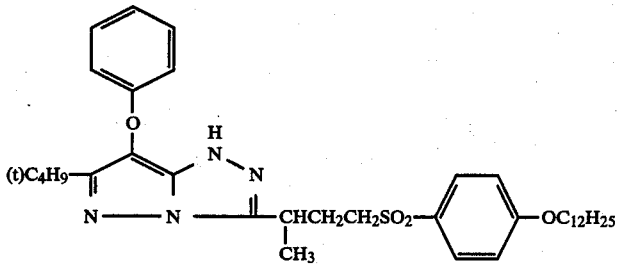
(M-II-126)
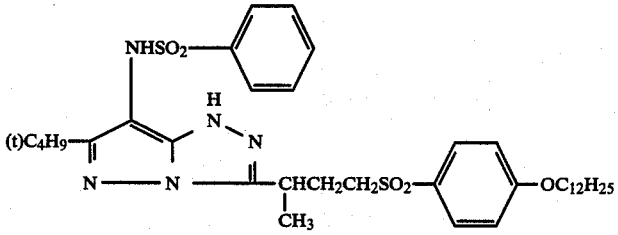
(M-II-127)
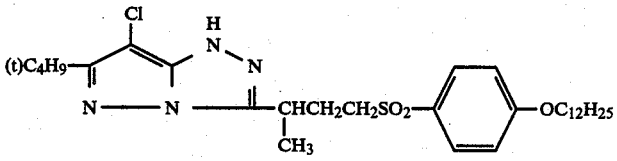
(M-II-128)
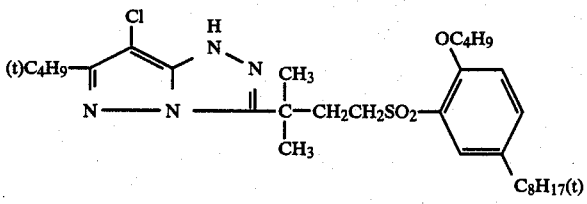
(M-II-129)
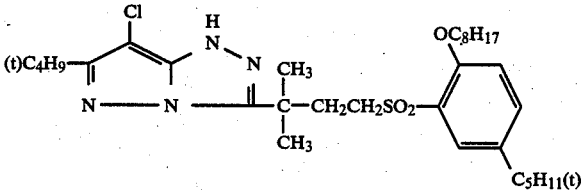

-continued
(M-II-130)
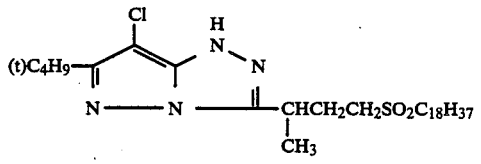
(M-II-131)
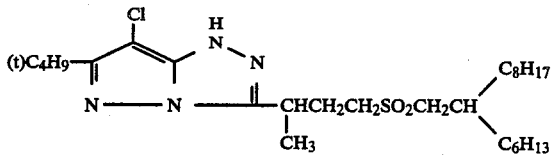
(M-II-132)
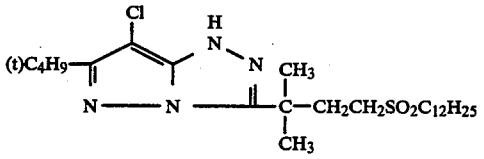
(M-II-133)
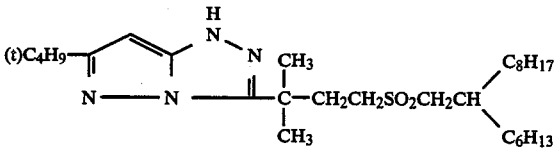
(M-II-134)
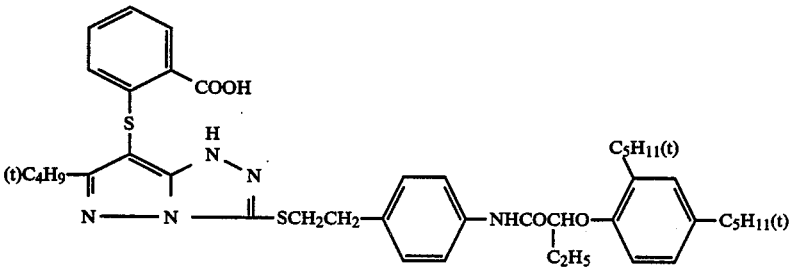
(M-II-135)
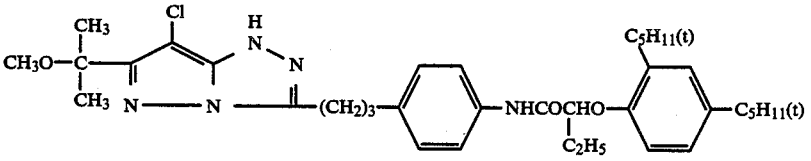
(M-II-136)
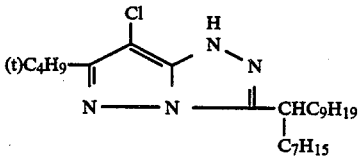
(M-II-137)
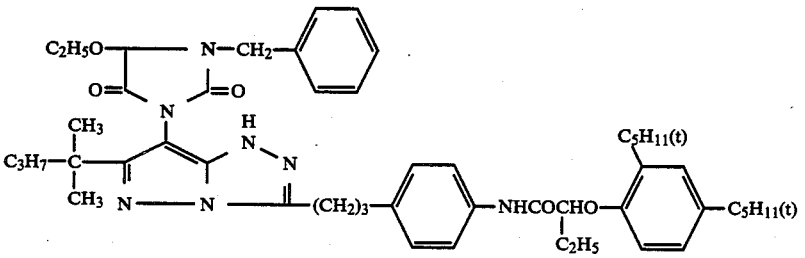

-continued
(M-II-138)
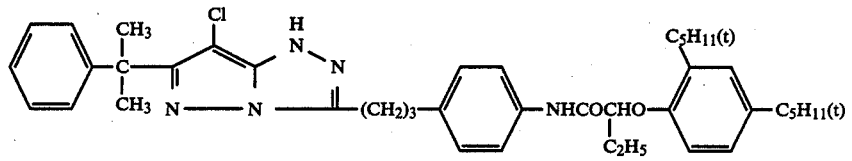
(M-II-139)
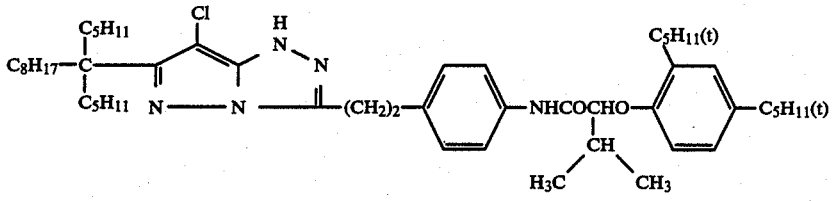
(M-II-140)
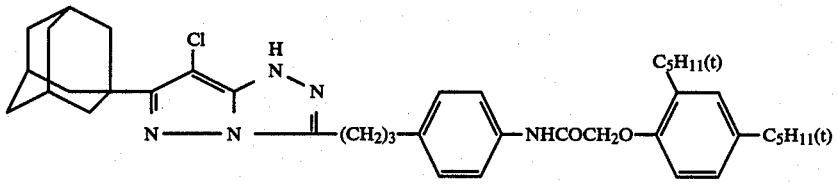
(M-II-141)
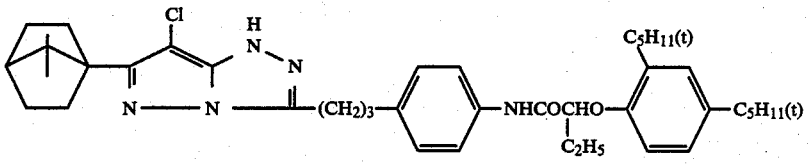
(M-II-142)
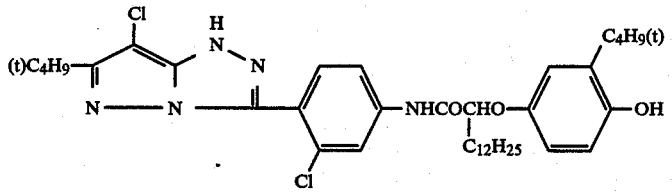
(M-II-143)
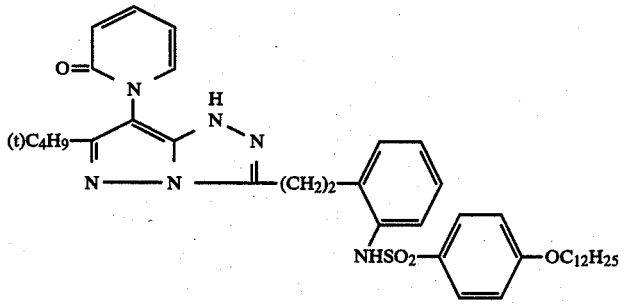
(M-II-144)
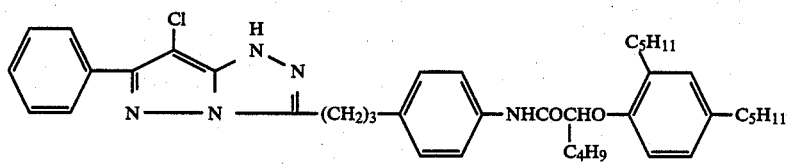
(M-II-145)
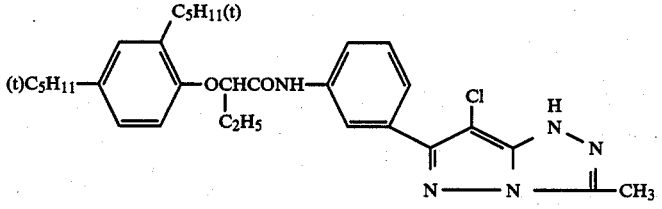

-continued
(M-II-146)
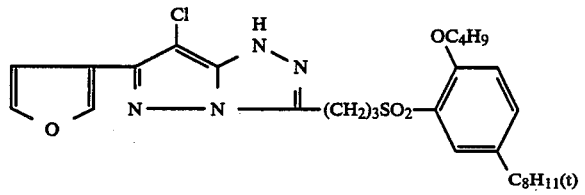
(M-II-147)
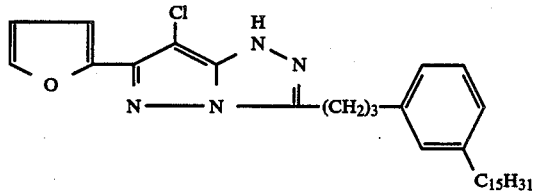
(M-II-148)
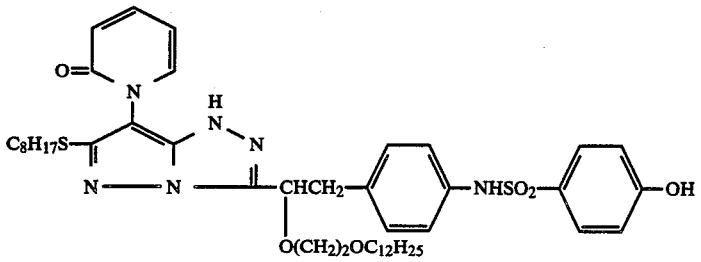
(M-II-149)
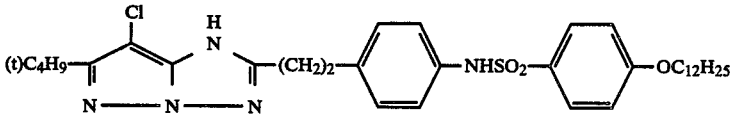
(M-II-150)
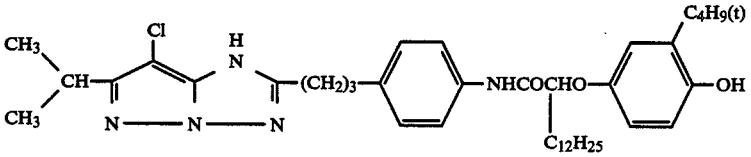
(M-II-151)
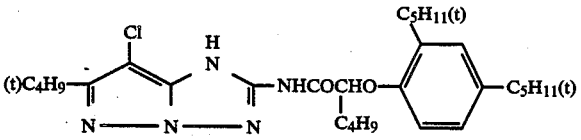
(M-II-152)
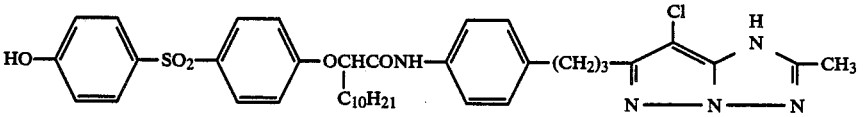
(M-II-153)
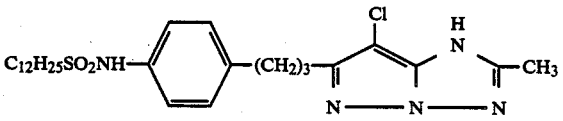
(M-II-154)
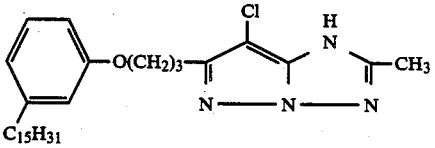

-continued
(M-II-155)
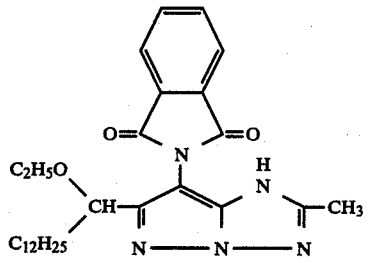
(M-II-156)
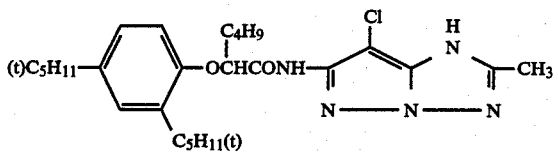
(M-II-157)
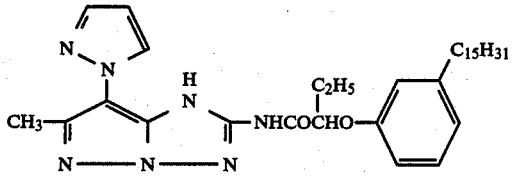
(M-II-158)
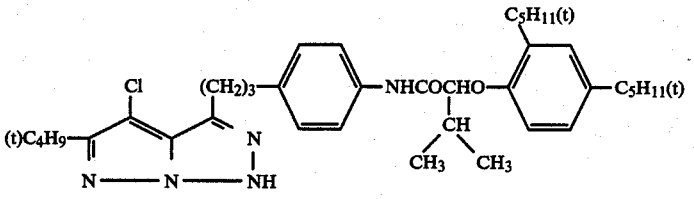
(M-II-159)
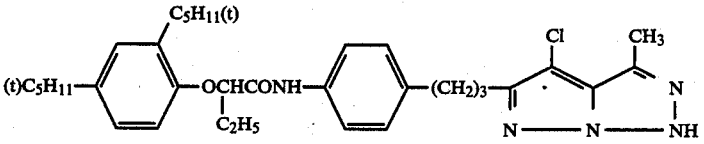
(M-II-160)
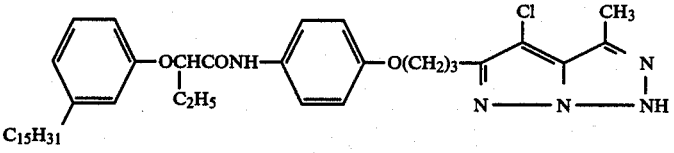
(M-II-161)
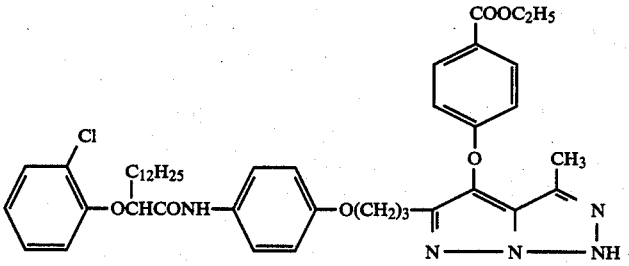
(M-II-162)
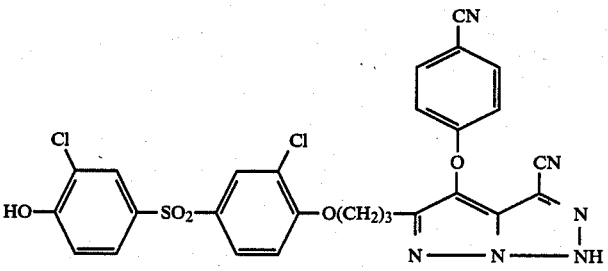

-continued
(M-II-163)
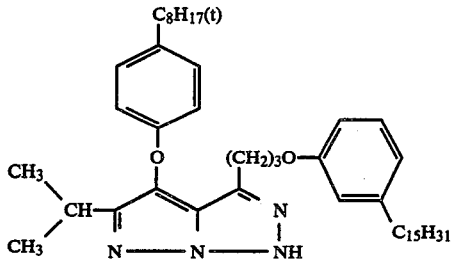
(M-II-164)
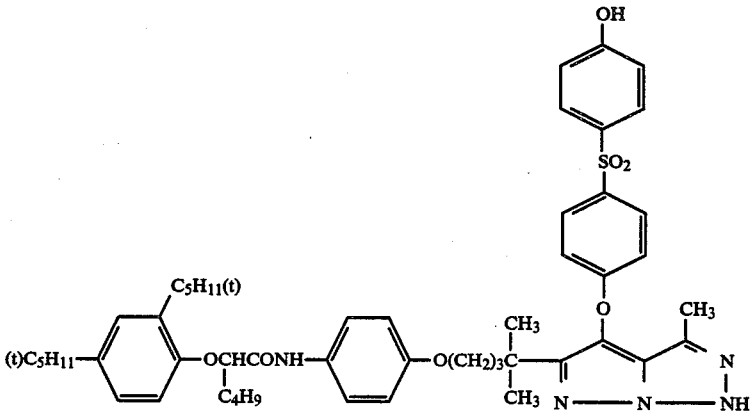
(M-II-165)
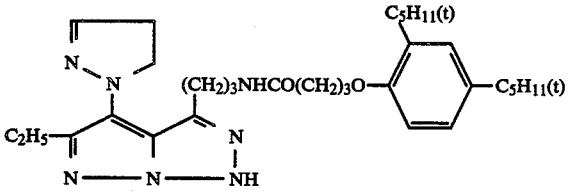
(M-II-166)
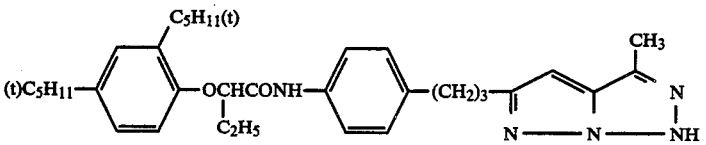
(M-II-167)
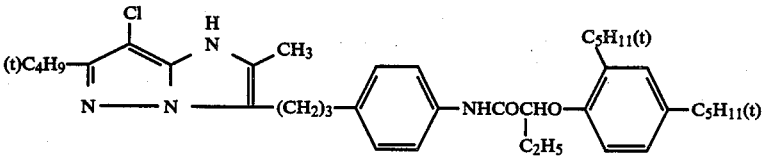
(M-II-168)
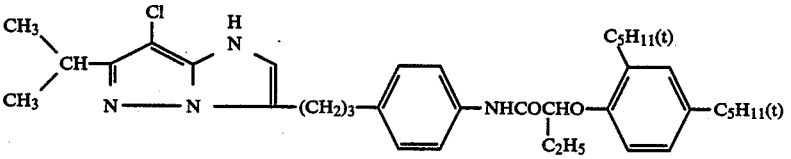
(M-II-169)
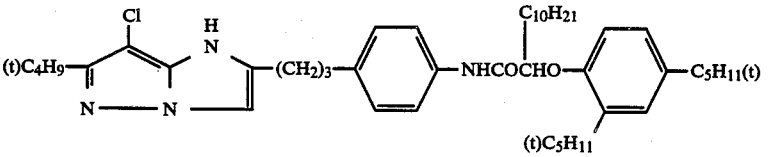

-continued
(M-II-170)
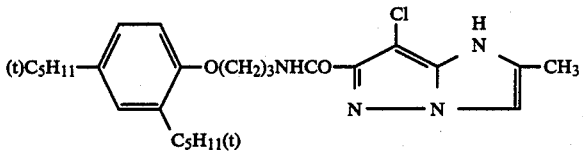
(M-II-171)
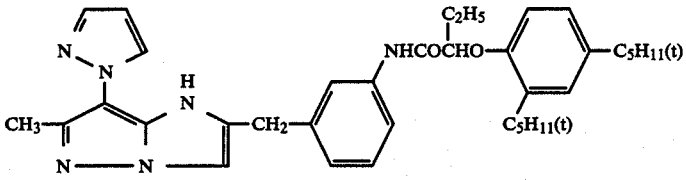
(M-II-172)
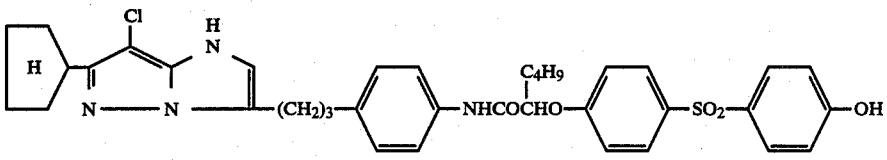
(M-II-173)
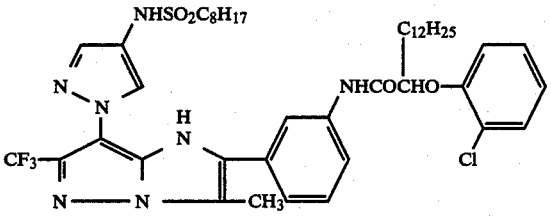
(M-II-174)
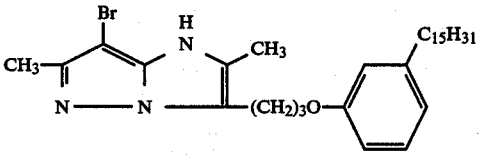
(M-II-175)
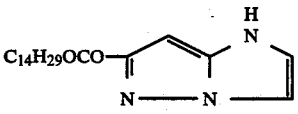
(M-II-176)
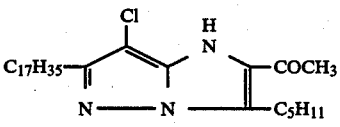
(M-II-177)
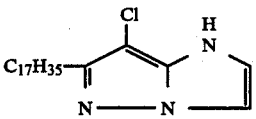
(M-II-178)
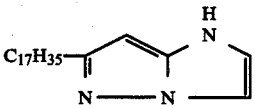
(M-II-179)
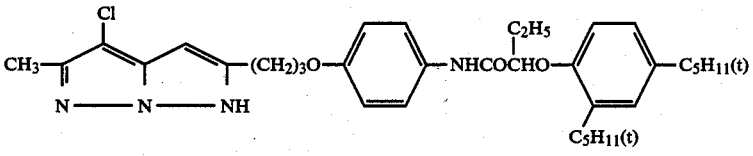

-continued
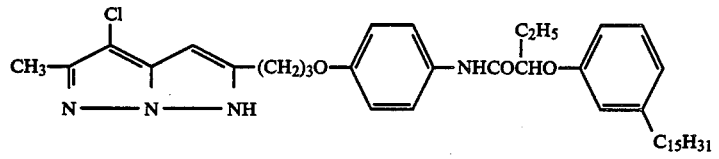
(M-II-180)
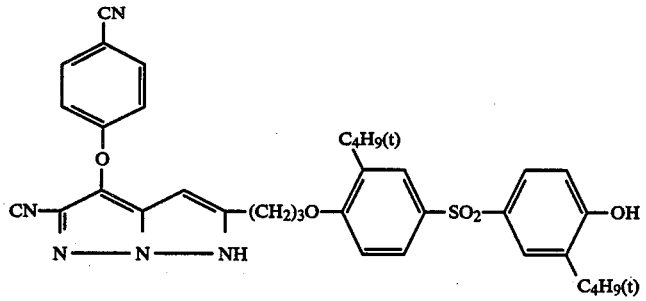
(M-II-181)
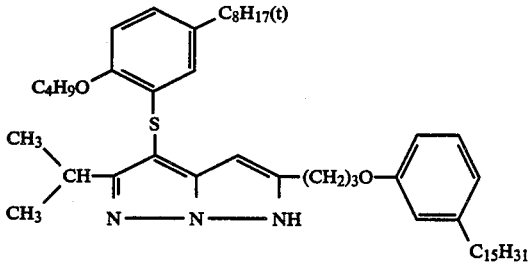
(M-II-182)
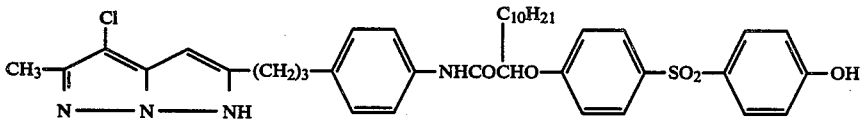
(M-II-183)
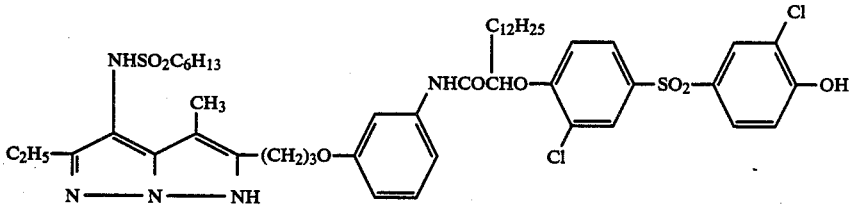
(M-II-184)
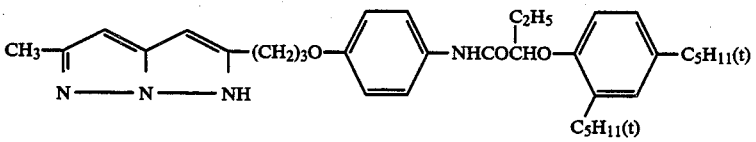
(M-II-185)
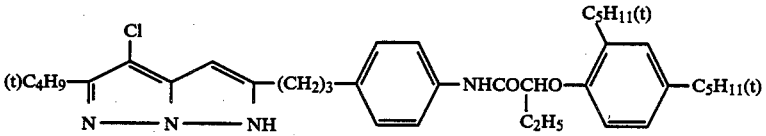
(M-II-186)
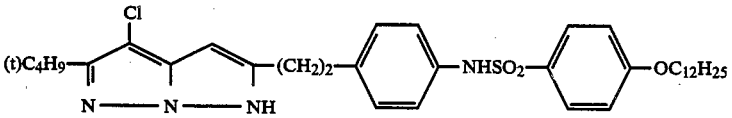
(M-II-187)

-continued
(M-II-188)
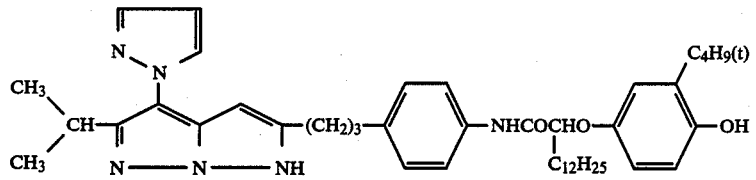
(M-II-189)
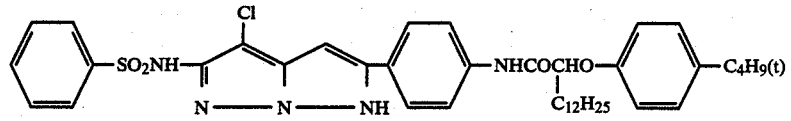
(M-II-190)
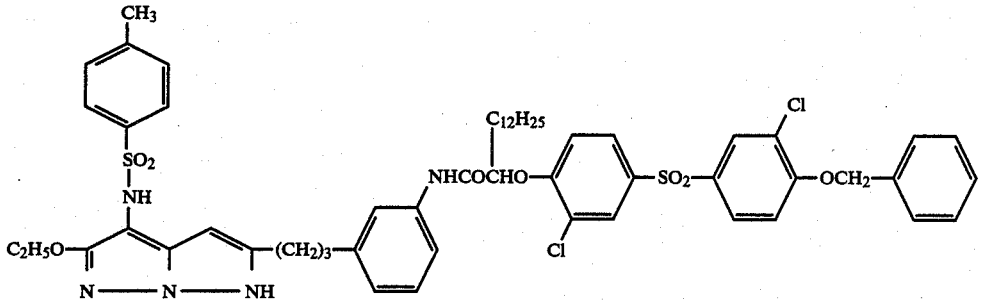
(M-II-191)
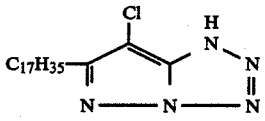
(M-II-192)
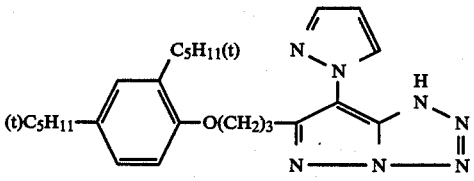
(M-II-193)
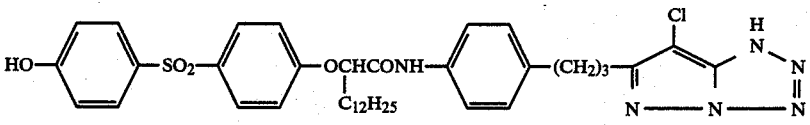
(M-II-194)
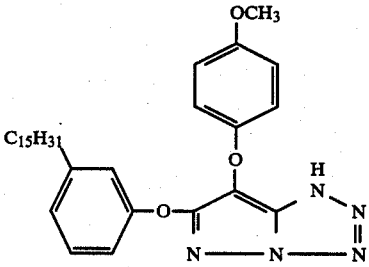
(M-II-195)
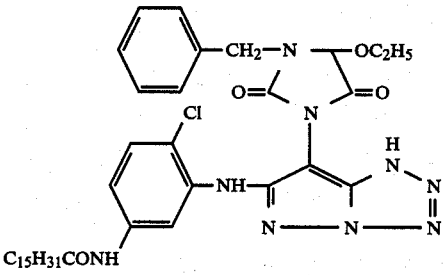

-continued

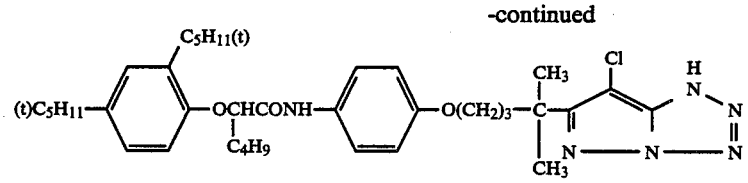

(M-II-196)

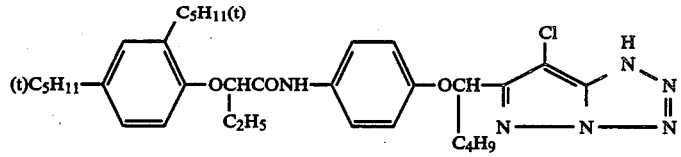

(M-II-197)

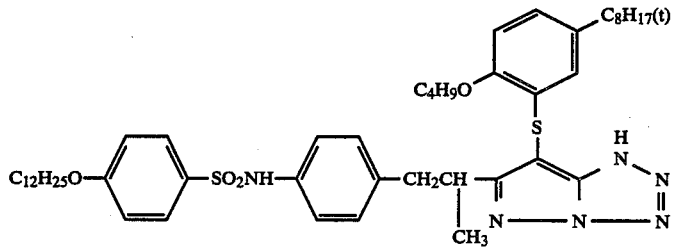

(M-II-198)

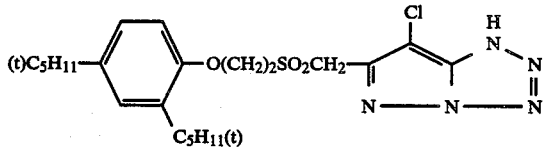

(M-II-199)

The above-mentioned couplers can be synthesized by referring Journal of the Chemical Society, Perkin I (1977) 2047–2052 and U.S. Pat. No. 3,725,067, Japanese Patent O.P.I. Publication No. 99437/1984, 42045/1983, 162548/1984, 171956/1984, 33552/1985 and 436591/1985.

Couplers used in this invention can be used in a range of $1\times10^{-3}$ mol–1 mol per mol of silver halide and preferably in a range $1\times10^{-2}$ mol–$8\times10^{-1}$ mol. They can also be used mixed with other magenta couplers.

Polymer couplers used in this invention can be obtained by polymerizing the coupler monomers. The general formula of a preferable monomer of the yellow polymer coupler is as shown in [CIII]. Preferable monomer of cyan coupler has the general formula [CIV] or [CV]. Preferable monomer of magenta coupler has the general formula [CVI], [CVII] or [CVIII].

General formula [CIII] Yellow coupler monomer (b)

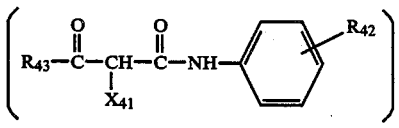

(a)

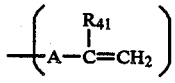

where, $R_{41}$ is a hydrogen atom or methyl group, $R_{42}$ is a hydrogen atom, an alkyl group having 1 to 4 carbon atoms, an alkoxy group, a halogen atom, sulfo, carboxy, sulfonamide, carbamoyl, sulfamoyl (for example, alkylsulfamoyl) or cyano group.

$R_{43}$ is alkyl or aryl group.

$X_{41}$ is a group which can release when it is coupled with oxidized product of aromatic primary amine developing agent. Examples are a hydrogen atom, a halogen atom, or groups directly bonded with nitrogen atom of the coupling position by an oxygen atom thereof such as aryloxy, carbamoyloxy, carbamoylmethoxy, acyloxy, sulfonamide and succinic imido group. Or else, the releasable groups described in U.S. Pat. No. 3,471,563, Japanese Patent Examined Publication Nos. 36894/1973, 37425/1972, 10135/1975, 117422/1975, 130441/1975, 108841/1976, 120334/1975, 18315/1977, 52423/1978 and 105226/1978 can be used.

In the above general formula [CIII], the branch (b) is the yellow-coloring component and the branch (a) is a group containing polymerizable vinyl group at least one of which is substituted to one position of (b). "A" represents —NHCO— (carbon atom is connected to the vinyl group) or

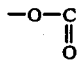

(carbon atom is connected to the vinyl group) or —O— bridging

Cyan coupler monomer

General formula [CIV]

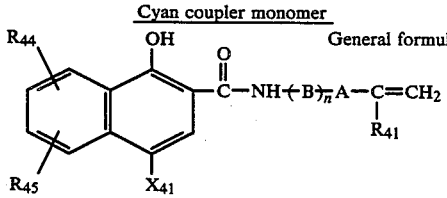

-continued

Cyan coupler monomer

General formula [CV]

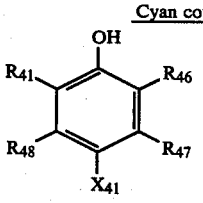

In general formula [CIV], $R_{41}$, A and $X_{41}$ are the same as those in the formula [CIII]. $R_{44}$ and $R_{45}$ are the same as $R_{41}$ and $R_{42}$ in the formula [CIII], respectively. B is a bivalent organic group and n indicates 0 or 1. Actual examples of B are:

(1) alkylene group having carbon numbers 1–12;
(2) arylene group having carbon numbers 6–12;
(3) arylene-alkylene group having carbon numbers 7–24;
(4) arylenebisalkylene group having carbon numbers 8–32;
(5) alkylenebisarylene group or iminoarylenealkylene group respectively having carbon numbers 13–34.

In general formula [CV], $R_{47}$ and $R_{49}$ are the same as $R_{41}$ and $R_{42}$ in general formula [CIII], respectively. $X_{41}$ is same as that in general formula [CIII]. $R_{46}$ and $R_{48}$ are respectively a hydrogen atom, an alkyl group having carbon numbers 1–8, an alkoxy group, a halogen atom, a sulfo group, a carbamoyl group, a carboxy group, a sulfamoyl group, a group represented by NH-L (where, L is alkoxy-carbonyl or alkylcarbanmoyl group), R'—CO— or R'—$SO_2$— group (where, R' is aliphatic, aromatic or heterocyclic group), as well as substitutable acryloylamino, metacryloylamino, acryloyloxy and metacryloyloxy groups. At least one of $R_{46}$ and $R_{48}$ should have a polymerizable vinyl group as shown in the general formula [CIII](a) as the end substituente.

Magenta coupler monomer

General formula [CVI]

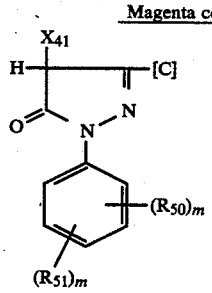

where $X_{41}$ is the same as that in general formula [CIII].
$R_{50}$ is the same as $R_{42}$ in [CIII].
$R_{51}$ is the same as $R_{46}$ and $R_{48}$ in [CV].
[C] is the same as $R_{46}$, $R_{48}$ in [CV] or a group shown as:

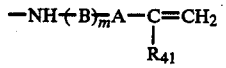

in this formula $R_{41}$, A and B is the same as those in general formula [CIV].
m is an integer of 0 to 3.
At least either [C] or $R_{51}$ should have a group containing polymerizable vinyl group asd shown in [CIII](a).

General formula [CVII]

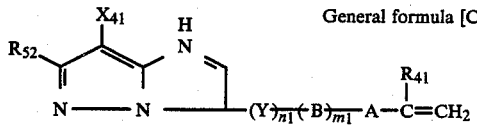

General formula [CVIII]

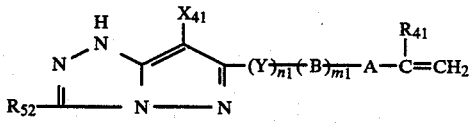

In general formulas [CVI], [CVII] and [CVIII], $X_{41}$ is same as that in [CIII] and $R_{52}$ is one of the following groups:

hydrogen atom, hydroxyl group, respectively substituted or non-substituted alkyl, aryl, heterocycle of 5–6 members, alkylamino, acylamino, anilino, alkoxycarbonyl, alkylcarbonyl, arylcarbonyl, alkylthio, carbamoyl, sulfamoyl, or sulfonamide group.

A, B are the same as those in [CIV] and Y is —O—, —NH—, —S—, —SO—, —$SO_2$—, —CONH—, —COO—, —NHCO or —NHCONH—, as for $m_1$ and $n_2$, when $n_1=1$, $m_1=1$, and when $n_1=0$, $m_1=0$ or 1.

m is an integer of 0–3.

Actual examples of coupler monomers are shown below. Compounds used in this invention are, however, not limited to these.

(Examples of coupler monomers)

(1)

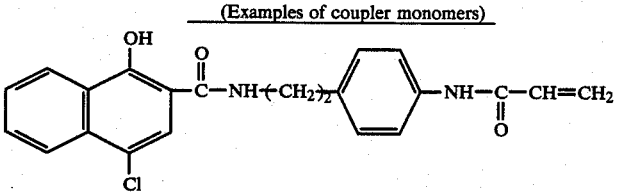

(2)

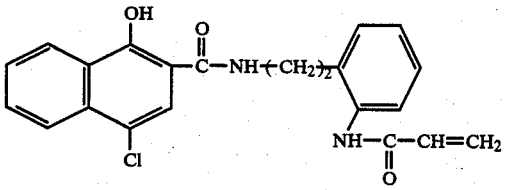

(3)

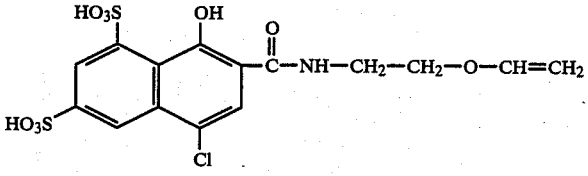

-continued
(Examples of coupler monomers)
(4)
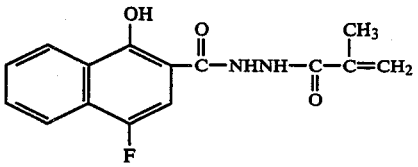
(5)
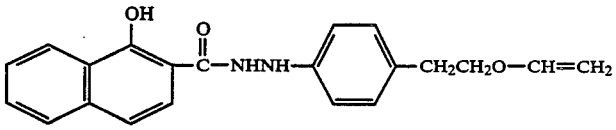
(6)
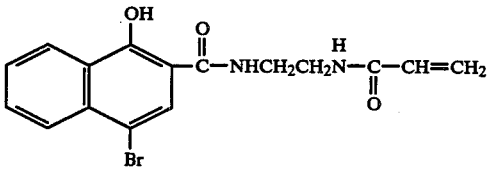
(7)
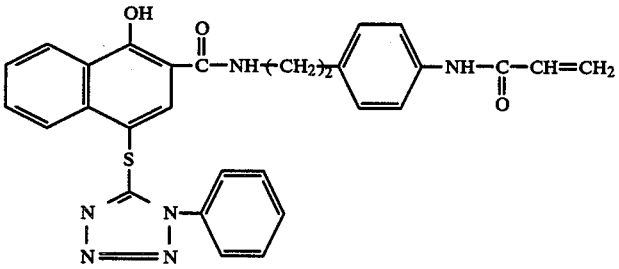
(8)
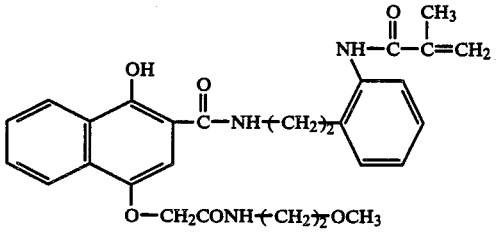
(9)
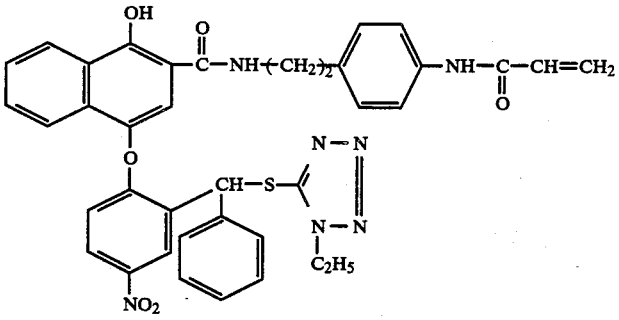
(10)
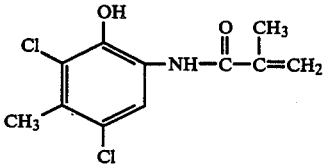
(11)
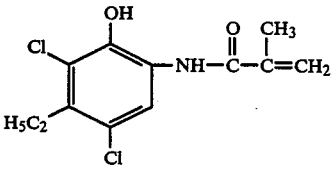
(12)
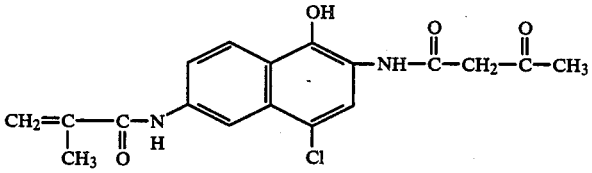

-continued
(Examples of coupler monomers)
(13)
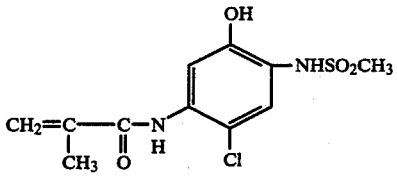
(14)
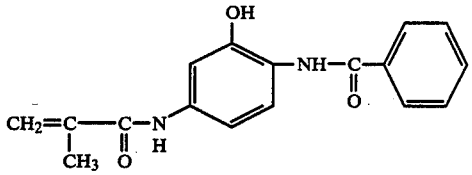
(15)
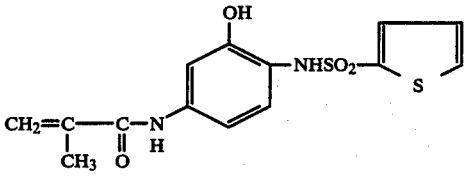
(16)
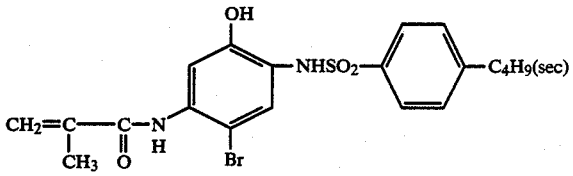
(17)
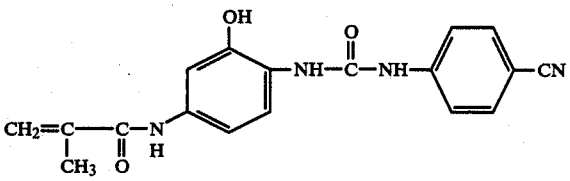
(18)
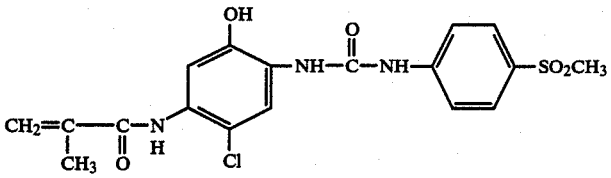
(19)
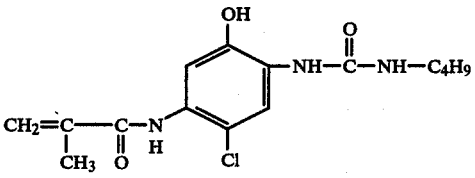
(20)
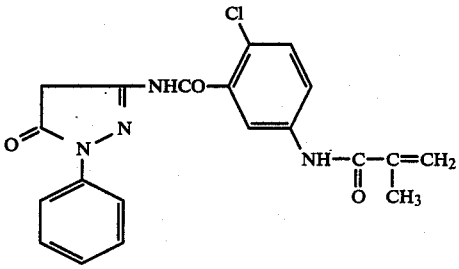
(21)
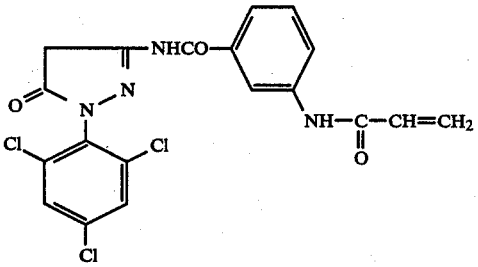
(22)
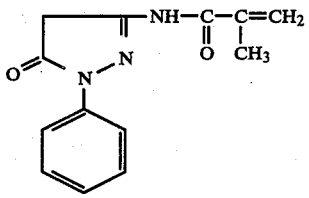
(23)
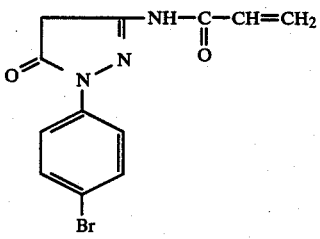
(24)
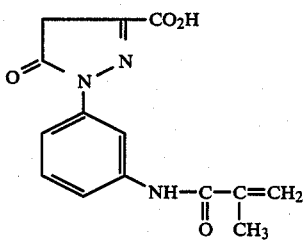

-continued
(Examples of coupler monomers)
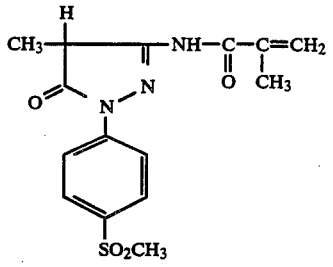
(25)
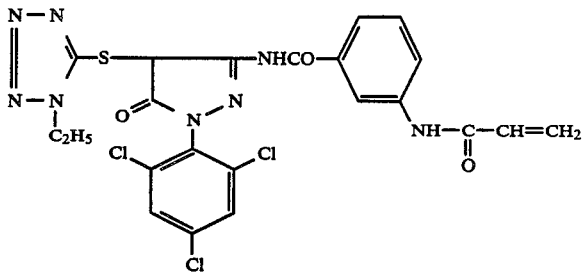
(26)
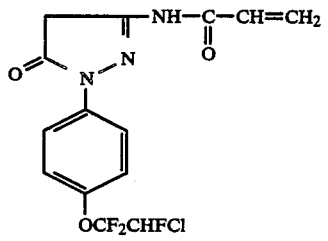
(27)
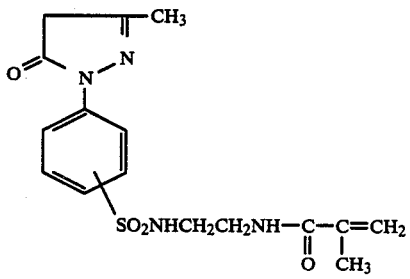
(28)
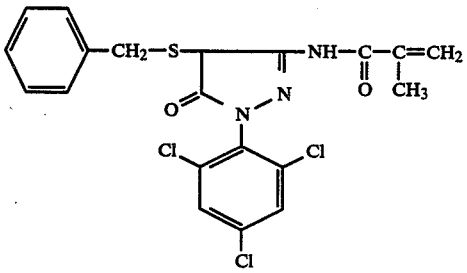
(29)
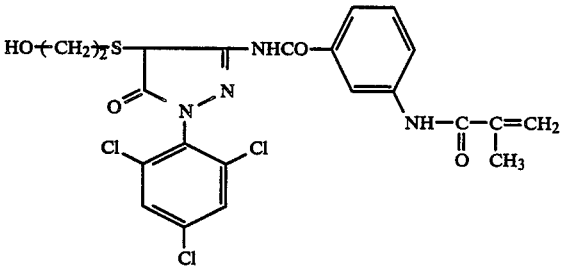
(30)
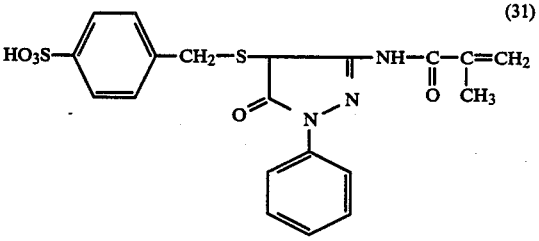
(31)
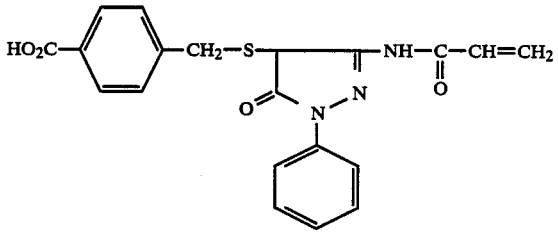
(32)
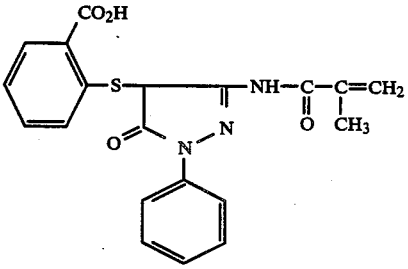
(33)
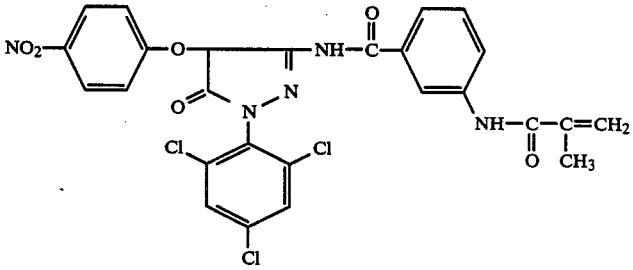
(34)

-continued
(Examples of coupler monomers)
(35)
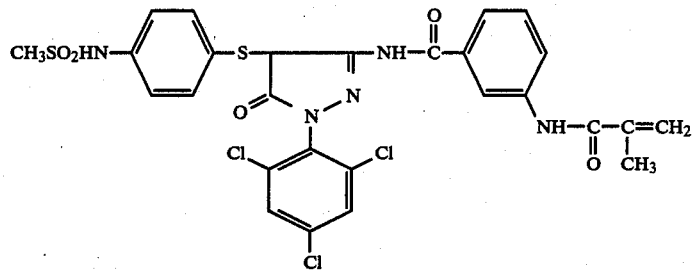
(36)
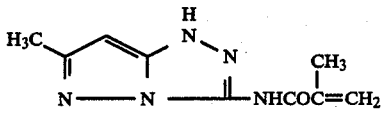
(37)
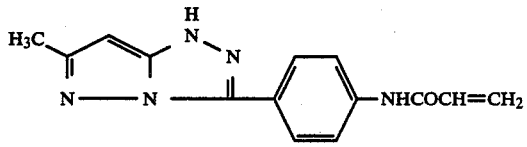
(38)
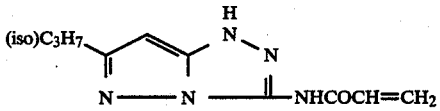
(39)
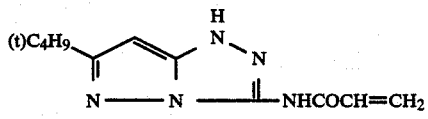
(40)
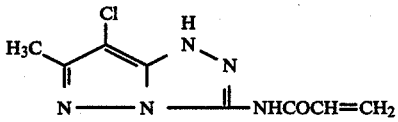
(41)
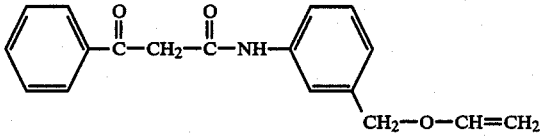
(42)
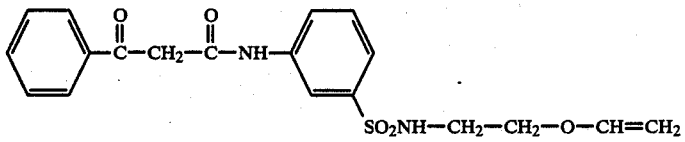
(43)
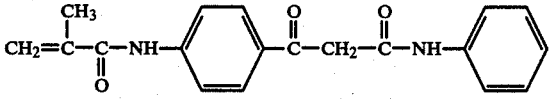
(44)
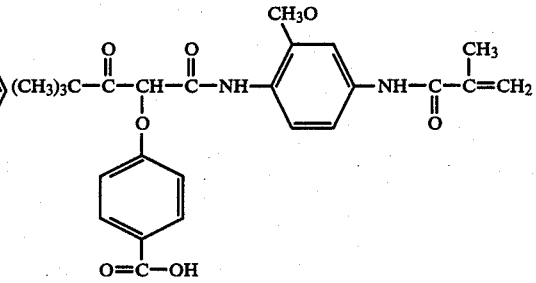
(45)
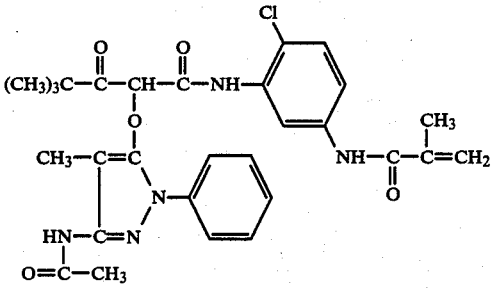
(46)
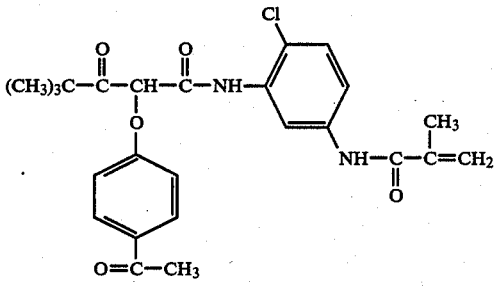

-continued (Examples of coupler monomers)

(47)

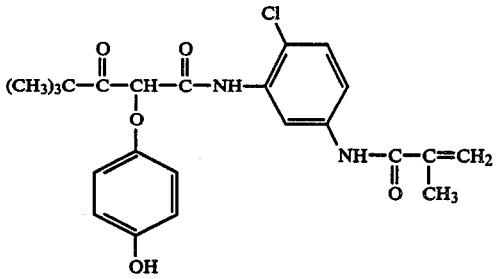

(48)

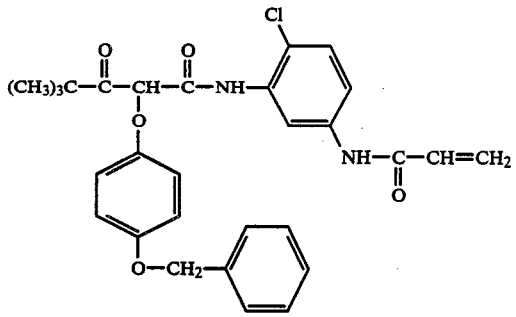

(49)

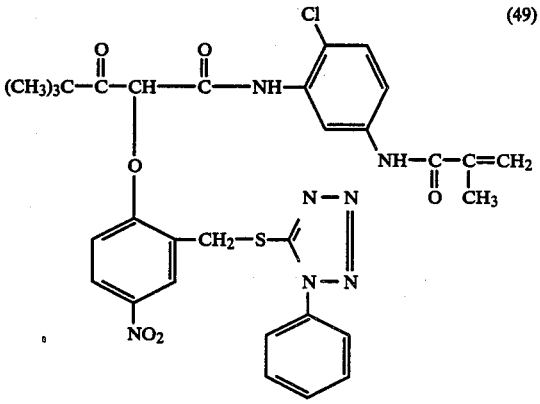

(50)

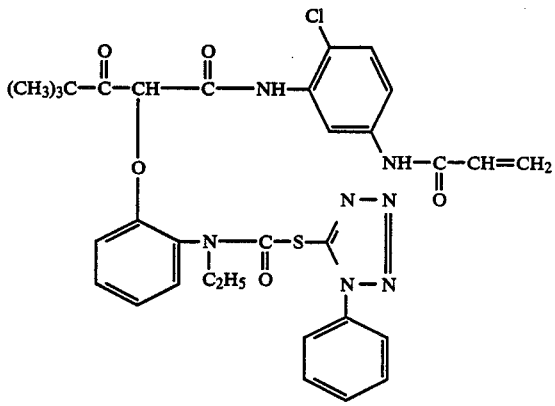

Actual examples of polymers may be used in this invention as polymer coupler latex obtained from aforementioned coupler monomers. This invention is not limited to these polymers.

[Examples of polymer couplers]

(P-1)

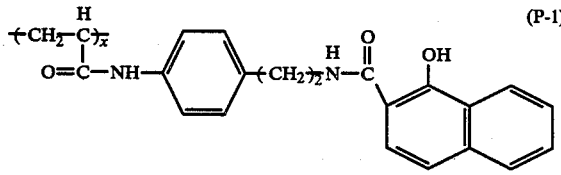

x = 60 weight %

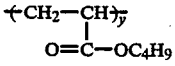

y = 40 weight %

(P-2)

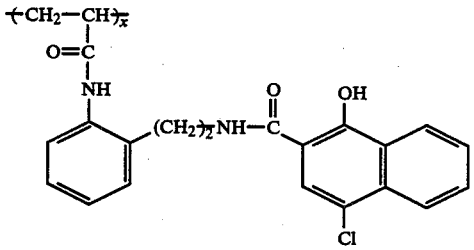

x = 70 weight %

-continued

[Examples of polymer couplers]

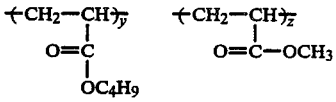

y = 20 weight % z = 10 weight %

(P-3)

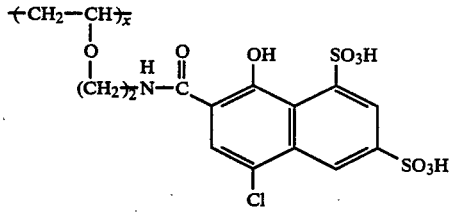

x = 80 weight %

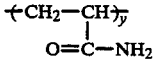

y = 20 weight %

(P-4)

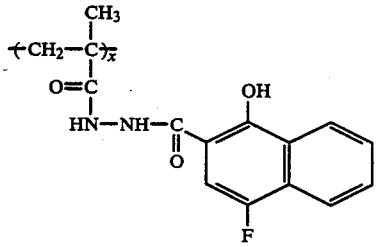

x = 90 weight %

-continued
[Examples of polymer couplers]
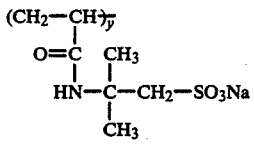
y = 5 weight %
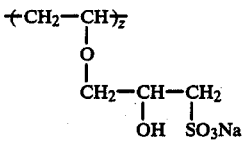
z = 5 weight %
(P-5)
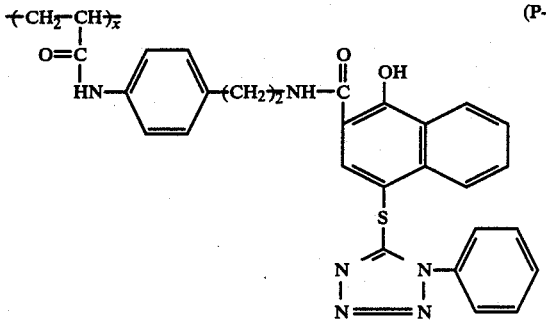
x = 60 weight %
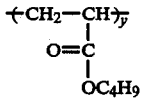
y = 40 weight %
(P-6)
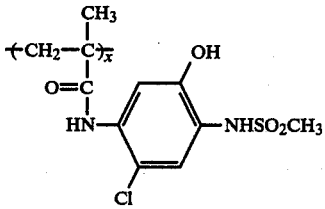
x = 100 weight %
(P-7)
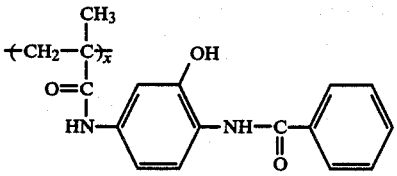
x = weight %
(P-8)
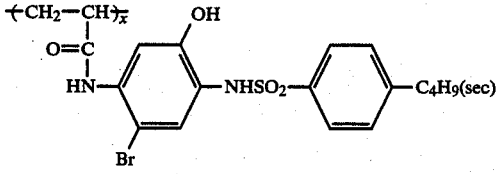
x = 65 weight %
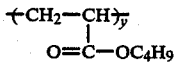
y = 35 weight %
-continued
[Examples of polymer couplers]
(P-9)
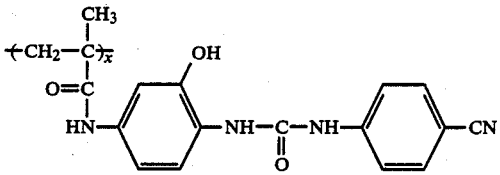
x = 90 weight %
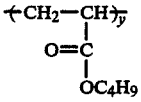
y = 10 weight %
(P-10)
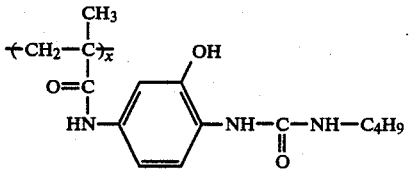
x = 55 weight %
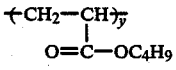
y = 45 weight %
(P-11)
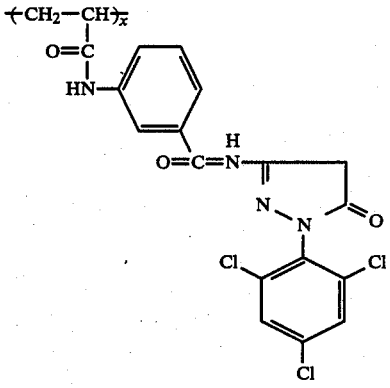
x = 80 weight %
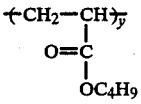
y = 20 weight %
(P-12)
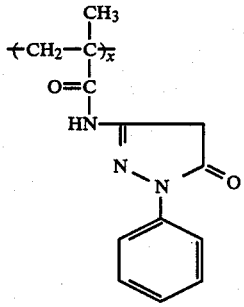
x = 100 weight %

-continued
[Examples of polymer couplers]
(P-13)
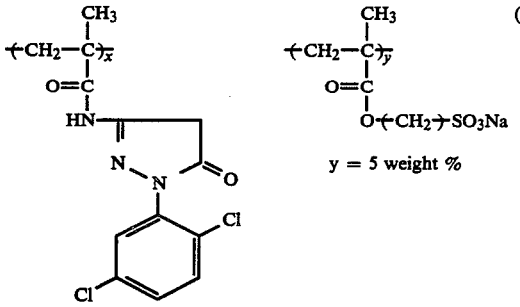
x = 85 weight %
y = 5 weight %
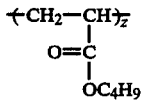
z = 10 weight %
(P-14)
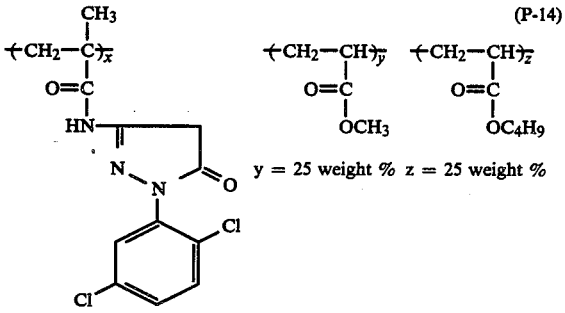
x = 50 weight %
y = 25 weight % z = 25 weight %
(P-15)
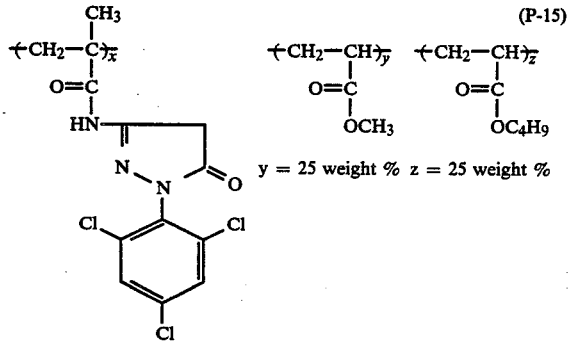
x = 50 weight %
y = 25 weight % z = 25 weight %
(P-16)
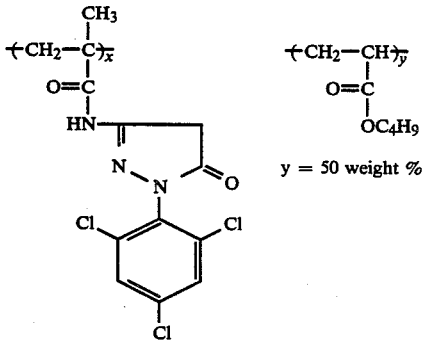
x = 50 weight %
y = 50 weight %
-continued
[Examples of polymer couplers]
(P-17)
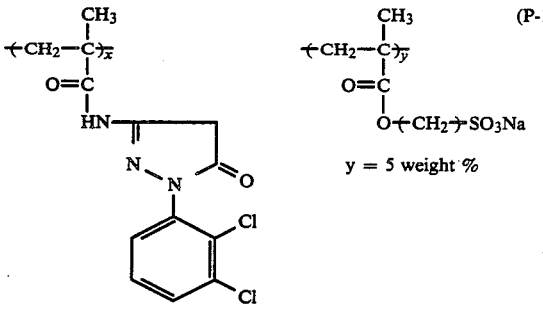
x = 85 weight %
y = 5 weight %
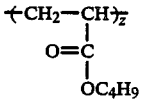
z = 10 weight %
(P-18)
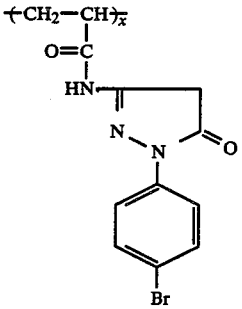
x = 100 weight %
(P-19)
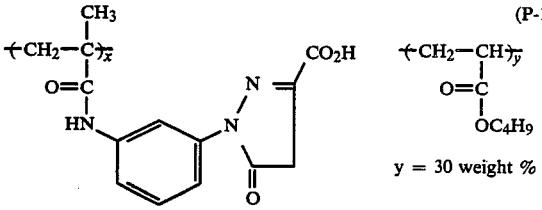
x = 70 weight %
y = 30 weight %
(P-20)
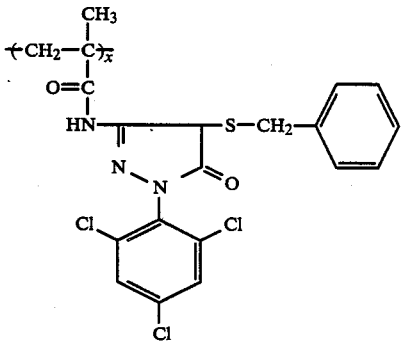
x = 80 weight %

-continued
[Examples of polymer couplers]
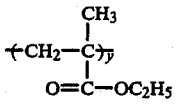
y = 15 weight %
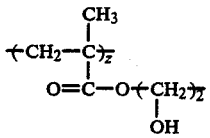
z = 5 weight %
(P-21)
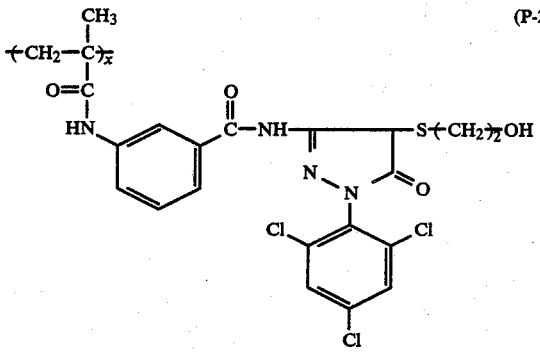
x = 80 weight %
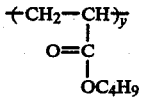
y = 20 weight %
(P-22)
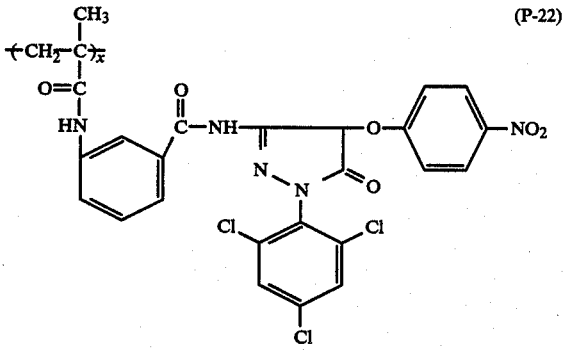
x = 70 weight %
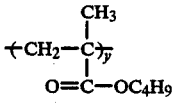
y = 30 weight %
(P-23)
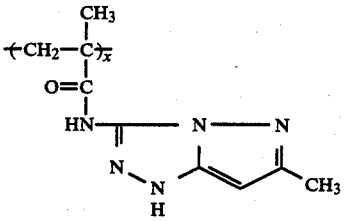
x = 50 weight %
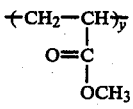
y = 50 weight %
-continued
[Examples of polymer couplers]
(P-24)
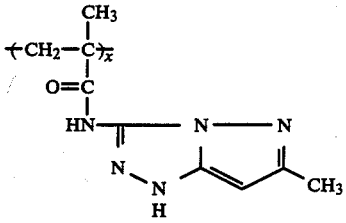
x = 50 weight %
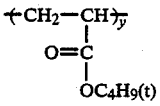
y = 50 weight %
(P-25)
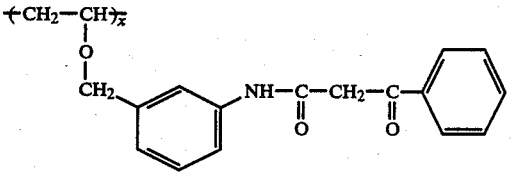
x = 80 weight %
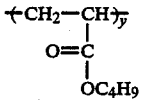
y = 20 weight %
(P-26)
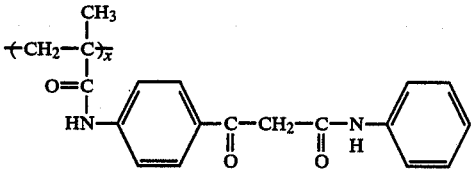
x = 55 weight %
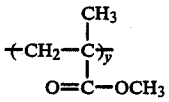
y = 45 weight %
(P-27)
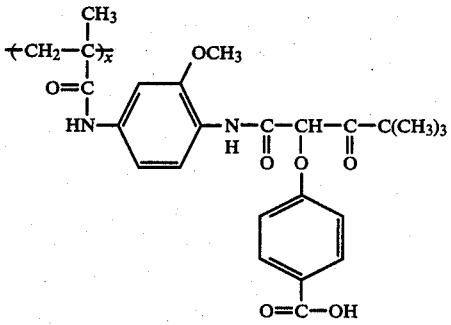
x = 90 weight %
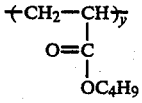
y = 10 weight %

-continued
[Examples of polymer couplers]
(P-28)
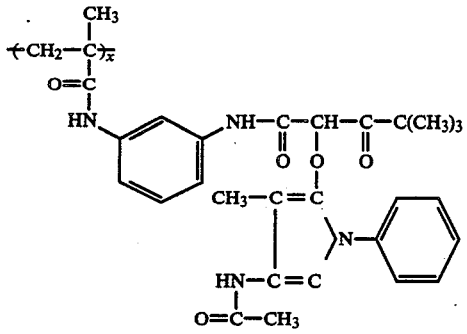
x = 95 weight %
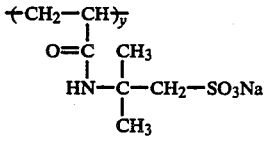
y = 5 weight %
(P-29)
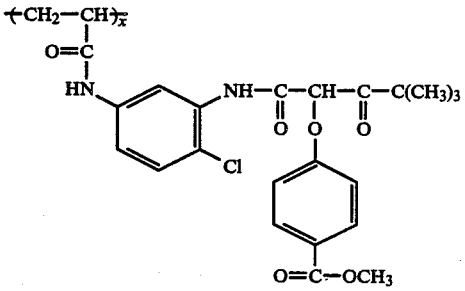
x = 50 weight %
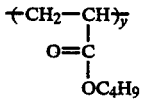
y = 50 weight %
(P-30)
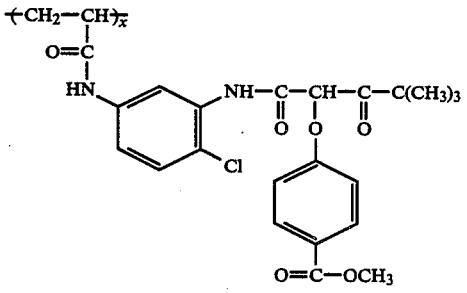
x = 100 weight %
-continued
[Examples of polymer couplers]
(P-31)
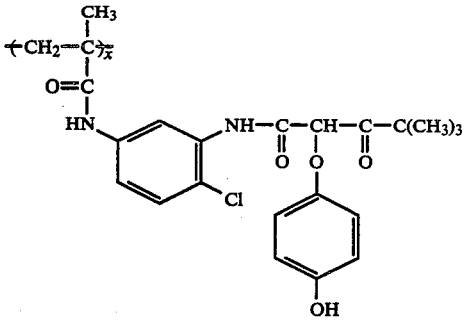
x = 60 weight %
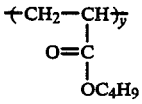
y = 40 weight %
(P-32)
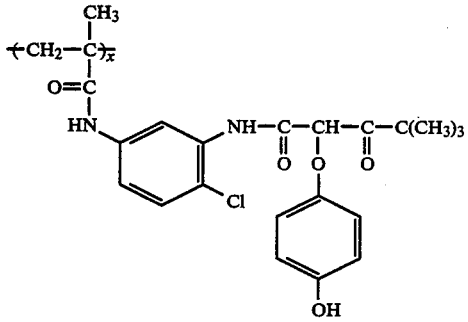
x = 100 weight %
(P-33)
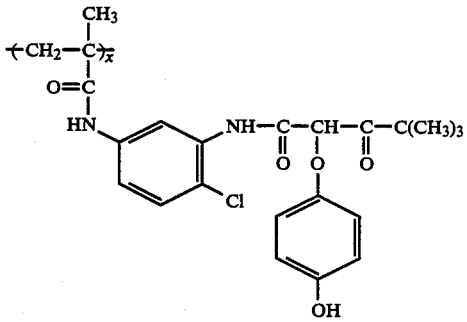
x = 70 weight %

-continued

[Examples of polymer couplers]

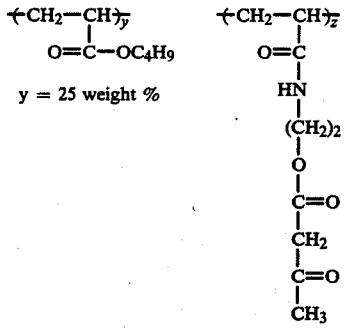

y = 25 weight % z = 5 weight %

Preferable addition amount of polymer couplers may be used in photographic sensitive materials in this invention is 0.005–0.5 mol per mole of silver halide in emulsion layer. More preferably, it is 0.05–0.3 mol.

In general, it is difficult to improve the granularity and the sharpness of color image in color-photosensitive materials simultaneously. However, the bleach-fixing solution of this invention succeeded to improve the granularity and sharpness simultaneously by using above-mentioned polymer coupler. The mechanism of this effect has not been elucidated yet. Probably it relates to the fact that the amount of the high boiling point solvent used for the dispersion of the coupler and the thickness of emulsion layer could be reduced by the use of polymer coupler. By the use of this photographic sensitive material, the sharpness and granularity become inferior if a minute amount of silver remains after the bleaching-fixing treatment. Since silver is almost perfectly removed by the method of this invention, the very high sharpness and granularity can be obtained.

Polymer couplers used in this invention can be used accompanied with generally known following photographic couplers:

Applicable photographic cyan couplers are phenolic and naphthalic compounds shown in:

U.S. Pat. Nos. 2,369,922, 2434,272, 2,474,293, 2,895,826, 3,253,924, 3,034,892, 3,311,476, 3,386,301, 3,419,390, 3,458,315, 3,476,563 and 3,591,383

Synthetic methods are also described in the patent reports.

As photographic magenta couplers, following compounds are used:

pyrazolones, pyrazolotriazols, pyrazolino-benzimidazols, indazolons.

Pyazolone series magenta couplers are described in:

U.S. Pat. Nos. 2,600,788, 3,062,653, 3,127,269, 3,311,476, 3,419,391, 3,519,429, 3,558,318, 3,684,514, 3,888,680,

Japanese Patent O.P.I. Publication Nos. 29639/1974, 111631/1974, 129538/1974, 13041/1975, 47167/1978, 10491/1979, 30615/1980

Pyrazolotriazol series magenta couplers are described in:

U.S. Pat. No. 1,247,394 and

Belgium Pat. No. 792,525

As non-diffusible colored magenta couplers, colorlessed magenta couplers having substituted by arylazol groups at the coupling position are generally used. They are described in:

U.S. Pat. Nos. 2,801,171, 2,983,608, 3,005,712 and 3,684,514,

British Pat. No. 937,621,

Japanese Patent O.P.I Publication Nos. 123625/1974, 31448/1974.

Moreover, another type colored magenta couplers can also be used in which the dye flows into the treating solution by reaction with the oxidized product of developing agent (U.S. Pat. No. 3,419,391).

As photographic yellow couplers open-chain ketomethylene compounds have been used. Widely used type yellow couplers such as benzoylacetoanilide-type yellow couplers and pivaloylacetoanilide-type yellow couplers can be used. Moreover, a di-equivalent type yellow coupler in which the carbon atom of coupling position is substituted by a substitute group which is releasable when the coupling reaction occurs. Examples are shown with synthetic methods in the following literature:

U.S. Pat. Nos. 2,875,057, 3,265,506, 3,664,841, 3,408,194, 3,277,155, 3,447,928, 3,415,652

Japanese Patent Examined Patent No. 13576/1974

Japanese Patent O.P.I. Publication Nos. 29432/1973, 66834/1973, 10736/1974, 122335/1974, 28834/1975, 132926/1975

Used amount of above-mentioned non-diffusible couplers is, in general, 0–1.0 mol per mol of silver in photosensitive silver halide emulsion layers.

As methods for dispersion of above-mentioned couplers various methods can be used such as alkali aqueous solution dispersion method, solid dispersion method, latex dispersion method, oil-in-water type emulsifying dispersion method among which it can be selected in accordance with the chemical structure of the coupler.

In this invention, latex dispersion method and oil-in-water emulsion type dispersion method are very effective. These have been well-known and especially about latex dispersion method and its efficiency are described in:

Japanese Patent O.P.I. Publication No. 74538/1974, 59943/1976, 32552/1979 and Research Disclosure No. 1485 (August 1976) pp. 77–779.

Examples of latexes are homopolymers, co-polymers and terpolymers compound from monomers such as:

styrene, ethylacrylate, butylacrylate, butylmethacrylate, 2-acetoacetoxyethylmetacrylate, 2-(metacryloyloxy) ethyltrimethylammonium metal sulfate, 3-(metacryloyloxy) propane-1-sulfonic acid sodium salt, N-isopropylacrylamide, N-[2-(2-methyl-4-oxopentyl)]acrylamide and 2-acrylamide-2-methylpropane sulfonic acid.

As the oil-in-water type emulsion dispersion process, a conventional method is applicable which disperses a hydrophobic additive such as couplers. For example, couplers are dissolved in a single or mixed solvent composed of a high-boiling point organic solvent (b.p. 175° C. or higher) such as tricresylphosphate or dibulyphthate and/or a low-boiling point organic solvent such as ethylacetate or butylpropionate and then the solution is mixed with an equeous gelatin solution containing a surface active agent. After that, the mixture is put to emulsified dispersion by a high-speed blender or colloid mill and it is directly added to silver halide emulsion or is made to remove the low boiling-point solvent by the widely-known method and then added to silver halide emulsion.

Non-color-forming couplers which can be jointly used with this invention are described in the following literature:

British Pat. Nos.: 861,138, 914,145, 1,109,963

Japanese Patent O.P.I. Publication No. 14033/1970

U.S. Pat. No. 3,580,722 and Mitteilungen aus den Forschenings Laboratorie in der Agfa Leverkusen Vol. 4 pp. 352–367 (1964).

As a hydrophilic binder used to coat silver halide used as a color-photographic light sensitive material, gelatin is usually used but a high polymer can also be used whose layer swelling rate T ½ should be not more than 25 seconds. The swelling rate T ½ can be measured by using a conventional method (For example, a swellometer described by A. Green in Phot. Sci. Eng., Vol. 19, No. 2, pp. 124–129).

T ½ is defined as the time necessary to swell up to the thickness of ½ of the saturated layer thickness. Saturated layer thickness is defined as the 90% of the maximum layer swelling thickness attainable when the film is treated by color developing solution for 3 minutes and 15 seconds at 30° C.

Swelling velocity T ½ of the layer can be adjusted by adding a hardening agent to gelatin as a binder. Examples of hardening agent are:

Aldehyde types, aziridine series (for example, PB report 19,921, U.S. Pat. Nos. 2,950,197, 2,964,404, 2,983,611, 3,271,175, Japanese Patent Examined Publication No. 40898/1971; Japanese Patent O.P.I. Publication No. 91315/1975

Isooxazolium types (for example, U.S. Pat. Nos. 3,321,323).

Epoxy types (for example U.S. Pat. No. 3,047,394; West Germany Pat. No. 1,085,663; British Pat. No. 1,033,518; Japan Patent Examined Publication No. 35495/1973).

Vinyl sulfone types (for example, PB report 19,920; West Germany Pat. Nos. 1,100,942, 2,337,412, 2,545,722, 2,635,518, 2,742,308, 2,749,260; British Pat. No. 1,251,091, U.S. Pat. Nos. 3,539,644, 3,490,911)

Acryloyl types (for example, U.S. Pat. No. 3,640,720)

Carbodiimide types (for example, U.S. Pat. Nos. 2,938,892, 4,043,818, 4,061,499, Japanese Patent Examined Publication No. 38715/1971)

Triazene types (for example, West Germany Pat. Nos. 2,410,973, 2,553,915, U.S. Pat. No. 3,325,287, Japanese Patent O.P.I. Publication No. 12722/1977)

High polymer type (for example, British Pat. No. 822,061, U.S. Pat. Nos. 3,623,878, 3,396,029, 3,226,234, Japanese Patent Examined Publication Nos. 18578/1972, 18579/1972 and 48896/1972)

Others—maleic imide, acetylene, methane-sulforic acid ester, N-methylol types hardening agents can be used singly or by combining.

Examples of efficient combining technique is described in the following literature: for example, West Germany Pat. Nos. 2,447,587, 2,505,746, 2,514,245, U.S. Pat. Nos. 4,047,957. 3,832,181, 3,840,370, Japanese Patent O.P.I. Publication No. 43319/1973, 63062/1975, 127329/1977, Japanese Patent Examined Publication No. 32364/1973.

The swelling rate T ½ of the photographic component layers used in this invention is not more than 25 seconds. The smaller this value the better the quality but it is preferable that lowest limit value is about 1 second since the film cannot be hardened and caused troubles such as scratches when the value is too small. More preferably from more than 2 seconds to less than 20 seconds, especially more preferably less than 15 seconds and most preferably less than 10 seconds. In the case it is longer than 25 seconds, the desilvering—that is, bleach-fixing capability—is worsened. Especially when low-molecular weight organic acid iron (III) complexes are used or when highly concentrated high-molecular weight organic acid iron (III) complexes are used the worsening is remarkable.

Bleaching accelerating agents used in this invention are indicated as general formulas [I]–[VII]. Typical examples are described in the following but are not limited to these.

[Exemplified compounds]

(I-1)

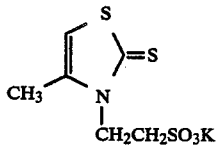

(I-2)

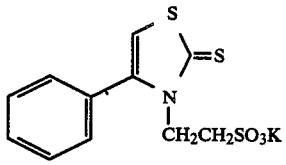

(I-3)

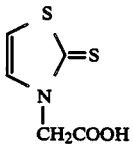

(I-4)

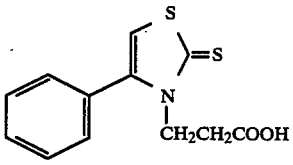

(I-5)

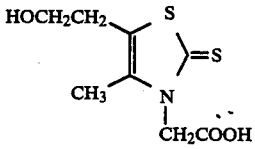

(I-6)

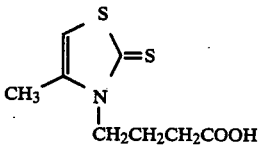

(I-7)

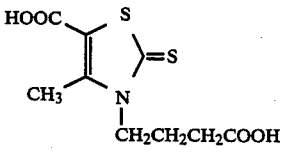

-continued
(I-8)
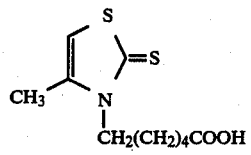
(I-9)
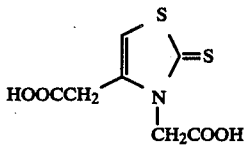
(I-10)
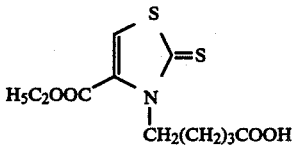
(I-11)
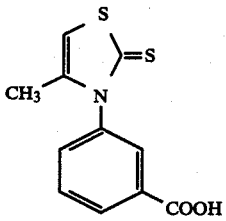
(I-12)
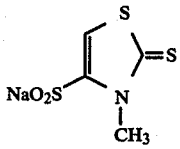
(I-13)
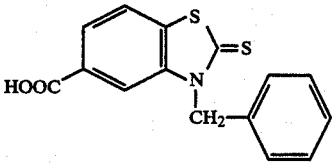
(I-14)
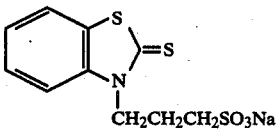
(I-15)
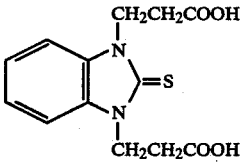
(I-16)
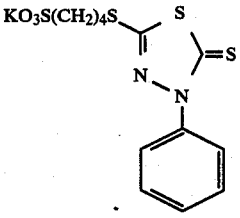
-continued
(I-17)
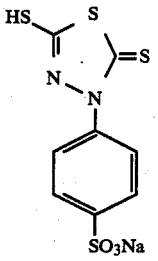
(I-18)
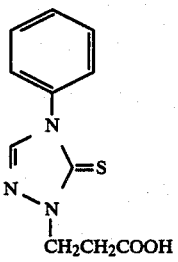
(I-19)
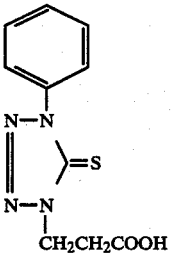
(I-20)
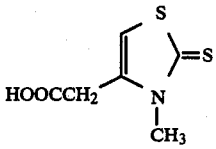
(I-21)
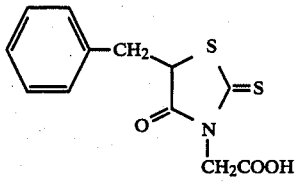
(I-22)
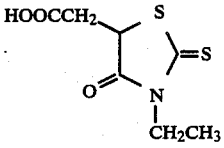
(I-23)
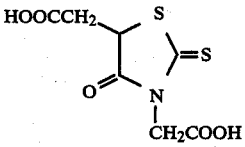
(I-24)
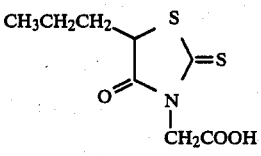

-continued
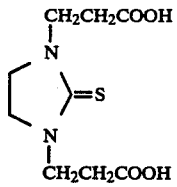
(I-25)
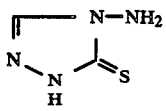
(I-26)
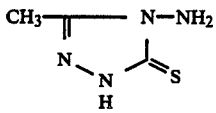
(I-27)
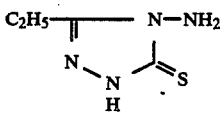
(I-28)
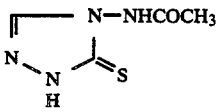
(I-29)
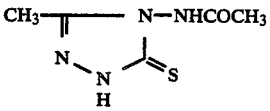
(I-30)
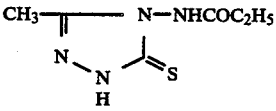
(I-31)
-continued
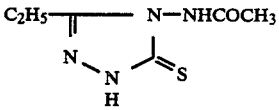
(I-32)
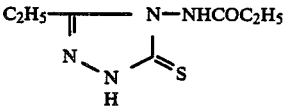
(I-33)
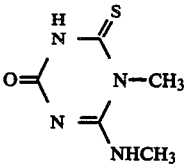
(I-34)
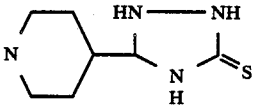
(I-35)
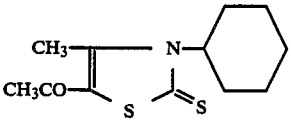
(I-36)
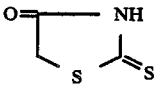
(I-37)
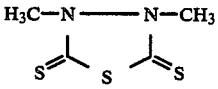
(I-38)
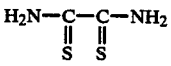
(II-1)
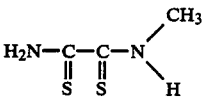
(II-2)
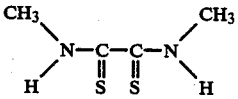
(II-3)
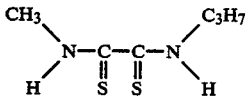
(II-4)
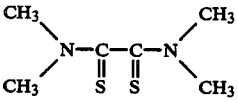
(II-5)
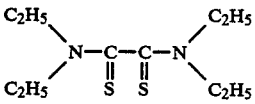
(II-6)
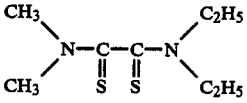
(II-7)
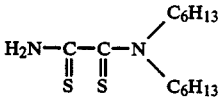
(II-8)
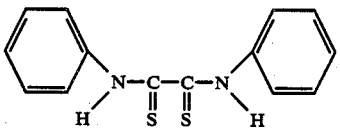
(II-9)
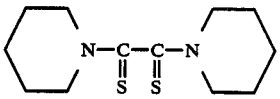
(II-10)

-continued
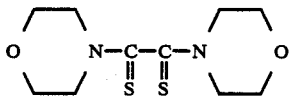
(II-11)
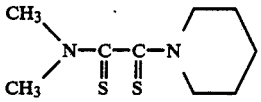
(II-12)
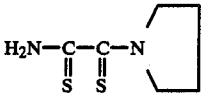
(II-13)
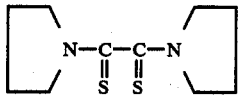
(II-14)
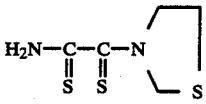
(II-15)
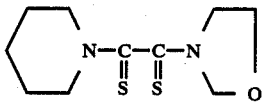
(II-16)
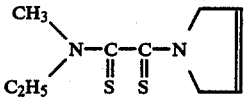
(II-17)
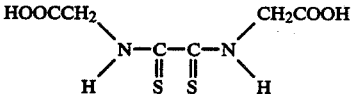
(II-18)
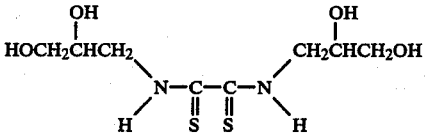
(II-19)
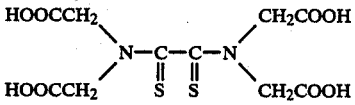
(II-20)
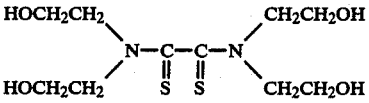
(II-21)
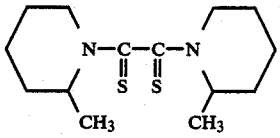
(II-22)
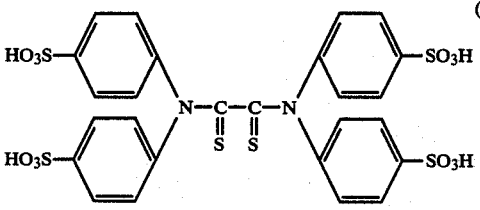
(II-23)
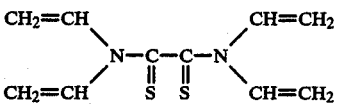
(II-24)
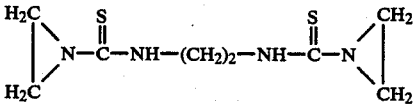
(II-25)
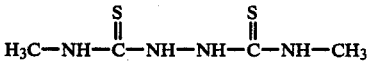
(II-26)
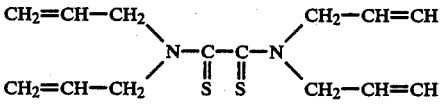
(II-27)
$H_2N-CSNHNHCS-NH_2$
(II-28)
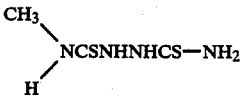
(II-29)
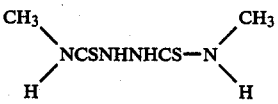
(II-30)
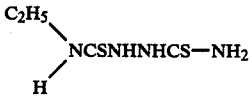
(II-31)
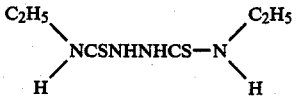
(II-32)
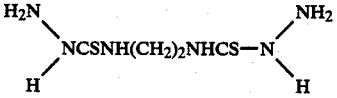
(II-33)
$H_2N-CSNH(CH_2)_2NHCS-NH_2$
(II-34)
$H_2N-CSNH(CH_2)_4NHCS-NH_2$
(II-35)
$H_2N-CSNH(CH_2)_5NHCS-NH_2$
(II-36)

-continued
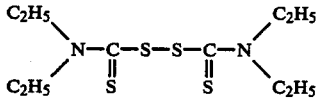
(II-37)
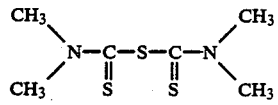
(II-38)
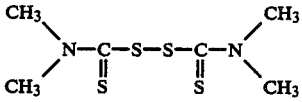
(II-39)
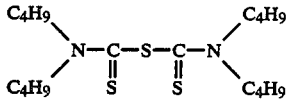
(II-40)
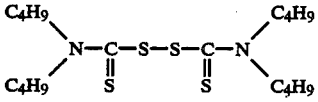
(II-41)
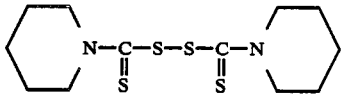
(II-42)
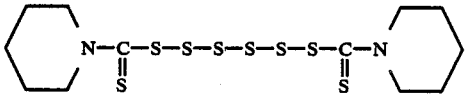
(II-43)
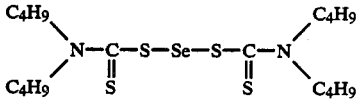
(II-44)
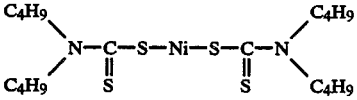
(II-45)
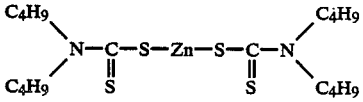
(II-46)
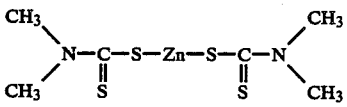
(II-47)
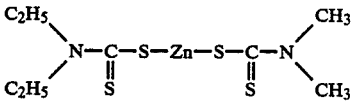
(II-48)
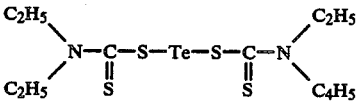
(II-49)
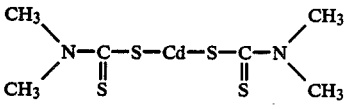
(II-50)
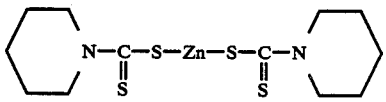
(II-51)
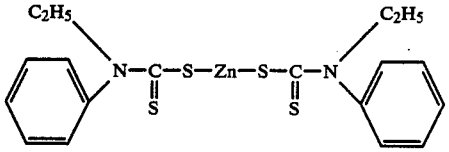
(II-52)
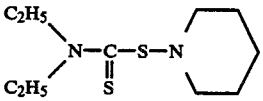
(II-53)
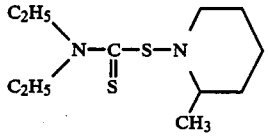
(II-54)
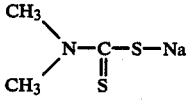
(II-55)
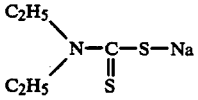
(II-56)
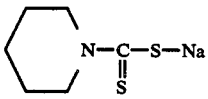
(II-57)
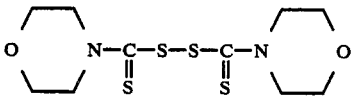
(II-58)
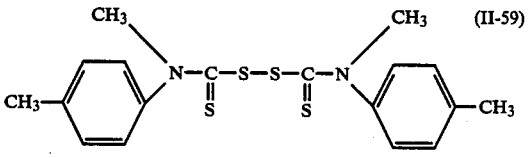
(II-59)
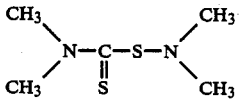
(II-60)

-continued
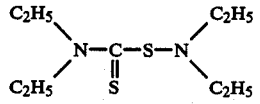
(II-61)
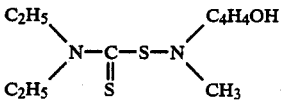
(II-62)
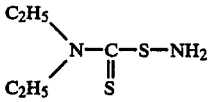
(II-63)
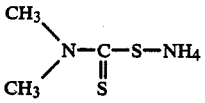
(II-64)
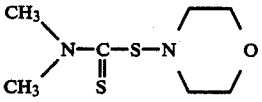
(II-65)
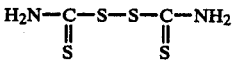
(II-66)
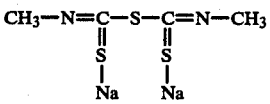
(II-67)
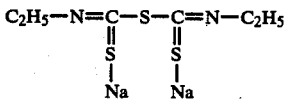
(II-68)
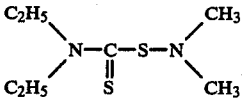
(II-69)
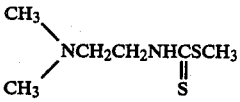
(II-70)
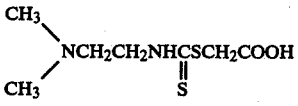
(II-71)
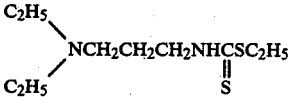
(II-72)
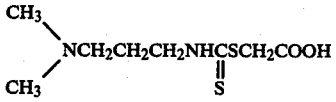
(II-73)
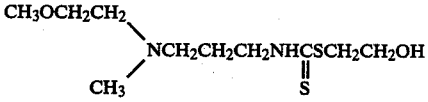
(II-74)
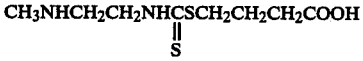
(II-75)
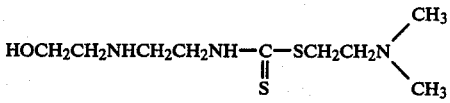
(II-76)
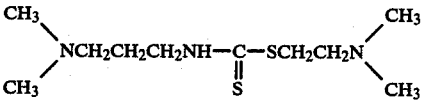
(II-77)
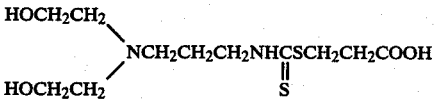
(II-78)
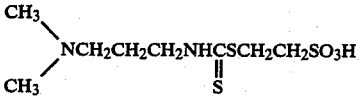
(II-79)
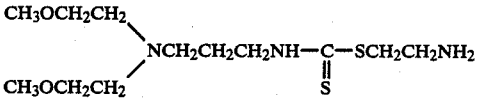
(II-80)
(II-81)
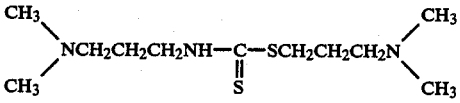
(II-82)
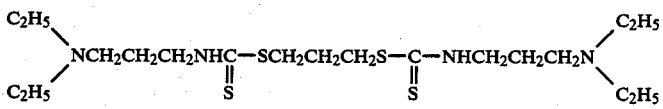
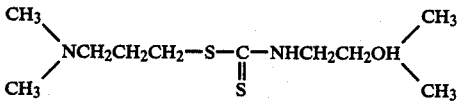
(II-83)
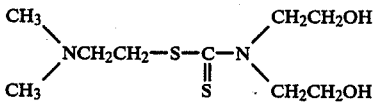
(II-84)
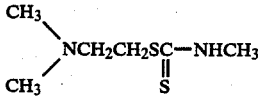
(II-85)
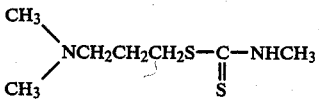
(II-86)
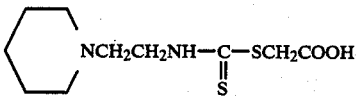
(II-87)
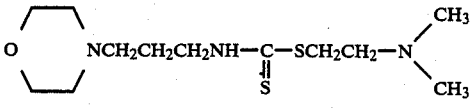
(II-88)

-continued
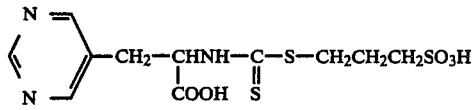
(II-89)
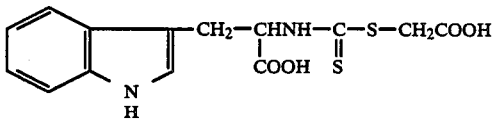
(II-90)
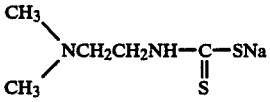
(II-91)
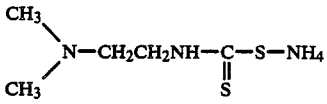
(II-92)
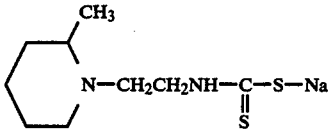
(II-93)
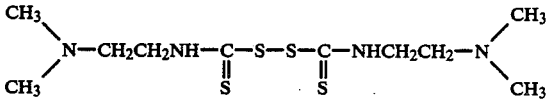
(II-94)
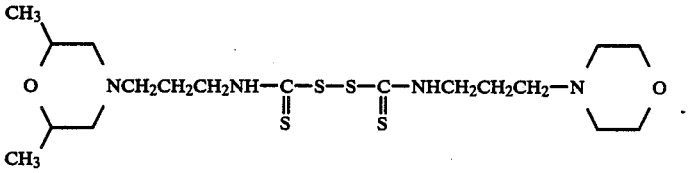
(II-95)
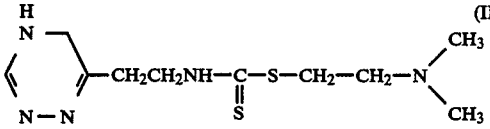
(II-96)
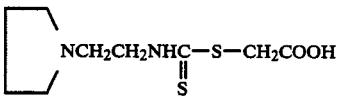
(II-97)
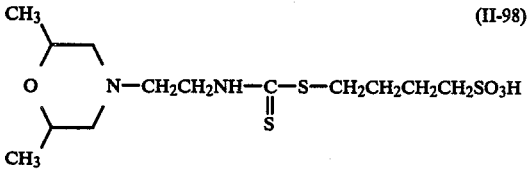
(II-98)
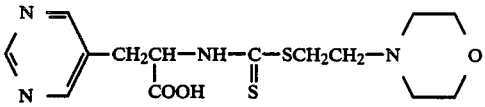
(II-99)
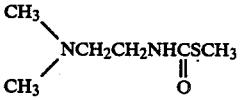
(II-100)
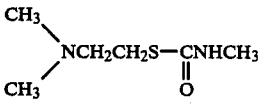
(II-101)
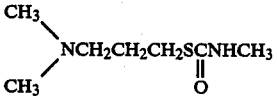
(II-102)
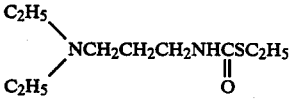
(II-103)
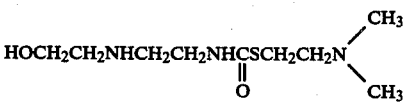
(II-104)
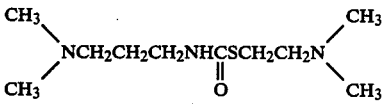
(II-105)
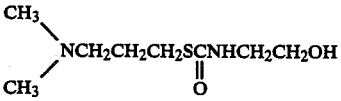
(II-106)
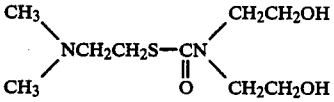
(II-107)
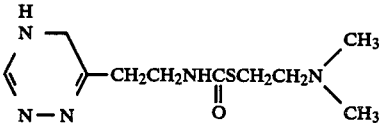
(II-108)
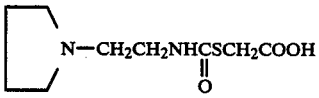
(II-109)
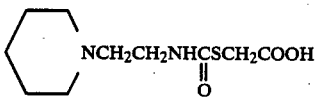
(II-110)
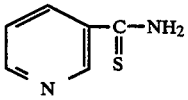
(II-111)

-continued
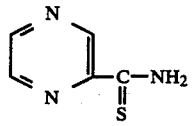
(II-112)
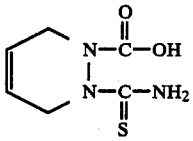
(II-113)
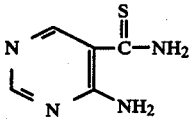
(II-114)
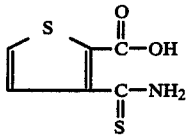
(II-115)
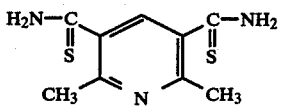
(II-116)
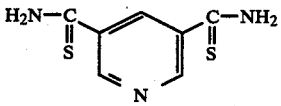
(II-117)
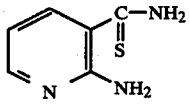
(II-118)
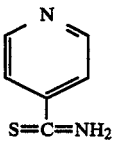
(II-119)
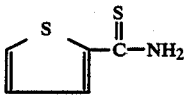
(II-120)
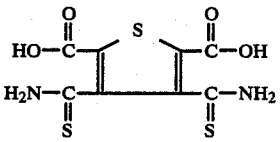
(II-121)
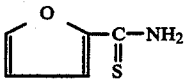
(II-122)
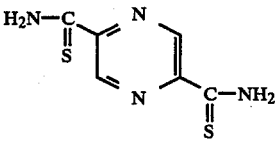
(II-123)
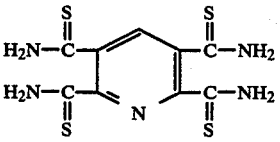
(II-124)
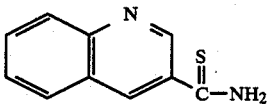
(II-125)
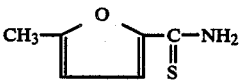
(II-126)
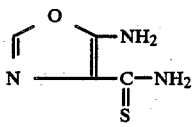
(II-127)
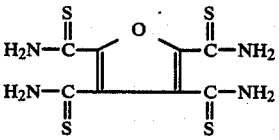
(II-128)
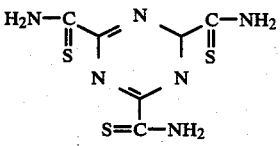
(II-129)
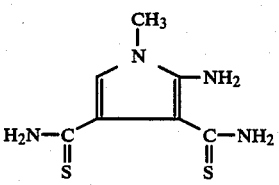
(II-130)
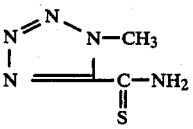
(II-131)

-continued
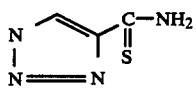
(II-132)
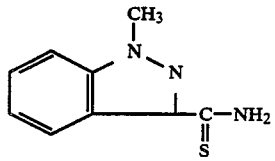
(II-133)
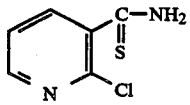
(II-134)
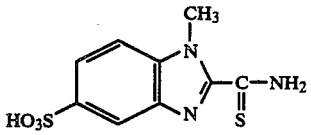
(II-135)
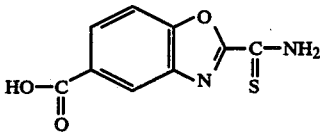
(II-136)
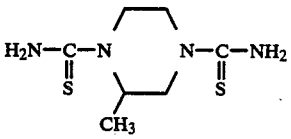
(II-137)
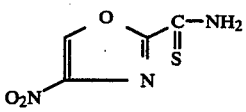
(II-138)
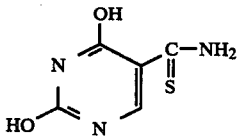
(II-139)
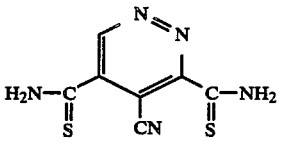
(II-140)
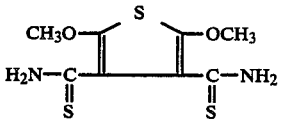
(II-141)
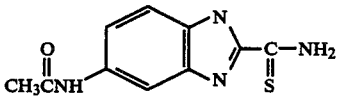
(II-142)
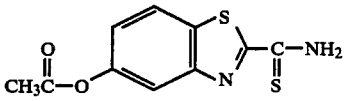
(II-143)
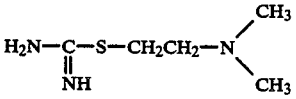
(II-144)
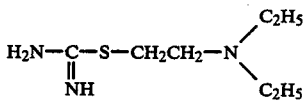
(II-145)
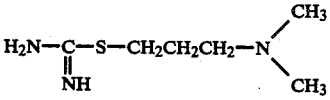
(II-146)
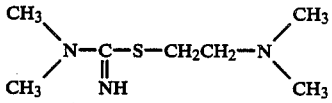
(II-147)
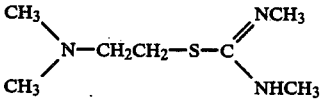
(II-148)
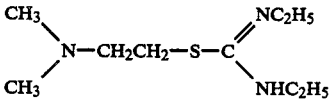
(II-149)
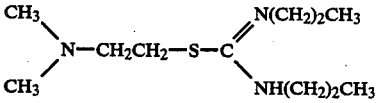
(II-150)
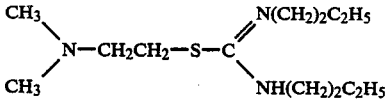
(II-151)
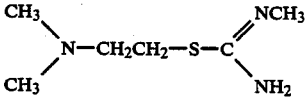
(II-152)
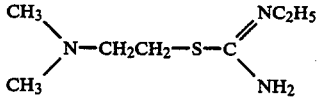
(II-153)
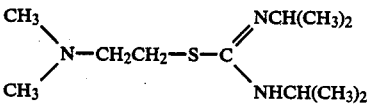
(II-154)
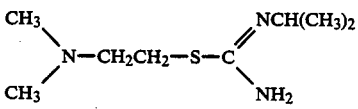
(II-155)

-continued
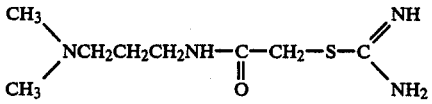
(II-156)
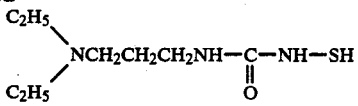
(II-157)
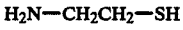
(III-1)
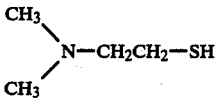
(III-2)
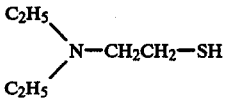
(III-3)
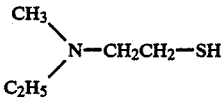
(III-4)
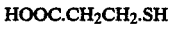
(III-5)
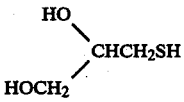
(III-6)
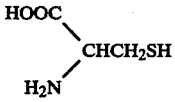
(III-7)
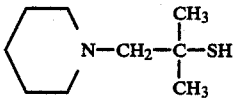
(III-8)
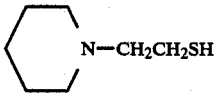
(III-9)
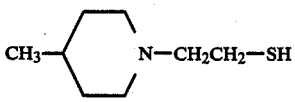
(III-10)
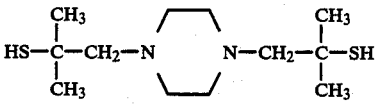
(III-11)
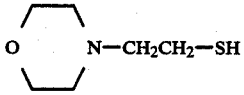
(III-12)
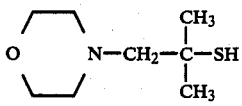
(III-13)
-continued
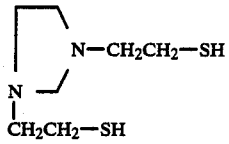
(III-14)
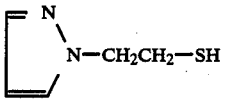
(III-15)
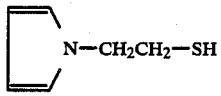
(III-16)
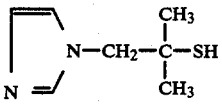
(III-17)
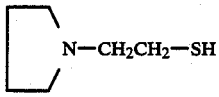
(III-18)
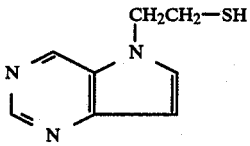
(III-19)
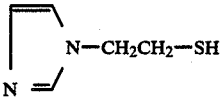
(III-20)
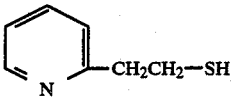
(III-21)
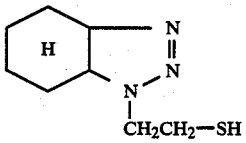
(III-22)
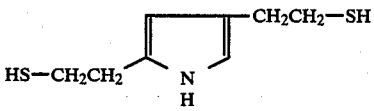
(III-23)
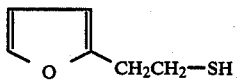
(III-24)

-continued
(III-25)
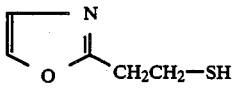
(III-26)
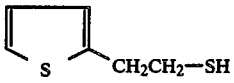
(III-27)
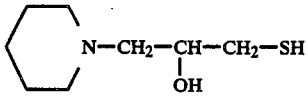
(III-28)
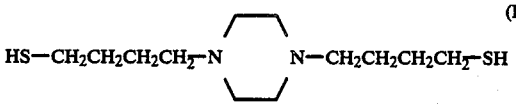
(III-29)
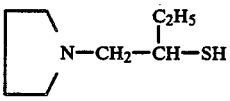
(III-30)
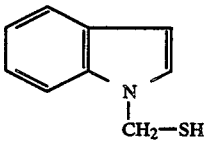
-continued
(III-31)
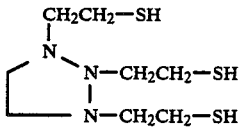
(III-32)
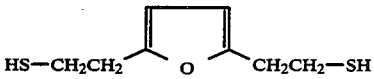
(III-33)
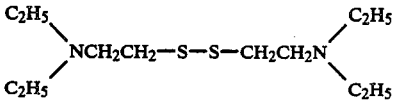
(III-34)
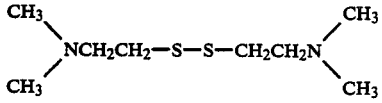
(III-35)
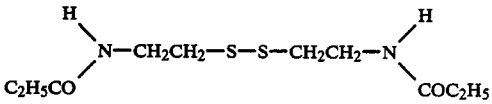
(III-36)
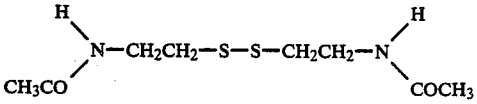
(III-37)
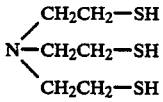
(IV-1)
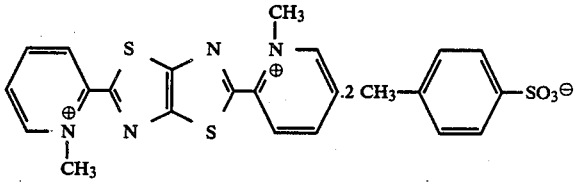
(IV-2)
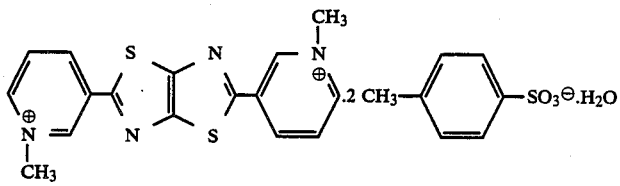
(IV-3)
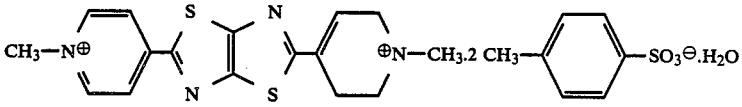
(IV-4)
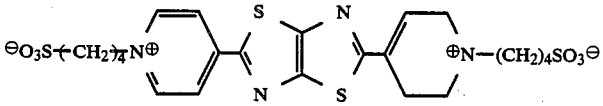

-continued
(IV-5)
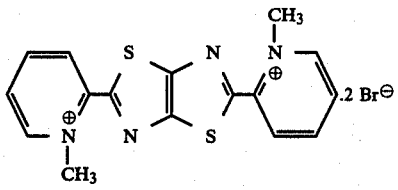
(V-1)
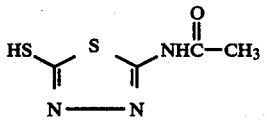
(V-2)
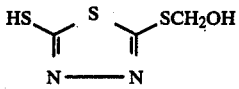
(V-3)
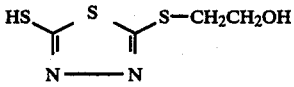
(V-4)
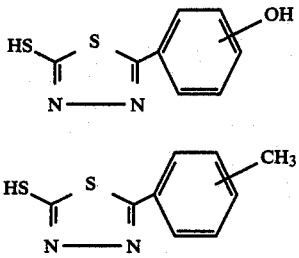
(V-5)
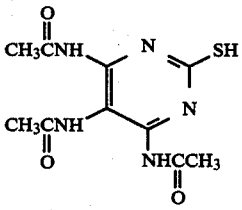
(V-6)
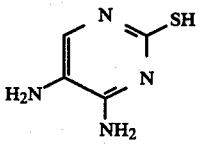
(V-7)
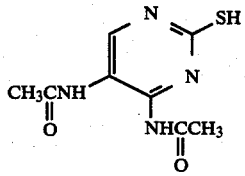
(V-8)
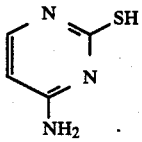
(V-9)
-continued
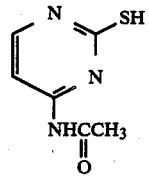
(V-10)
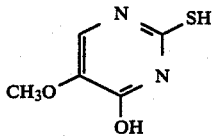
(V-11)
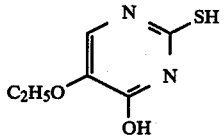
(V-12)
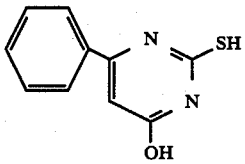
(V-13)
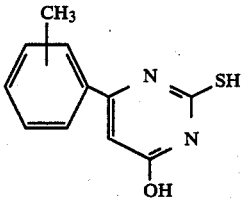
(V-14)
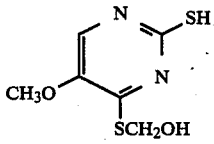
(V-15)
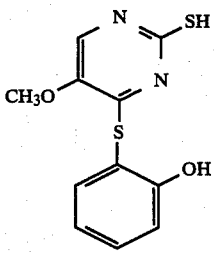
(V-16)

-continued
(V-17)
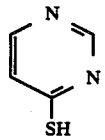
(V-18)
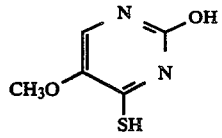
(V-19)
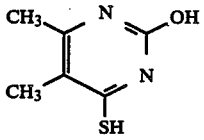
(V-20)
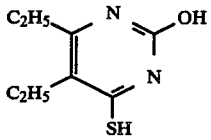
(V-21)
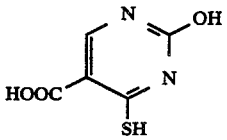
(V-22)
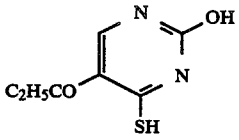
(V-23)
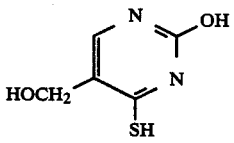
(V-24)
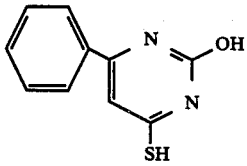
(V-25)
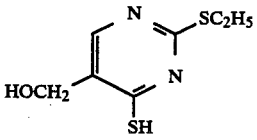
(V-26)
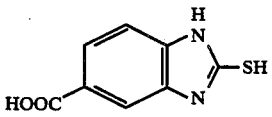
-continued
(V-27)
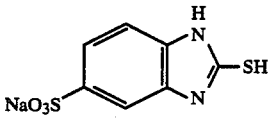
(V-28)
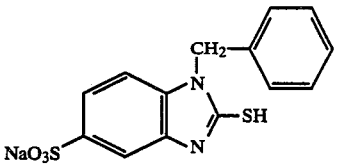
(V-29)
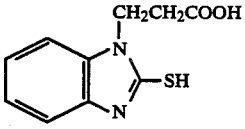
(V-30)
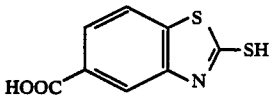
(V-31)
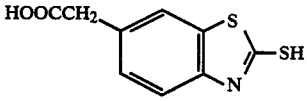
(V-32)
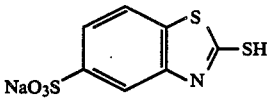
(V-33)
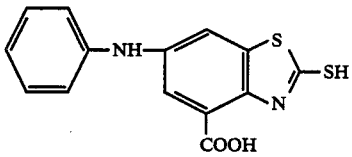
(V-34)
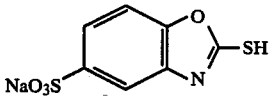
(V-35)
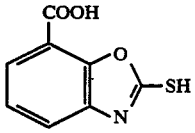
(V-36)
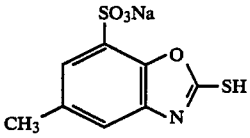
(V-37)
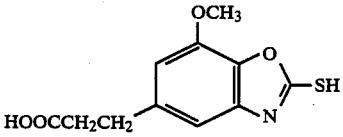

-continued
(V-38)
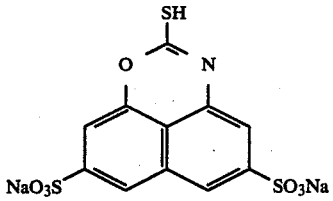
(V-39)
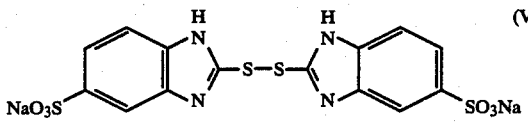
(V-40)
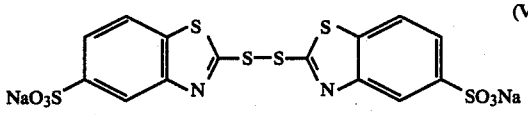
(V-41)
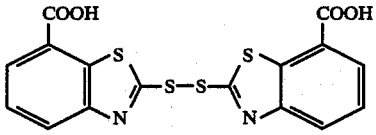
(V-42)
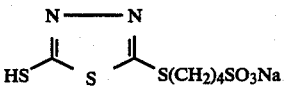
(V-43)
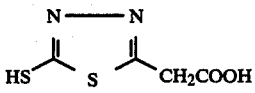
(V-44)
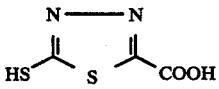
(V-45)
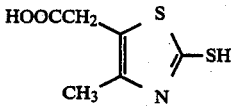
(V-46)
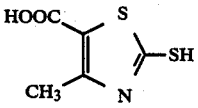
(V-47)
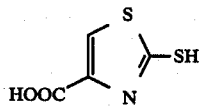
(V-48)
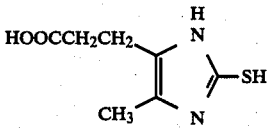
(V-49)
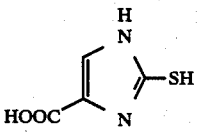
-continued
(V-50)
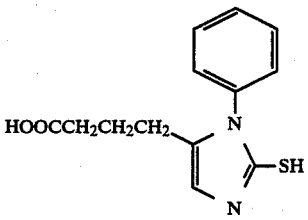
(V-51)
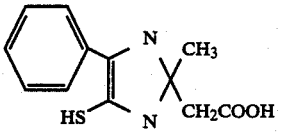
(V-52)
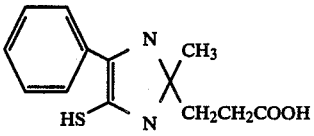
(V-53)
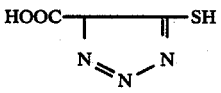
(V-54)
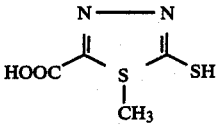
(V-55)
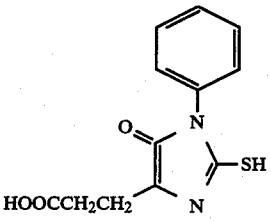
(V-56)
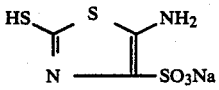
(V-57)
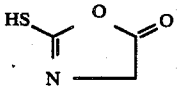
(V-58)
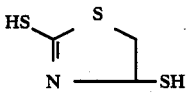
(V-59)
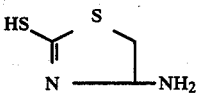
(V-60)
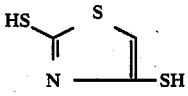
(V-61)
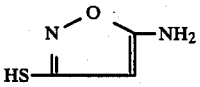

-continued
(V-62)
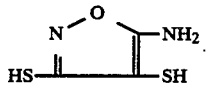
(V-63)
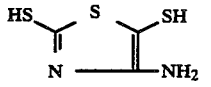
(V-64)
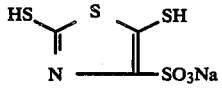
(V-65)
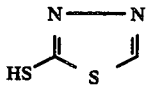
(V-66)
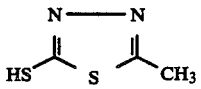
(V-67)
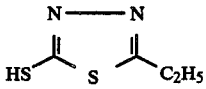
(V-68)
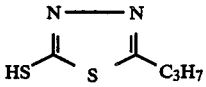
(V-69)
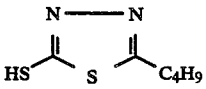
(V-70)
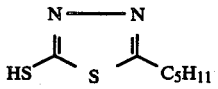
(V-71)
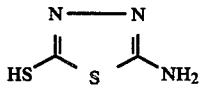
(V-72)
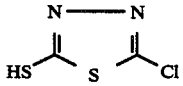
(V-73)
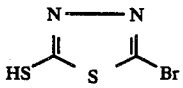
(V-74)
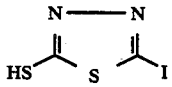
(V-75)
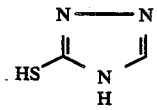
(V-76)
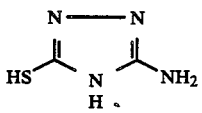
-continued
(V-77)
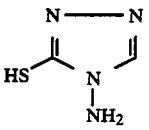
(V-78)
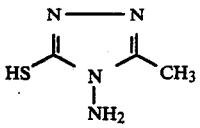
(V-79)
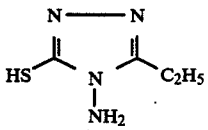
(V-80)
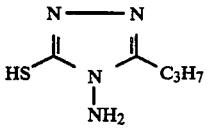
(V-81)
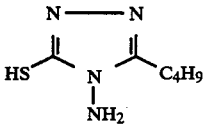
(V-82)
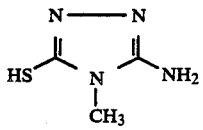
(V-83)
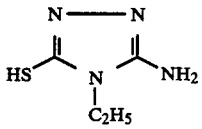
(V-84)
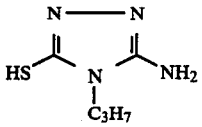
(V-85)
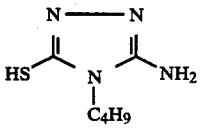
(V-86)
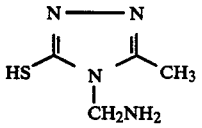
(V-87)
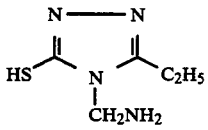

-continued
(V-88)
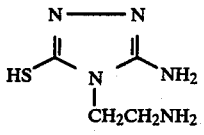
(V-89)
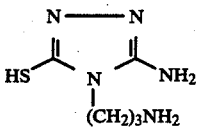
(V-90)
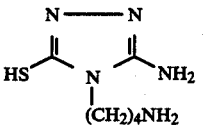
(V-91)
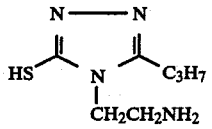
(V-92)
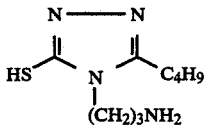
(V-93)
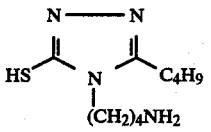
(V-94)
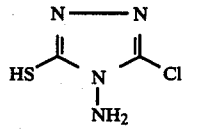
(V-95)
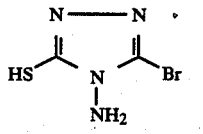
(V-96)
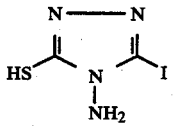
(V-97)
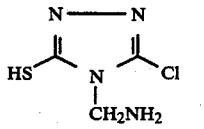
(V-98)
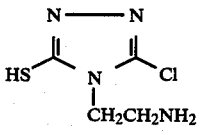
-continued
(V-99)
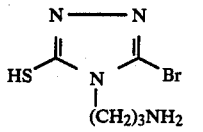
(V-100)
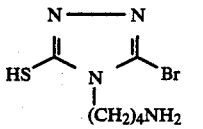
(V-101)
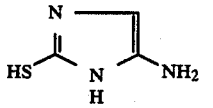
(V-102)
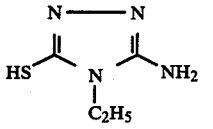
(V-103)
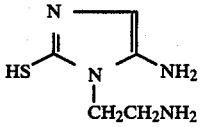
(V-104)
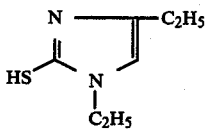
(V-105)
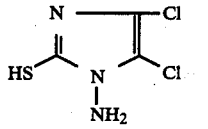
(V-106)
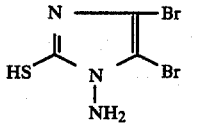
(V-107)
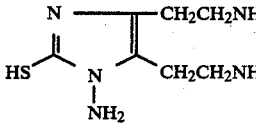
(V-108)
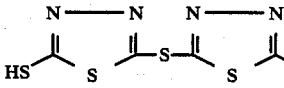
(V-109)
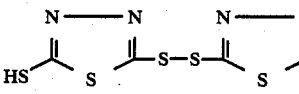
(V-110)
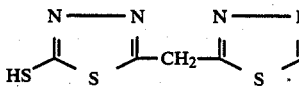

-continued
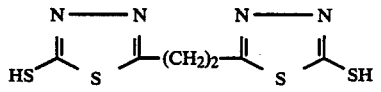
(V-111)
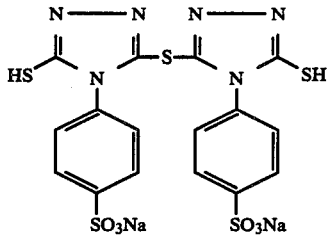
(V-112)
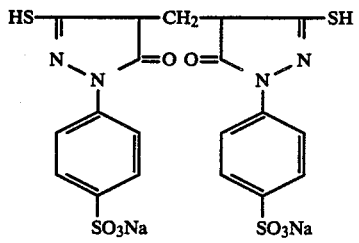
(V-113)
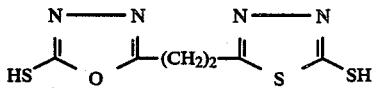
(V-114)
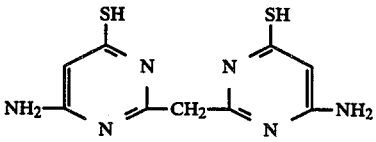
(V-115)
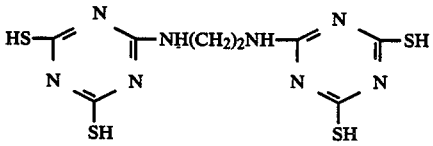
(V-116)
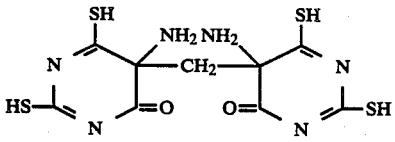
(V-117)
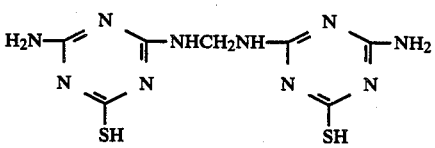
(V-118)
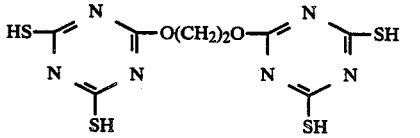
(V-119)
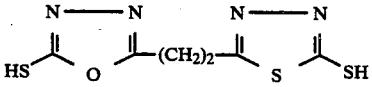
(V-120)
-continued
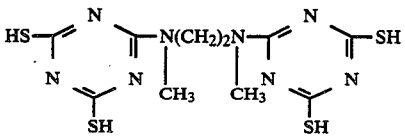
(V-121)
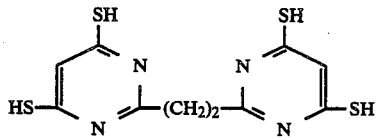
(V-122)
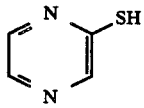
(V-123)
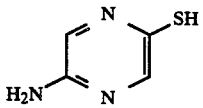
(V-124)
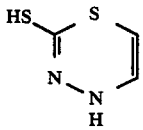
(V-125)
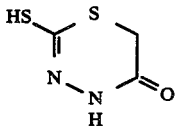
(V-126)
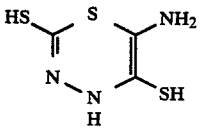
(V-127)
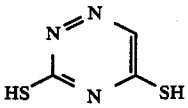
(V-128)
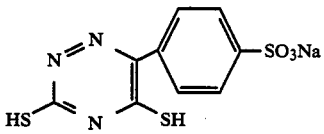
(V-129)
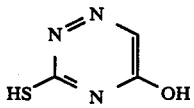
(V-130)
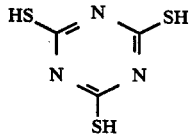
(V-131)

-continued
(V-132)
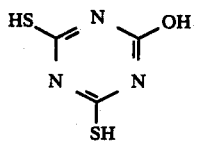
(V-133)
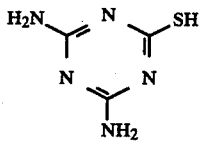
(V-134)
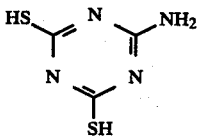
(V-135)
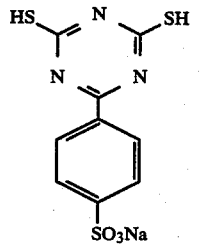
(V-136)
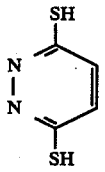
(V-137)
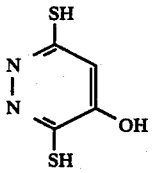
(V-138)
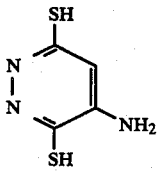
(V-139)
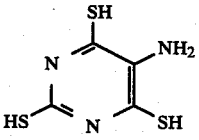
(V-140)
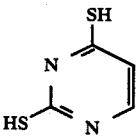
-continued
(V-141)
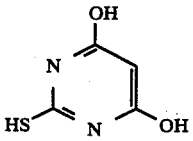
(V-142)
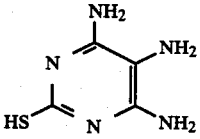
(V-143)
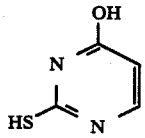
(V-144)
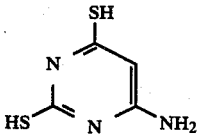
(V-145)
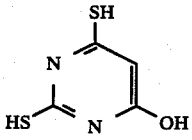
(V-146)
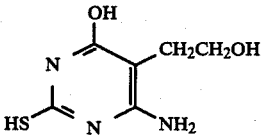
(V-147)
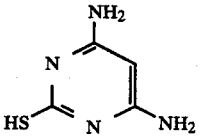
(V-148)
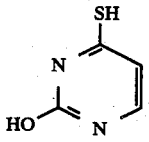
(V-149)
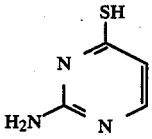
(V-150)
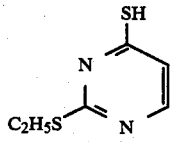
(V-151)
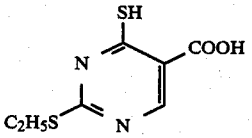

-continued
(V-152)
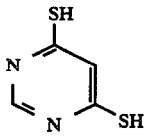
(V-153)
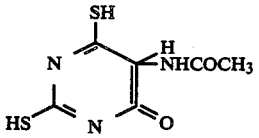
(V-154)
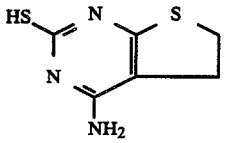
(V-155)
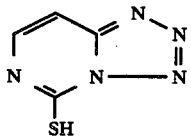
(V-156)
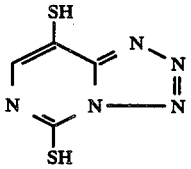
(V-157)
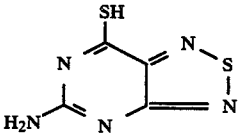
(V-158)
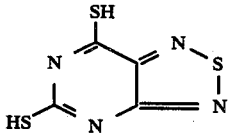
(V-159)
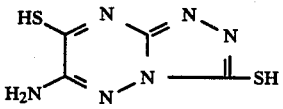
(V-160)
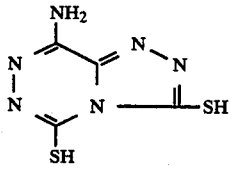
(V-161)
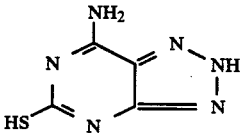
-continued
(V-162)
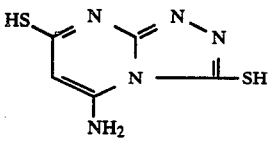
(V-163)
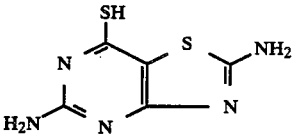
(V-164)
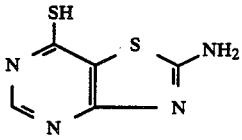
(V-165)
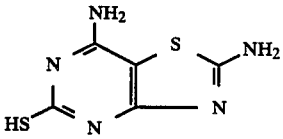
(V-166)
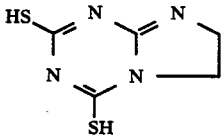
(V-167)
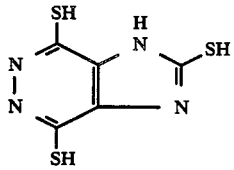
(V-168)
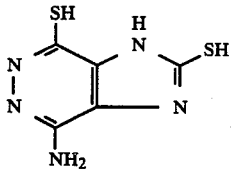
(V-169)
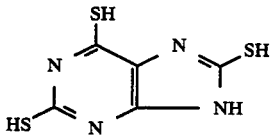
(V-170)
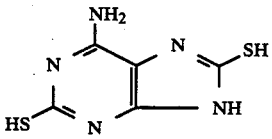
(V-171)
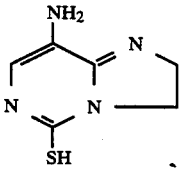

-continued
(V-172)
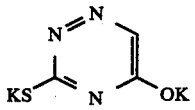
(V-173)
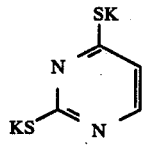
(V-174)
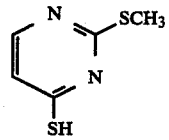
(V-175)
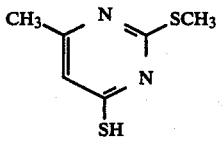
(V-176)
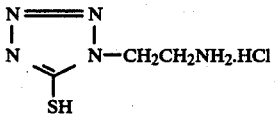
(V-177)
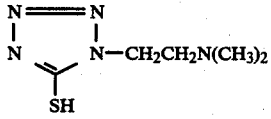
(V-178)
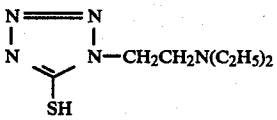
(V-179)
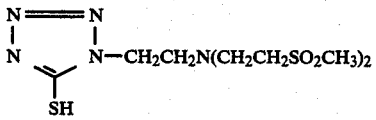
(V-180)
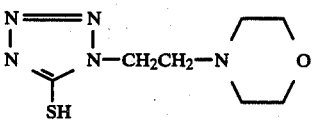
(V-181)
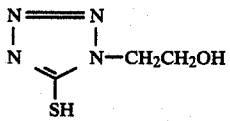
(V-182)
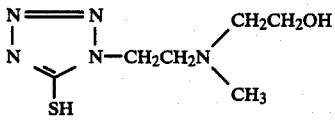
(V-183)
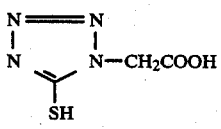
-continued
(V-184)
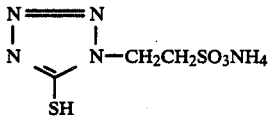
(VI-1)
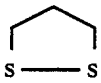
(VI-2)
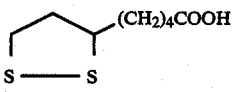
(VI-3)
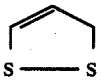
(VI-4)
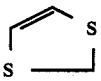
(VI-5)
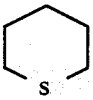
(VI-6)
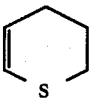
(VI-7)
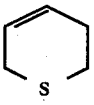
(VI-8)
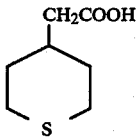
(VI-9)
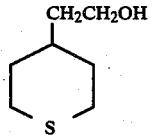
(VI-10)
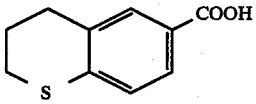
(VI-11)
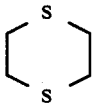
(VI-12)
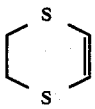

(VI-13)
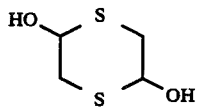
(VI-14)
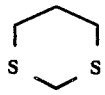
(VI-15)
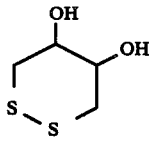
(VI-16)
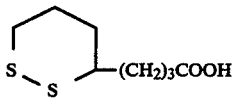
(VI-17)
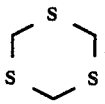
(VI-18)
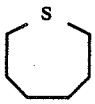
(VI-19)
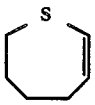
(VI-20)
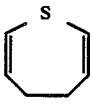
(VI-21)
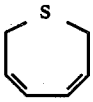
(VI-22)
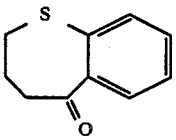
(VI-23)
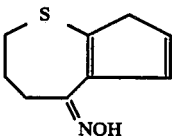
(VI-24)
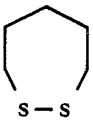
(VI-25)
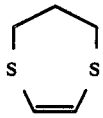
(VI-26)
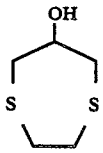
(VI-27)
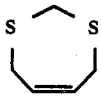
(VI-28)
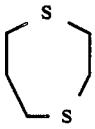
(VI-29)
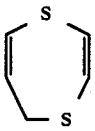
(VI-30)
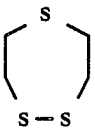
(VI-31)
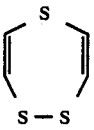
(VI-32)
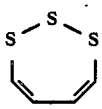
(VI-33)
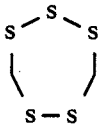
(VI-34)
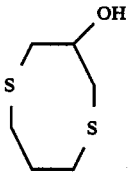
(VI-35)
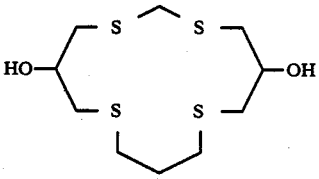

-continued (VI-36)

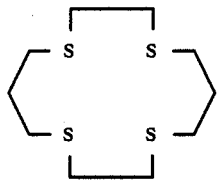

(VII-1)

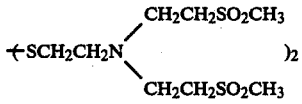

(VII-2)

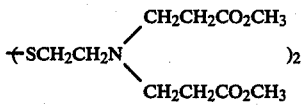

(VII-3)

(VII-4)

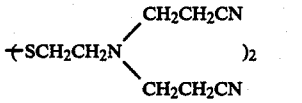

(VII-5)

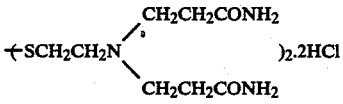

(VII-6)

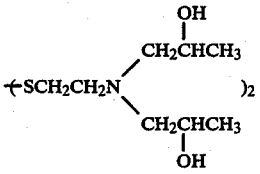

(VII-7)

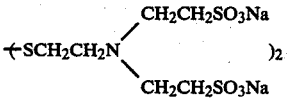

(VII-8)

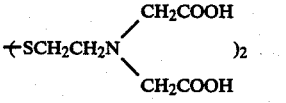

(VII-9)

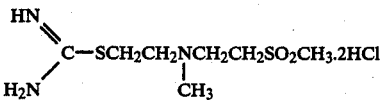

(VII-10)

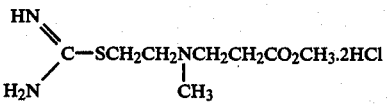

(VII-11)

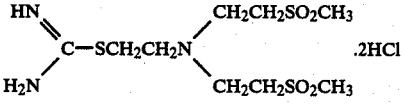

(VII-12)

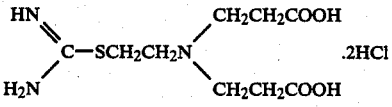

-continued (VII-13)

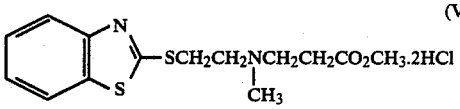

(VII-14)

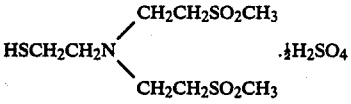

(VII-15)

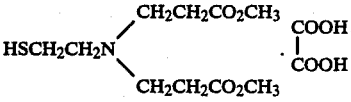

(VII-16)

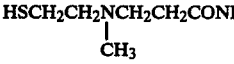

(VII-17)

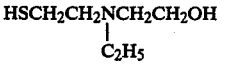

(VII-18)

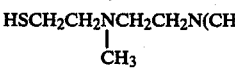

(VII-19)

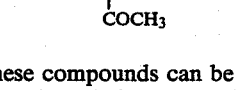

(VII-20)

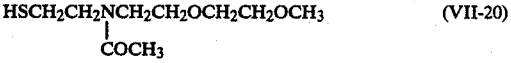

These compounds can be easily synthesized by conventional technique described in British Pat. No. 1,138,842, Japanese Patent O.P.I. Publication Nos. 20832/1977, 28426/1978, 95630/1978, 104232/1978, 141632/1978, 17123/1980, 95540/1985, U.S. Pat. Nos. 3,232,936, 3,772,020, 3,779,757 and 3,893,858.

Since the bleaching accelerating agent of this invention is merely to let exist when the silver image obtained by developing is to be bleached, it is preferable to add into the bleach-fixing bath. It is also preferable to add in a preceding bath (pretreat solution, especially prefixing bath); in this case, the accelerating agent is brought into the bleach-fixing bath accompanied with the silver halide color photographic light-sensitive material. The most preferable method is that the accelerating agent is added both in the pretreating solution (especially in the prefixing solution) and in the bleach-fixing solution. In the last case, the agent is added in the pretreating solution and it is brought into the bleach-fixing solution accompanied with the photographic material to be treated. Or otherwise, it is also preferable to make it exist in the pretreat solution and in the bleach-fixing solution by adding it into the silver halide color-photographic material at the manufacturing stage.

The bleach-accelerating agent can either be used singly or in multiple (two or more kinds). Its preferable adding amount into the bleach-fixing solution or into a preceeding bath (pretreating or pre-fixing solution) is in a range about 0.01–100 g per liter of the solution. When the amount is too small the bleach-acceleration effect is inferior. When it is excessive the color photographic light-sensitive material is contaminated due to the appearance of precipitation. Preferably it should be 0.05–50 g per liter of the solution or more preferably it should be 0.15–15 g per liter.

When the bleach-accelerating agent is added to the bleach-fixing bath and/or in a preceding bath (pretreating bath or pre-fixing bath) it can be added directly as it is. But it is usually added after dissolving in an organic acid, etc. Other organic solvents such as methanol, ethanol, and aceton are also applicable without causing any trouble to its bleach-fixing effect.

In this invention, supply of a metallic ion by some method into the bleach-fixing solution is preferable to enhance the bleach-fixing efficiency. For example, halides, hydroxides, sulfates, phosphates and acetates of metals can be used but it is preferable to be added in the form of complex salts of chelate compounds as shown in the following. (Hereafter, these metal compounds used for the supply of metallic ion are called the metal compounds of this invention.) The method for the supply of metallic ions is, however, not limited to these examples.

Any type of chelating agents can be used such as organic polyphosphoric acids and aminopolycarboxylic acids.

| [Exemplified compounds] | |
|---|---|
| (A-1) | Nickel chloride |
| (A-2) | Nickel nitrate |
| (A-3) | Nickel sulfate |
| (A-4) | Nickel acetate |
| (A-5) | Nickel bromide |
| (A-6) | NIckel iodide |
| (A-7) | Nickel phosphate |
| (A-8) | Bismuth chloride |
| (A-9) | Bismuth nitrate |
| (A-10) | Bismuth sulfate |
| (A-11) | Bismuth acetate |
| (A-12) | Zinc chloride |
| (A-13) | Zinc bromide |
| (A-14) | Zinc sulfate |
| (A-15) | Zinc nitrate |
| (A-16) | Cobalt chloride |
| (A-17) | Cobalt nitrate |
| (A-18) | Cobalt sulfate |
| (A-19) | Cobalt acetate |
| (A-20) | Cerium sulfate |
| (A-21) | Magnesium chleride |
| (A-22) | Magnesium sulfate |
| (A-23) | Magnesium acetate |
| (A-24) | Calcium chloride |
| (A-25) | Calcium nitrate |
| (A-26) | Barium chloride |
| (A-27) | Barium acetate |
| (A-28) | Barium nitrate |
| (A-29) | Strontium chloride |
| (A-30) | Strontium acetate |
| (A-31) | Strontium nitrate |
| (A-32) | Manganese chloride |
| (A-33) | Manganese sulfate |
| (A-34) | Manganese acetate |
| (A-35) | Lead acetate |
| (A-36) | Lead nitrate |
| (A-37) | Titanium chloride |
| (A-38) | Tin (II) chloride |
| (A-39) | Zinconium sulfate |
| (A-40) | Zirionium nitrate |
| (A-41) | Ammonium vanadate |
| (A-42) | Ammonium metavanadate |
| (A-43) | Sodium tungstate |
| (A-44) | Ammonium tungstate |
| (A-45) | Aluminum chloride |
| (A-46) | Aluminum sulfate |
| (A-47) | Aluminum nitrate |
| (A-48) | Yttrium sulfate |
| (A-49) | Yttrium nitrate |
| (A-50) | Yttrium chloride |
| (A-51) | Samarium chloride |
| (A-52) | Samarium bromide |
| (A-53) | Samarium sulfate |
| (A-54) | Samarium acetate |
| (A-55) | Ruthenium sulfate |
| (A-56) | Ruthenium chloride |

These metal compounds of this invention can either be used singly or in mulfiple (by mixing two or more kinds). The applicable amount is 0.0001–2 mols per liter of solution and the preferable range of amount is 0.001–1 mol.

Iron (III) complex salts of organic acids (hereinafter referred to as iron (III) complex of organic acids of this invention) are contained in the bleach-fixing solution of this invention.

Typical examples of organic acids contained in iron (III) complexes of organic acids of this invention are as follows:

(1) Diethylenetetraminepentaacetic acid (MW=393.27)
(2) Diethylenetriaminepentamethylenephosphonic acid (MW=573.12)
(3) Cyclohexanediaminoteteraacetic acid (MW=364.35)
(4) Cyclohexanediaminoteteramethylenephosphonic acid (MW=58.23)
(5) Triethylenetetraminhexaacetic acid (MW=364.35)
(6) Triethylenetetraminehexamethylenephosphonic acid (MW=710.72)
(7) Gycoletherdiaminetetraacetic acid (MW=380.35)
(8) Gycoletherdiaminetetramethylenephosphonic acid (MW=524.23)
(9) 1, 2-Diaminopropanetetraacetic acid (MW=306.27)
(10) 1, 2-Diaminopropanetetramethylenephosphonic acid (MW=450.15)
(11) 1, 3-Diaminopropane-2-ol-tetraacetic acid (MW=322.27)
(12) 1, 3-Diaminopropane-2-ol-tetramethylene phosphonic acid (MW=466.15)
(13) Ethylenediaminediorthohydroxyphenylacetic acid (MW=360.37)
(14) Ethylenediaminediorthohydroxyphenylmethylenesulfonic acid (MW=432.31)
(15) Ethylenediaminetetramethylenephosphonic acid (MW=436.13)
(16) Ethylenediaminetetraacetic acid (MW=292.25)
(17) Trinitrotriacetic acid (MW=191.14)
(18) Nitrotrimethyleneposphonic acid (MW=299.05)
(19) Iminodiacetic acid (MW=133.10
(20) Iminodimethylene posphonic acid (MW=205.04)
(21) Methyliminodiacetic acid (MW=147.13)
(22) Methyliminodimethylenephosphonic acid (MW=219.07)
(23) Hydroxyethyliminodiacetic acid (MW=177.16)
(24) Hydroxyethyliminodimethylenephosphonic acid (MW=249.10)
(25) Ethylenedianinetetrapropionic acid (MW=348.35)
(26) Hydroxyethylglycidine (MW=163.17)
(27) Nitrylotripropionic acid (MW=233.22)
(28) Ethylenediaminediacetic acid (MW=176.17)
(29) Ethylenediaminedipropionic acid (MW=277.15)

Iron (III) complex salts of organic acids of this invention are not limited to these examples and either one kind of them can optionally be used or two or more kinds of them can be used in combination.

Especially preferable organic acids to compose iron (III) complex salts are as follows:

(1) Diethylenetriaminepentaacetic acid (MW=393.27)
(3) Cyclohexanediaminotetraacetic acid (MW=364.35)
(5) Triethylenetetraminehexaacetic acid (MW=494.45)
(7) Glycoletherdiaminotetraacetic acid (MW=380.35)
(9) 1,2-Diaminopropanetetraacetic acid (MW=306.27)
(11) 1,3-Diaminopropane-2-ol-tetraacetic acid (MW=322.27)
(13) Ethylenediaminediorthohydioxyphenylacetic acid (MW=360.37)

(16) Ethylendiaminetetraacetic acid (MW=292.25)
(19) Iminodiacetic acid (MW=133.10)
(21) Methyliminodiacetic acid (MW=147.13)
(23) Hydroxyethyliminodiacetic acid (MW=177.16)
(25) Ethylenediaminetetrapropionic acid (MW=348.35)
(26) Hydroxyethylglycidine (MW=163.17)
(27) Nitrotripropionic acid (MW=233.22)
(28) Ethylenediaminediacetic acid (MW=176.17)
(29) Ethylenediaminedipropionic acid (MW=277.15)

Iron (III) complex salts of organic acids of this invention are used as the states such as free acids (hydroacid salts), alkali salts such as sodium, potassium, lithium salts, ammonium salts and water-soluble amine salts (e.g. triethanolamine). Preferable ones are potassium, sodium and ammonium salts. They are applicable singly or in multiple (two or more kinds in combination). The applicable amount is also optional but is necessary to decide by referring to the amount of silver and the composition of silver halide in the used light-sensitive material.

The amount should preferably be more than 0.01 mol per liter of used solution and more preferably be 0.05–1.0 mol. The replenishment solution should preferably be made in very concentrated state up to the limit of solubility so as to replenishment with a small amount as far as possible.

Applicable pH is preferable at pH 2.0–10.0, more preferably at pH 3.0–9.5 and the most preferably at 4.0–9.0.

Applicable temperature is preferably not more than 80° C., more preferably not more than 55° C. and most preferably not more than 45° C. and the generation of vapor should be avoided.

Time of bleach-fixing treatment should preferably be within 8 minutes and more preferably within 6 minutes.

Bleach-fixing solution of this invention can contain various kinds of additives mixed with iron (III) complexes of organic acids. As additives to help the bleaching and fixing properties, alkali halides and ammonium halides are preferable such as: potassium bromide, sodium bromide, sodium chloride, ammonium bromide, ammonium iodide, sodium iodide, potassium, iodide, etc. Substances which has been known as additives for ordinary bleaching solutions are able to add such as dissolving agents (e.g. triethanol amine), acetylacetone, phosphonocarbonic acid, polyphosphoric acid, organic sulfonic acid, oxycarbonic acid, polycarbonic acid, alkylamine, polyethyleneoxide, etc.

Various kinds of bleach-fixing solutions can be used as the bleach-fixing solution of this invention such as the solution in which a small amount of a halide such as potassium bromide is added or the solution in which a large amount of a halide such as potassium bromide, ammonium bromide and/or ammonium iodide, potassium iodide is added. A special bleach-fixing solution can also be used containing a bleaching agent of this invention and a large amount of a halide such as potassium iodide.

Various kinds of compounds which can form water-soluble complex salts by reaction with silver halide are applicable as the silver-halide fixing agent added to the bleach-fixing solution of this invention. Typical examples are as follows: thiosulfates such as potassium thiosulfate, sodium thiosulfate, ammonium thiosulfate, thiocyanates such as potassium thiocyanate, sodium thiocyanate, ammonium thiocyanate, and thiourea, thioether, highly concentrated bromides and iodides.

Their applicable amount is not smaller than 5 g/l, preferably is not smaller than 50 g/l, more preferably is 70 g/l up to the limit of solubility.

Various kinds of pH buffering agents can be contained in the bleach-fixing solution of this invention singly or in multiple (two or more kind combination) such as: boric acid, borax, sodium hydroxide, potassium hydroxide, sodium carbonate, potassium carbonate, sodium bicarbonate, potassium bicarbonate, acetic acid, sodium acetate, and ammonium hydroxide.

Moreover, various kinds of fluorescent whitening agents, antifoaming agents and antifungal agents can also be contained. Preservatives such as hydroxylamine, hydrasine, sulfites, metabisulfites, bisulfite additives of aldehydes and ketones and other additives and organic solvents can properly be contained. And moreover, it is preferable to add polymers or copolymers having vinyl pyrolidine nucleus as described in Japanese Patent Application No. 51803/1975.

Other compounds which can be added to the bleach-fixing solutions of this invention and can accelerate their bleach-fixing property are as follows: tetramethyl urea, phosphoric acid trisdimethylamide, ε-caprolactum, N-methylpyrolidone, N-methyl merpholine, tetraethyleneglycol monophenylether, acetonitrile, and glycol monomethylether.

Preferable treating method of this invention is to carry out bleach-fixing of this invention immediately after color developing. Bleach-fixing treatment of this invention can, however, be carried out after washing with water, rinsing or stopping succeeding to the color developing. Most preferably, the bleach-fixing treatment of this invention should be carried out succeeding to the pre-fixing treatment after the color developing as aforementioned. In this case, the bleaching-asccelerating agent of this invention can be added in the pre-fixing treatment.

After the bleach-fixing treatment of this invention the stabilization treatment can either be directly succeeded without washing or be carried out after washing with water. Except these treatment procedures, various kinds of supplemental procedures can be added if necessary such as hardening, neutralization, developing for monochrome picture, reversal developing and washing with small amount water. Examples of preferable treating procedures are as follows:

(1) Color-developing—bleach-fixing—washing with water
(2) Color-developing—bleach-fixing—washing with small amount water—washing with water
(3) Color-developing—bleach-fixing—washing with water—stabilization
(4) Color-developing—bleach-fixing—stabilization
(5) Color-developing—bleach-fixing—primary stabilization—secondary stabilization
(6) Color-developing—washing (or stabilization)—bleach-fixing—washing (or stabilization)
(7) Color-developing—pre-fixing—bleach-fixing—washing with water
(8) Color-developing—pre-fixing—bleach-fixing—stabilization
(9) Color-developing—pre-fixing—bleach-fixing—primary stabilization—secondary stabilization
(10) Color-developing—stopping—bleach-fixing—washing with water—stabilization Among these treatment procedures, preferably ones are (3), (4), (5), (8) and (9) procedures and more preferable ones are (4), (5), (8) and (9) procedures since the effect of this invention is remarkably exhibited.

Addition of various inorganic metal salts is preferable to the bleach-fixing solution of this invention. It is also preferable to use these salts after forming metal complex salts by addition of various chelating agents.

Chelating agents not-included in this invention and-/or their iron (III) complex salts can be added to the bleach-fixing solution of this invention. Addition amount of the iron (III) complex salts not included in this invention should preferably be not more than 0.45 mol% to iron (III) complex salts of organic acids of this invention.

It is preferable to add the bleach-accelerating agent of this invention into the pre-fixing solution as aforementioned. In this case, the most preferable method is to add the bleach-accelerating agent also into the bleach-fixing solution. It is, however, allowable to add the bleach-accelerating agent only to either the pre-fixing or bleach-fixing solution. When the bleach-accelerating agent is added to the pre-fixing agent only this bleach-accelerating agent is conveyed from the pre-fixing agent to the bleach-fixing agent attached with the silver halide color photographic light-sensitive material and exhibits its effect.

Practice of oxidation treatment is preferable in the bleach-fixing solution so as to bring the reduced body of the iron complex formed in the solution to the oxidized body. This oxidation treatment is practiced by an air-oxidation. The air-oxidation treatment procedure is a kind of enforced oxidation procedure to perform oxidation by introducing the air bubble forcibly into the bleaching solution tank of automatic developing machine or the treated solution in the bleach-fixing solution tank and being made to contact with the solution. Oxidation proceeds also on the surface of solution by contacting with air. This procedure is usually called aeration in which the air introduced from an air-compressor is passing through an air-distributor which equipped with many minute nozzles. For the purpose to perform oxidation efficiently the diameter of the generating air-bubble is made small and the contact area of air and solution is made large as far as possible. It is preferable to increase the oxidation efficiency by carrying out the oxidation by contact of the solution and the air introduced from the bottom of the tank.

The aeration is mainly carried out in the treating tank but it is also possible to be done in another tank by batch system or in a side-tank attached to the main tank. Especially when the recovery of bleaching solution or bleach-fixing solution is demanded it can preferably be performed outside of the main tank. Since in this invention it is not necessary to be careful about over-aeration, aeration can be carried out without care such as to perform all through the treating hours continuously or intermittently but strongly. The diameter of air bubble should, however, be kept small as far as possible so as to increase the efficiency and to prevent the scattering of liquid to other solutions by splash. Another preferable way of this invention is to perform aeration during the time the automatic developing machine stops and to stop and aeration during the machine works. Aeration can also be carried out by introducing the solution outside of the treating tank. Other aeration technique such as the showering method, spraying method and jet-spraying method described in Japanese Patent O.P.I. Publication Nos. 55336/1974, 9831/1976 and 95234/1979 can be used together and the method described in West German Patent (OLS) No. 2,113,651 can also be used.

The total amount of coated silver contained in the silver halide color photographic light-sensitive materials described in this invention is not larger than 80 mg/dm$^2$ which is the added amount contained in the layer of colloidal silver filter and in the layer of antihalation colloidal silver. Efficiency of this invention can be exhibited with this value. This value should preferably be not larger than 60 mg/dm$^2$ and more preferably be not larger than 50 mg/dm$^2$. From the standpoint of photographic performance it should preferably be not smaller than 20 mg/dm$^2$ which can exhibit the efficiency if this invention.

In this invention, the thickness of photograph-composing layer of silver halide color photographic light-sensitive materials (that is, thickness of gelatine layer) is defined as the thickness of photograph-composing layer except support; that is to say, the total of the thickness of layers such as under-coating layer, antihalation layer, intermediate layer, at least three kinds of emulsion layers, filter layer and protecting layer all of which are hydrophilic colloidal layers; or, in other words, layers composing dried photography. The measurement of thickness is carried out by using a micrometer and the value is not larger than 25 μm in this invention. It should preferably be not larger than 22 μm, more preferably not larger than 20 μm and most preferably not larger than 18 μm. From the stanpoint of photographic performance it should preferably be not smaller than 8 μm which can exhibit the efficiency of this invention.

The silver halide in the silver halide emulsion layer of this invention contains at least 0.5 mol% of silver iodide. For the purpose to exhibit the sensitivity of the silver halide color photographic light-sensitive materials, photographic characteristics and the bleach-fixing performance of this invention in the maximum extent, the amount of silver iodide should preferably be 0.5 mol%–25 mol% at the standpoints both the photographic characteristics and the bleach-fixing performance. In this invention when this value exceeds 25 mol% the photographic characteristics turns better but the bleach-fixing performance remarkably degrades. More preferably, the amount of silver iodide should be 2 mol%–20 mol%.

The dispersion layer of black collodial silver for antihalation used in this invention has a sufficiently high optical density in the visible ray zone (especially in the red light zone) to the incident light beams both from the surface of the supporting body of the silver halide color photographic light-sensitive materials and from the sulface of the emulsion. On the other hand, it has a sufficiently low reflectivity to the incident light from the surface of the emulsion of the silver halide color photographic light-sensitive materials.

The above-mentioned black colloidal silver dispersion layer should preferably contain sufficiently fine grain colloidal silver at the standpoint of reflectivity and bleach-fixing property. However, since sufficiently fine-grain colloidal silver has its absorption in the yellow or yellowish-brown area and to optical density to red light is weak, the size of the grain of colloidal silver is difficult to make very fine but make coarse in some extent. The coarse grain happens to cause a physical phenomenon by making the silver grains as nucleus. According to this, the bleach-fixing property in the boundary of silver halide emulsion layer seems to be worsened. In such cases as when the silver halide emulsion layer contains more than 0.5 mol% of silver iodide grains, or especially when the silver halide emulsion layer located very close to the supporting body contains more than 0.5 mol% of silver iodide grains, the bleach-fixing property is remarkably degraded. Since this phenomenon is especially remarkable in the case of the multiplayer silver halide color-photographic light sensitive materials having more than 3 layers of silver iodide-containing emulsion, the efficiency of this invention seems to be exhibited remarkably.

This invention exhibits the most remarkably efficiency when the light-sensitive materials containing core-shell emulsion are used. A part of applicable core-shell emulsions is described in Japanese Patent O.P.I. Publication No. 154232/1982 in detail. Preferable silver halide color-photographic light sensitive materials are those containing the silver halide whose composition of silver iodide in the core is 0.1–20 mol%, or more preferably, 0.5–10 mol%, and also containing silver bromide, silver chloride, silver iodo-bromide or silver chlorobromide or a mixture of them in the shell.

More preferably, silver halide emulsion in the shell should be composed of silver iodo-bromide or silver bromide. In this invention, it is more preferable to make the composition of the core as actually mono-dispersed silver halide grains and to make the thickness of the shell 0.01–0.8 μm.

The characteristics of silver halide color photographic light-sensitive materials of this invention are to be composed of silver halide grains containing at least 0.5 mol% of silver iodide, to have a halation protection layer composed of black colloidal silver and to have the coated silver whose total amount is not larger than 80 mg/dm$^2$, preferably not larger than 60 mg/dm$^2$, especially preferably not more 50 mg/dm$^2$ and, moreover, to have the photographic composition layer whose thickness without the support (that is, the thickness of gelatine layer) is not larger than 25 μm, preferably not larger than 22 μm, more preferably not larger than 20 μm. Especially important characteristics are to effectively utilize the good character of highly-sensitive silver halide grains containing silver iodide and to cover the bad character of these grains by using the silver halide grains containing silver iodide in the core and/or shell and by concealing the core with the shell of a specific thickness whose composition is silver bromide, silver chloride, silver chlorobromide or silver iodobromide or their mixture.

The above-mentioned silver halide emulsion containing silver halide grains in the shell of a specifically defined thickness can be manufactured by covering the core of silver halide grains contained in the mono-dispersed emulsion with these shells. In case of iodobromide shell, the ratio of silver iodide to silver bromide is preferably not larger than 20 mol%.

To make the core mono-dispersed silver halide grains, the grains of desirable diameter can be obtained with the double-jet method by keeping pAg constant. The silver halide emulsion of high mono-dispersivity can be manufactured by using the method described in Japanese Patent O.P.I. Publication No. 48521/1979. A preferable procedure described in this patent is as follows: an aqueous solution of potassium iodobromide-gelatine and an aqueous solution of ammoniacal silver nitrate are added into an aqueous gelatine solution containing silver halide seed grains by changing the addition velocity as the function of time. By selecting the time function of addition velocity, pH, pAg and temperature properly, a highly dispersed silver halide emulsion can be obtained.

Since the grain-size distribution of the mono-dispersed emulsion shows almost normal distribution, the standard deviation can be obtained easily. Width of distribution is defined as:

$$\frac{\text{Standard deviation}}{\text{Mean diameter of grains}} \times 100 = \text{Width of distribution (\%)}$$

Width of distribution which can effectively normalize the absolute thickness of covering should be not higher than 20% and, more preferably, should be not higher than 10% and have mono-dispersivity.

The thickness of the core covering the shell should be sufficiently small not to conceal the preferable character of the core and should also be sufficiently large to conceal the not-preferable character of the core. That is to say, the thickness of the core should be in a very small range limited by such upper and lower limits. Such kind of shell can be obtained by depositing a soluble silver halide compound solution and a soluble silver solution on the surface of the mono-dispersed core by the double-jet method.

An example of experimental preparation to manufacture the core-shell emulsion is shown below.

Actually mono-dispersed silver halide grains having the mean diameter of 1 μm and containing 2 mol% of silver iodide was used as the core and the 0.2 mol% silver iodebromide was used as the shell. An experimental measurement was carried out by changing the thickness of the shell. When the thickness of shell was 0.85 μm, the covering power of mono-dispersed silver halide grains was low. The product was treated with a solution having a physical-developing property and containing a solvent which can dissolve silver halide and then it was put to the scanning-electron microscope observation, which proved that the developed product did not contain the filament of developed silver. It suggests the degradation of optical density and covering power. By considering the figure of filament of developed silver, the mean diameter of the core was changed and the thickness of silver bromide shell was gradually decreased. Result shows that, regardless to the mean diameter of the core, the preferable thickness of the shell is not more than 0.8 μm as the absolute thickness (it should be not more than 0.5 μm, more preferably) to obtain good and abundant filaments of developed silver and to get a sufficient optical density. In this condition, a highly sensitive characteristic of the core was not disturbed.

On the other hand, when the thickness of the shell is too small the naked surface of the core containing silver iodide is partly exposed and the advantageous effects by covering with the shell—that is, chemical sensitization, quick developing, and quick fixing etc.—are lost. The preferable limit of the thickness is 0.01 μm.

According to the further research, using the high mono-dispersed dispersed core whose distribution width is not more than 10%, the preferable thickness of the shell is 0.01–0.06 μm, more preferable one is not higher than 0.03 μm.

The enhancement of optical density by the production of the above-mentioned filament of developed silver, the obtainment of sensitization effect by means of the high sensitivity of the core, and the obtainment of quick developing and fixing powers are attributable to the synergestic effect among the shells whose thickness is regulated by cores of high-dispersivity and the composition of silver halide contained in cores and shells. Accordingly, if the thickness regulation of shells can be satisfied, silver iodobromide, silver bromide, silver chloride, silver chlorobromide or their mixtures can be used as the silver halide constituting the shell. Silver bromide, silver iodobromide and their mixture are preferable by judging from the acclimatization with cores, the stability of performance and preservativity.

Light-sensitive silver halide emulsions used in this invention can apply the doping by various metal salts or metal complex salts at the period when the precipitation of silver halide in cores and shells is produced or during or after the development of grains. Salts or complex salts of gold, platinum, palladium, iridium, rhodium, bismuth, cadmium and copper or their combinations can be used for this purpose.

Excessive halogen compounds obtained during the preparation of the emulsions of this invention and salts and compounds such as nitrates and ammonium salts may be removed. Removing procedures used for ordinary emulsions such as noodle-washing method, dialysis method and flocculation method can be used.

Various kinds of chemical sensitization methods which are usually applied for conventional emulsions can also be applied for the emulsions of this invention. They are: activated gelatin, precious metal sensitizers such as water-soluble gold salts, water-soluble platinum salts, water-soluble palladium salts water-soluble rhorium salts, water-soluble iridium salts; sulfur sensitizers; selenium sensitizers; reduction sensitizers such as polyamines and tin (II) chloride. They can be used singly or in multiple.

The silver halides used in the emulsions can be optically sensitized in a desirable wave-length zone. As the optical sensitizing method, various methods can be applied without limitation such as cyanine dyes (e.g. zeromethine dye, monomethine dye, trimethine dye) or melocyanine dyes; they can be used singly or in multiple (e.g. super sensitization) to sensitize optically. These techniques described in:

U.S. Pat. Nos. 2,688,545, 2,912,329, 3,397,060, 3,615,635, 3,628,964; British Pat. Nos. 1,195,302, 1,242,588 and 1,293,862; West German Pat. (OLS) Nos. 2,030,326, 2,121,780; Japanese Patent Examined Publication Nos. 4936/1968, 14030/1969. Selection can be made in relation to the purposes and uses such as wave lengths to be developed and sensitivity.

Moreover, at the time to form silver halide grains of the silver halide emulsion used in this invention it can be improved into a mono-dispersed silver halide emulsion having almost uniform shell thickness with the treatment such as the use of the silver halide emulsion whose core is composed from practically mono-dispersed silver halide grains and is covered with shells. Such kind of practically mono-dispersed silver halide emulsions can be applied either in the grain-size distribution as it is or by blending two or more kinds of mono-dispersed emulsions having different mean diameters at an arbitrary period after grain formation.

As the silver halide emulsions of this invention the desirable ones are those which contain the silver halide grains in a ratio equivalent to or higher than that of the emulsions obtained by covering the mono-dispersive core having a width of distribution lower than 20% with a shell. However, it is allowable to contain silver halide emulsions not belonging to this invention in a range not obstructing the effect of this invention. In this case, the silver halide not belonging to this invention is either a core-shell type or not. And also it should be either a mono-dispersed or multi-dispersed type. The silver halide emulsions of this invention should preferably contain the silver halide grains of this invention in a ratio at least 65 weight %. Hopefully, it should be better if the almost all part is the silver halide grains of this invention.

This invention includes the silver halide emulsion containing emulsions in which tabular type silver halide grains containing at least 0.5 mol% of silver iodide. That is to say, the emulsions of this invention used in the silver halide emulsion layers of this invention include emulsions containing silver halide grains such conditions as:

1 aforementioned silver iodide-containing grains
2 tabular silver halide grains containing silver iodide (the grains should either be a core-shell type or not).
3 a mixture of 1 and 2.

From now on, tabular type silver halide grains containing silver iodide should be described.

A preferable type of tabular type silver halide grains is those whose grain diameters are five times or more of their thickness. They can be manufactured by general preparation methods described in Japan Patent O.P.I. Publication Nos. 113930/1983, 113934/1983, 127921/1983, 108532/1983, 99433/1984, and 119350/1984. In this invention, the diameter of grains should be more than 5 times of their thickness and should preferably be 5–100 times and more preferably be 7–30 times. Actual sizes of the diameters of grains should preferably be more than 0.3 μm and more preferably be 0.5–6 μm.

These tabular type silver halide grains can exhibit a more preferable effect for the purpose of this invention when a light sensitive material is used having one or more layers in which such type of grains are contained at a ratio 50 weight % or more. Especially preferable effect is obtained when almost of the all grains are the tabular type silver halide grains.

It is especially beneficial when the tabular type grains are the core-shell type. The core-shell grains should preferably possess the qualifications for the core-shell aforementioned.

In general, the tabular type means to have two flat planes parallel to each other and "thickness" in this invention can be expressed by the distance between two parallel planes composing the tabular silver halide grain.

"Diameter of grain" means the diameter of the projected plane when the tabular silver halide grain is observed at the rectangular direction to the tabular plane. When the figure of the plane is not a circle, the diameter of an imaginary circle is used whose diameter is the longest distance of the figure.

The composition of the tabular silver halide emulsion should preferably be silver bromide and silver iodobromide. More preferably, the silver iodobromide should be used whose silver iodide content is 0.5–10 mol%.

Then, the manufacturing method of tabular silver halide grains should be described.

As its manufacturing method, various methods well known in the photographic industry can be applied in a proper combination.

For example, a seed crystal containing tabular silver halide grains in more than 40 weight % is produced in an atmosphere where the pAg value is comparatively high and the pBr value is not higher than 1.3. And then, the seed crystal is gradually grown by keeping this pBr value and simultaneously adding silver and halogen solutions.

During this grain-growing process, the addition of silver and halogen solutions should be carried out so as not to generate new crystal nuclei.

The size of the tabular silver halide grain can be adjusted by controlling the temperature, the selection of the kind and the amount of solvent, the adding velocity of silver salts and the kind of halogen compounds used for the grain development.

During the manufacture of the tabular silver halide grains the size, configuration (the ratio of diameter and thickness, etc.), size distribution, and the developing velocity of the grains can be controlled by applying a solvent for silver halide at need. The applicable amount of the solvent should preferably be $1\times10^{-3}-1.0$ weight % of the reaction solution and more preferably be $1\times10^{-2}-1\times10^{-1}$ weight % of it.

For example, growing velocity can be increased by mono-dispersing the size distribution of silver halide grains accompanied with increasing the applied amount of the solvent of halogen.

Applicable solvents for silver halide are ammonia, thioether, thiourea, etc. Concerning thioethyer, reference documents are U.S. Pat. Nos. 3,271,157, 3,790,387 and 3,574,628.

The manufacturing of the tabular silver halide grains should preferably be carried out by increasing the adding velocities, amounts, and concentrations of silver salt solutions (e.g. aqueous $AgNO_3$ solution) and halide solutions (e.g. aqueous KBr solution) so as to accelerate the growing of the grains.

Reference documents for these processes are: British Pat. No. 1,335,925; U.S. Pat. Nos. 3,672,900, 3,650,757, 4,242,445; Japanese Patent O.P.I. Publication Nos. 142329/1980, 158124/1980.

The tabular silver halide grains can be put to chemical sensitization if necessary. As the chemical sensitization method, the aforementioned methods described as those for core-shells are applicable. Especially from the standpoint to economize the use of silver, gold-sensitization, sulfur-sensitization or their combination is preferable for the tabular silver halide grains in this invention.

The weight % of the tabular silver halide grains in the total silver halide grains in the layers in which the flat late type silver halide grains are contained should be not smaller than 40%, and should preferably be not smaller than 60%.

The thickness of layers containing the tabular silver halide grains should preferably be 0.5–5.0 μm and more preferably be 1.0–3.0 μm.

The coating amount of the tabular silver halide grains should preferably be 0.5–6 g/m$^2$ and more preferably be 1–5 g/m$^2$ for one side.

There is no special restrictive conditions concerning other components of the layers containing the tabular silver halide grains such as the kind of binders, hardening agents, fogging-preventive agents, stabilizers for silver halide, sufactants, photospectral sensitization dyes, dyestuffs and ultravioletray absorbers and their reference document is, for example, Research Disclosure Vol. 176, pp. 22–28 (December, 1978).

The composition of the outside silver halide emulsion layer (that is to say, the silver halide emulsion layer located at the outside (or the surfacial side) of the aforementioned tabular silver halide grain-containing layer) should be described below.

High-sensitivity silver halide grains used for the conventional direct-photographing X-ray film can preferably be applied as the silver halide grains for the outside silver halide emulsion layer. The configuration of the silver haide grain should preferably be globular or polyhedral or mixed of two or more of them. Especially, more than 60% of the total grains (weight %) should preferably be occupied by glubular and/or polyhedral type whose diameter/thickness ratio is not higher than 5.

Mean grain size should preferably be 0.5–3 μm and it can be developed by using a solvent such as ammonia, thioether or thiourea if necessary.

It is also preferable that the emulsion used to this invention contains an epitaxally combined silver balide grain such as those described in Japanese Patent O.P.I. Publication Nos. 103725/1978, 133540/1984 and 162540/1984.

The silver halide grains should preferably be highly sensitized by using sensitizing methods such as the sensitization method with gold or other metals, the reduction sensitization, sulfur sensitization or a combination of two or more of them.

There is no special restrictions concerning other compositions of the outside emulsion layer same as those concerning the tabular silver halide-containing layer and the reference document is aforementioned Research Disclosure Vol. 176. It is also preferable that the emulsion used to this invention contains an epitaxially combined silver halide grain such as those described in Japanese Patent O.P.I. Publication Nos. 103725/1978, 133540/1984 and 162540/1984.

The silver halide emulsions of this invention can contain various conventional additives such as:

(1) stabilizers and anti-fogging agents such as azaindenes, triazoles, tetrazoles, imidazoliums, tetrazoliums, and polyhydroxy compounds;
(2) hardening agents such as aldehydes, aziridines, isooxazoles, vinylsulfones, acryloyls, carbodiamides, maleinimide, metasulfonic acids, esters and triazines;
(3) developing-accelerating agents such as benzyl alcohol, and polyoxyethylene compounds;
(4) image-stabilizing agents such as cumarones, cumaranes, bisphenols, and phosphite esters
(5) lubricating agents such as waxes, glycerides of higher aliphatic acids, and higher alcohol esters of higher aliphatic acids Moreover, various surface active agents can be used such as improvers to increase the permeability of coating additives and treating agents and anti-foaming agents and the agents to control various physical properties of light sensitive materials such as anionic, cationic, non-ionic and ampho-ionic materials. Especially, it is preferable that these surface active agents are eluted into the treating solution having bleaching power. As antistatic agents, alkali salts of the reaction products of p-aminobenzen sulfonic acid and diacetyl cellulose, styreneperfluoroalkyl sodium maleate copolymer, or styrene-maleic anhydride copolymer can effectively be used. Polymetacrylic acid methyl, polystyrene and alkali-soluble polymers are used as matting agents. Colloidal silica can also be used for the same purpose. Copolymers of acrylic acid esters or vinyl esters and another monomer containing ethylene group are used as the latex which is added for the purpose to improve the physical property of film. Glycerol and glycolic compound are used as plasticizers. Styrene-sodium maleate copolymer and alkylvinyl-ether-maleic acid copolymer are used as viscosity-increasing agent.

In the silver halide color photographic light-sensitive material of this invention, a hydrophilic colloid is used for the purpose to prepare emulsions and other hydrophilic colloidal layer coating liquid. The following substances are used for this purpose: Gelatine, gelatine derivatives, graft polymer of gelatine and other high-molecular polymer, proteins such as case in and albumine, cellulose derivatives, such as hydroxyethyl cellulose and carboxymethyl cellulose, starch derivatives, synthetic hydrophilic high-molecular polymers (or copolymers) such as polyvinyl alcohol, polyvinyl imidazole and polyacrylic amide.

As the support of the silver halide color photographic light-sensitive materials, following substances are used by being selected for purposes: glass plate, cellulose acetate, cellulose nitrate, polyester films such as polyethylene terephthalate, polyamide film, polycarbonate film, and polystyrene film; moreover, conventional reflective supporting body can also be used such as baryta paper, polyethylene-coated paper, polypropylene synthetic paper, transparent supporting body accompanied with a reflective layer or a reflective support.

For the coating of the silver halide emulsion layers and other photographic component layers of this invention, various kinds of coating procedures can be used such as dipping coating, air-doctor coating, curtain coating and hopper coating. The simultaneous coating of two ro more layers described in U.S. Pat. Nos. 2,761,791 and 2,941,898 is also applicable.

For the purpose to apply the silver halide emulsions of this invention to color photographic light-sensitive materials, procedures and materials conventionally used for the preparation of color photographic light-sensitive materials are applicable such as to introduce color couplers (cyan, magenta and yellow) into the silver halide emulsions of this invention which has been color-sensitized and adjusted to red-, green- and blue-sensitivity.

The bleach-fixing solutions of this invention can be applicable for the silver halide color photographic light-sensitive materials either coupler-incorporating type or couper-nonincorporating type they are developed with coupler-nonincorporating developer (ref. U.S. Pat. Nos. 2,376,679 and 2,801,171) or with couper-corporated developer (ref. U.S. Pat. Nos. 2,252,718, 2,592,243, and 2,590,970), respectively. Any kind of the conventional couplers known in this industry can be applied such as:

(1) cyan coupler: having naphtholic- or phenolic-type base structure and composing indoaniline dye by coupling;
(2) magenta coupler: having a skeleton structure of 5-pyrazolone ring attached with active methylene group.
(3) yellow coupler: having acylacetoanilide structure such as benzoylacetoanilide or pivaryl acetoanilide attached with active methylene chain and also attached with or not with a substitute at the coupling position. Therefore, either a so-called di-equivalent type or tetra-equivalent coupler can be used. So-called monochrome primary developing agent which is used for the treatment of the conventional silver halide color-photographic light sensitive material or the conventional developers for monochrome-photographic light-sensitive materials can be used as the developing agent of this invention for monochrome photographic developing. Various additives conventionally used for the developing of monochrome photograph can also be used. Examples of applicable additives are:

(1) developing agents such as 1-phenyl-3-pyrazolidone, methol and hydroquinone;
(2) preservatives such as sulfites;
(3) accelerators such as various alkalis—sodium hydroxide, sodium carbonate and potassium carbonate;
(4) inorganic and organic inhibitors such as potassium bromide, 2-methylbenzoimidazole, and methylbenzothiazol;
(5) water-softeners such as polyphosphates;
(6) inhibitor for surface over-developing composed of a minute amount of iodide and mercapto compounds.

Various kinds of aromatic primary amine type color-developing main agents which have been used conventionally for various color-photographic processes can be used as the color developing solution which is used preceding to the treatment by the bleach-fixing solution of this invention. As this type of color-developing agents, aminophenolic and p-phenylene diamine derivatives are used. These compounds are used not as the free compounds but as the salt type such as chloride and sulfate because of their stability. These compounds should preferably be used in a concentration about 0.1–30 g per 1 liter of the color developer and more preferably in a concentration about 1–15 g per liter.

Applicable examples of aminophenolic developing agents are: o-aminophenol, p-aminophenol, 5-amino-2-hydroxytoluene, 2-amino-3-hydroxytoluene, 2-hydroxy-3-amino-1,4-dimethylbenzine.

Especially useful armatic primary amine type color developing agents are N-dialkyl-p-phenylene-diamine compounds whose alkyl and phenyl groups may either be substituted or not. Especially useful ones among them are:

N,N-diethyl-p-phenylene-diamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-β-methanesulfonamideethyl-3-methyl-4-aminoaniline sulfate, N-ethyl-N-β-hydroxyethylaminoamiline sulfate, 4-amino-3-methyl-N,N-diethylaniline sulfate, 4-amino-N-(methoxyethyl)-N-ethyl-3-methylamiliine-p-toluenesulfonate.

Especially useful color-developing main agents used in this invention are paraphenylenediamine type color-developing main agents attached with at least one water-soluble group (hydrophilic group) on the amino group. Typical examples of such kind color-developing agents are as follows (but the invention is not limited to these):

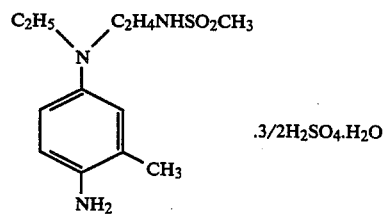

(1)

-continued (2)

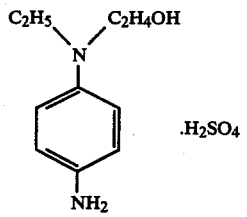

(3)

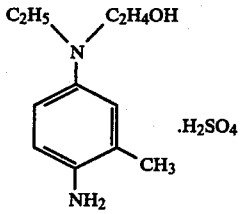

(4)

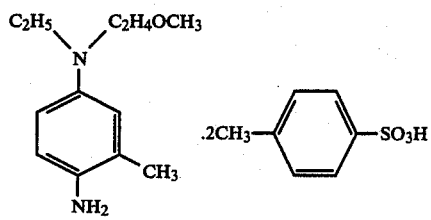

(5)

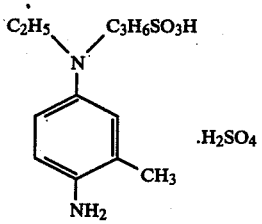

(6)

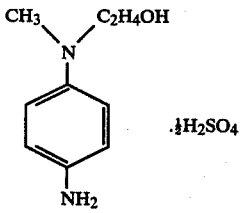

(7)

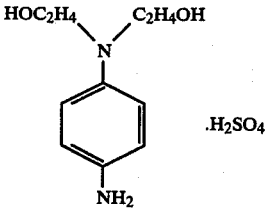

(8)

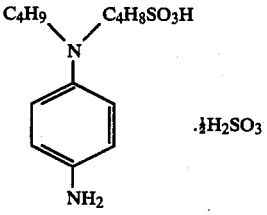

-continued (9)

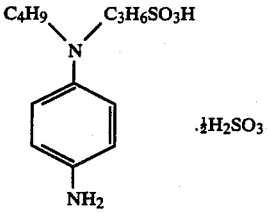

(10)

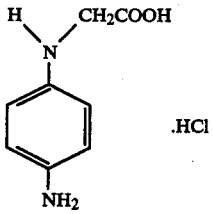

(11)

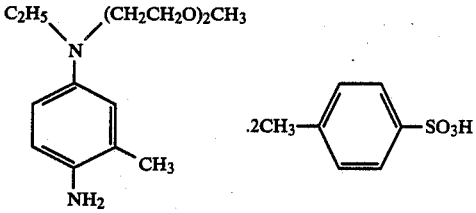

(12)

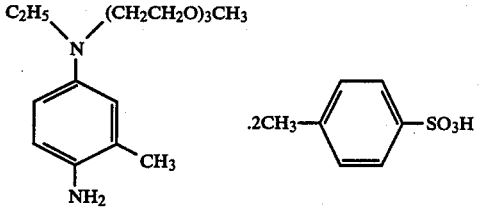

(13)

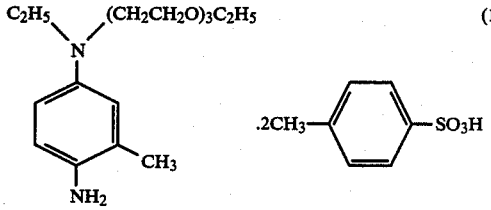

(14)

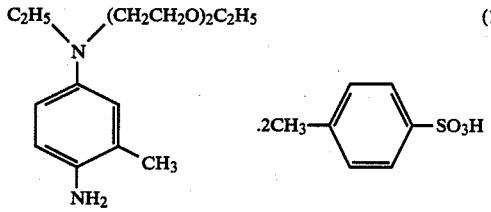

Especially useful color-developing main agents used in this invention are compounds containing substituted groups such as —$(CH_2)n.CH_2OH$, —$(CH_2)m.N$-$HSO_2(CH_2)n.CH_3$, and —$(CH_2)m.O(CH_2)n.CH_3$ (where, m and n are integers 0–6, and preferably are 0–5). Actual examples are above-mentioned (1), (2), (3), (4), (6) and (7).

The above-mentioned paraphenylenediamine type color-developing agents should preferably be mixed in the bleach-fixing solution of this invention.

Alkaline color-developing solution used preceding to the use of the bleach-fixing solution of this invention can contain various additives mixed with the above-mentioned aromatic primary amine type color-developing agent. These are the conventionally used additives for color-developers such as:

(1) Alkaline agents such as sodium hydroxide, sodium carbonate, potassium carbonate;

(2) Water softeners and concentraters such as alkali-metal sulfites, alkali-metal bisulfites, alkali-metal thiocyanates, alkali-metal halides, benzyl alchol, diethylenetriamine pentaacetic acid, and 1-hydroxyethylidene-1,1-diphsphonic acid.

The value of pH of this color-developing solution is, in general, higher than 7 and more generally, about 10–13.

The bleach-fixing solution used in this invention can be applied for various silver halide color-photographic light sensitive materials in which the emulsions of this invention are used. Examples of them are: color paper, color negative film, color positive film, color reversal film for slide use, color reversal film for movies, color reversal film for television, reversal color paper.

It is most preferably applied for silver iodide-containing highly-sensitive color-photographic materials whose total coated silver amount is 20–50 mg/dm$^2$.

[EXAMPLES]

Detail of this invention will be explained in the following practical examples. Practical features of this invention are not limited to them.

EXAMPLE 1

Layer configuration of the highly sensitive silver halide color-photographic light sensitive materials conventionally adopted in this trade are used. That is to say, the order of layer is as follows (Various supplemental layers are inserted in between):

(1) Anti-halation layer
(2) Red-sensitive silver halide emulsion layer
(3) Green-sensitive silver halide emulsion layer
(4) Blue-sensitive silver halide emulsion layer
(5) Mono-dispersed highly-sensitive silver halide emulsion layer (from the side of the support).

Samples are prepared with the undermentioned ways. The total amount of coated silver is made uniform by changing the amount of gelatine and the thickness of the coated layers after drying is let to change. Amount of coated silver in each layer is adjusted to:

Blue-sensitive silver halide emulsion layer: about 13 mg/dm$^2$

Green-sensitive silver halide emulsion layer: about 18 mg/dm$^2$

Red-sensitive silver halide emulsion layer: about 13 mg/dm$^2$

Undermentioned is the standad coating condition and they are adjusted by changing the amount of gelatine for the change of thickness.

Layer 1 . . . Silver nitrate was reduced by using hydroguinone as the reducing agent and the obtained black colloidal silver (0.8 g) was dispersed in gelatine (3 g) and it was coated as the anti-halation layer. Obtained black colloidal silver has a high absorption in a wave-length range 400–700 nm.

Layer 2 . . . Intermediate layer composed of gelatine (thickness after drying: 0.8 μm)

Layer 3 . . . Low-sensitivity red-sensitive silver halide emulsion layer containing:

(1) 1.5 g of low-sensitive red-sensitive silver iodo-bromide emulsion (AgI: 6 mol %)
(2) 1.9 g of gelatine
(3) 0.4 g of tricresylphosphate (hereinafter referred to TCP) dissolving 0.96 g of 1-hydroxy-4-(β-methoxyethylaminocarbonylmethoxy)-N-[δ-2,4-di-t-aminophenoxy)butyl]-2-naphthoamide (hereinafter referred to cyan coupler (C-1) and 0.028 g of 1-hydroxy-4-[4-(1-hydroxy-8-)acetoamido-3.6-disulfo-2-naphthylazo)phenoxy]-N-[δ-(2,4-di-amylphenoxy)butyl]-2-naphthoamide disodium (hereinafter referred to colored cyan-coupler (CC-1).

Layer 4 . . . High-sensitivity red-sensitive silver halide emulsion layer containing 1.1 g of high-sensitivity red-sensitive silver iodo-bromide emulsion (AgI: 8 mol %), 1.2 g of gelatine, 0.15 g of TCP dissolving 0.41 g of cyan coupler (C-1) and 0.026 g of colored cyan-coupler (CC-1).

Layer 5 . . . Intermediate layer containing 0.04 g of dibutylphthalate (hereinafter referred to DBP) dissolving 0.08 g of 2,5-di-t-octylhydroquinone (hereinafter referred to stain preventing agent (HQ-1) and 1.2 g of gelatine Layer 6 . . . Low-sensitivity green-sensitive silver halide emulsion layer containing:

(1) 1.6 g of low-sensitivity green-sensitive silver iodo-bromide emulsion (AgI: 15 mol %)
(2) 1.7 g of gelatine
(3) 0.3 g of TCP dissolving $2\times10^{-1}$ mol of the magenta coupler of this invention and 0.066 g of 1-(2,4,6-trichlorophenyl)-4-(1-naphthylazo)-3-(2-chloro-5-octadecenylsuccinimidoanilino)-5-pyrazolone (hereinafter referred to color magenta coupler (CM-1))

Layer 7 . . . High-sensitivity green-sensitive silver halide emulsion layer containing 1.5 g of high-sensitivity green-sensitive silver iodo-bromide emulsion (AgI: 11 mol %), 1.9 g of gelatine and 1.2 g of TCP containing $0.62\times10^{-1}$ mol, of magenta coupler of this invention and 0.049 g of colored magenta coupler (CM-1).

Layer 8 . . . Yellow filter layer containing 0.2 g of yellow colloidal silver, 0.11 g of DBP dissolving 0.2 g of stain preventing agent (HQ-1) and 2.1 g of gelatine Layer 9 . . . Low-sensitivity blue-sensitive silver halide emulsion layer containing:

(1) 0.95 g of low-sensitivity blue-sensitive silver iodo-bromide emulsion (AgI: 6 mol %)
(2) 1.9 g of gelatine
(3) 0.93 g of DBP dissolving 1.84 g of α-[4-(1-benzyl-2-phenyl-3,5-dioxo-1,2,4-triazolidinyl)]-α-pivaroyl-2-chloro-5-[γ-2,4-di-t-aminophenoxy)-butaneamido]acetoanilide (hereinafter referred to yellow coupler (Y-1))

Layer 10 . . . High-sensitivity blue-sensitive silver halide emulsion layer containing 1.2 g of high-sensitivity mono-dispersed blue-sensitive silver iodo-bromide (AgI: 7 mol %), 2.0 g of gelatine, 0.23 g of DBP dissolving 0.46 g of yellow coupler (Y-1).

Layer 11 . . . secondary protective layer of gelatine

Layer 12 . . . primary protective layer containing 2.3 g of gelatine

Thickness (after drying) of the photographic composition layer of the prepared samples are 4 kinds (35, 27, 25 and 18 μm). Samples No. 1–4 contain coupler M-I-35 exemplified in this invention in layers 6 and 7 and samples No. 5–8 contain coupler M-I-27. The swelling rate ($T\frac{1}{2}$) of the layer is 25 second.

Another group of samples (No. 9–16) was also prepared by using magenta couplers undermentioned in (1) and (2) (control couplers) instead of those of this invention contained in layers 6 and 7. Addition amounts (mol numbers) were equal to those of this invention and the sensitometry was adjusted so as to exhibit same as that in this invention and other conditions were also made equal t those in this invention.

Control coupler (1)

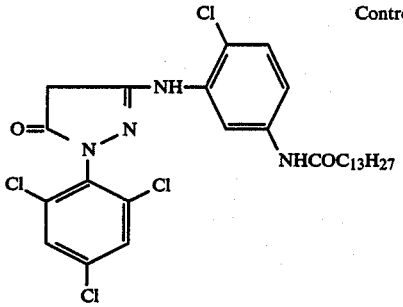

Control coupler (2)

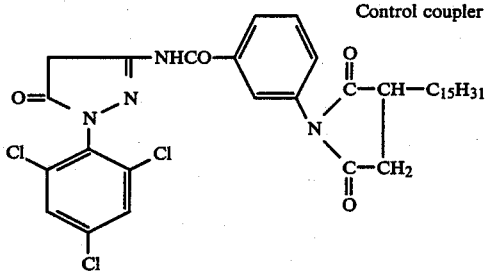

Processing is: color developing: 3 minutes and 15 seconds; bleach-fixing: 1–30 minutes; primary stabling: 2 minutes; secondary stabling: 30 seconds; temperature of each treatment: 37.8° C.

Recipes of the treating solutions are:

| [Color-developing solution] | |
|---|---|
| potassium carbonate | 30.0 g |
| sodium sulfite | 2.0 g |
| hydroxylamine-sulfuric acid | 2.0 g |
| 1-hydroxyethylidene-1, 1-diphosphonic acid (60% aqueous solution) | 1.0 g |
| potassium bromide | 1.2 g |
| magnesium chloride | 0.6 g |
| sodium hydroxide | 3.4 g |
| N—ethyl-N—β-hydroxyethyl-3-methyl-4-amino-aniline sulfate | 4.6 g |

Total is made to 1 liter by adding water and its pH is adjusted to 10.1 by using sodium hydroxide.

| [Bleach-fixing solution] | |
|---|---|
| ethylenediaminetetraacetic acid diammonium salt | 7.5 g |
| diethylenetriaminepentaacetic acid iron (III) ammonium | 0.3 mol |
| ammonium sulfite (50% solution) | 10.0 g |
| ammonium thiosulfate (70% solution) | 200.0 g |

Total is made to 1 liter by adding water and its pH is adjusted to 7.5 by using ammonium hydroxide.

| [Primary stabilizer] | |
|---|---|
| 1-hydroxyethylidene 1, 1-diphosphonic acid | 3.0 g |
| 5-chloro-2-methyl-4-isothiazoline-3-on | 1.0 g |
| ethyleneglycol | 1.0 g |

Total is made to 1 liter by adding water and its pH is adjusted to 7.1 by adding potassium hydroxide.

| [Secondary stabilizer] | |
|---|---|
| formaline (37% solution) | 7.0 ml |
| $C_9H_{19}$—⟨benzene⟩—$O(CH_2CH_2O)_{10}H$ | 1.0 ml |

Total is made to 1 liter by adding water.

As bleaching accelerator in the bleach-fixing solution the exemplified compound (1) was added (0.7 g per liter). The time needed to finish the bleach-fixing (desilvering time) was measured.

And also, the ratio of re-coloring inferiority of the cyan dye was measured by the following method and its result is shown in Table 1.

(cyan dye loss ratio)

Red-color density at the end of desilvering of a sample was measured (the obtained value is D(R)). After that, the sample was treated with the oxidizing bath containing 0.5 mol of ethylenediaminetetraacetic acid iron (III) complex and having pH 6.0 for 6 minutes at 40° C. The red-color density was then measured again (the obtained value is D(R)o). The cyan dye loss ratio is obtained by the formula:

$$\text{cyan dye loss ratio} = \frac{D(R)o - D(R)}{D(R)o}$$

TABLE 1

| Sample No. | Thickness of Coating (μm) | Layer swelling rate ($T\frac{1}{2}$) = 25 seconds: Magenta coupler | Re-coloring inferiority ratio (%) | End time of desilvering |
|---|---|---|---|---|
| 1 | 35 | M-I-35 | 0 | 22 min. |
| 2 | 27 | " | 1.3 | 18 min. |
| 3 | 25 | " | 2.0 | 4 min. |
| 4 | 18 | " | 2.2 | 3 min. |
| 5 | 35 | M-I-27 | 1.0 | 25 min. |
| 6 | 27 | " | 1.3 | 19 min. |
| 7 | 25 | " | 1.8 | 5 min. |
| 8 | 18 | " | 2.2 | 4 min. |
| 9 | 35 | Control-1 | 0 | 23 min. |
| 10 | 27 | " | 1.3 | 19 min. |
| 11 | 25 | " | 12.4 | 7 min. |
| 12 | 18 | " | 10.5 | 6 min. |
| 13 | 35 | Control-2 | 1.3 | 27 min. |
| 14 | 27 | " | 1.2 | 20 min. |
| 15 | 25 | " | 10.7 | 6 min. |
| 16 | 18 | " | 13.3 | 4 min. |

Table 1 shows that the ratio of cyan dye loss is extremely increased when the thickness of coating is lowered to 25 μm or lower in the case of the magenta couplers not used in this invention and the ratio is not increased even though the thickness of coating is lowered to 25 μm or lower in the case of the magenta a coupler of this invention. It shows that the magenta coupler of this invention can exhibit a marvelous effect to the improvement of the cyan dye loss ratio. The table also shows that the end time of de-silvering is not extented by the use of magenta couplers of this invention.

[EXAMPLE 2]

Samples were prepared by reducing the amount of hardening agent and by shortening the swelling rate (T ½) to 10 sec. Other conditions were same as the practical example 1. The re-coloring inferiority ratio of cyan dye was measured. The bleach-fixing solution not containing the accelerator was also tested and evaluated. (Table 2)

TABLE 2

| Sample No. | Thickness of coating (μm) | Layer swelling rate (T ½) = 10 seconds | | |
|---|---|---|---|---|
| | | Magenta coupler | Cyan dye loss ratio (%) Without accelerator | Cyan dye loss ratio (%) With exemplified compound (1) |
| 17 | 35 | M-I-35 | 0 | 0 |
| 18 | 27 | " | 1.6 | 1.8 |
| 19 | 25 | " | 2.1 | 1.9 |
| 20 | 18 | " | 2.2 | 2.3 |
| 21 | 35 | M-I-27 | 1.3 | 1.5 |
| 22 | 27 | " | 2.5 | 2.3 |
| 23 | 25 | " | 2.0 | 2.4 |
| 24 | 18 | " | 1.9 | 1.7 |
| 25 | 35 | Control-1 | 1.3 | 1.3 |
| 26 | 27 | " | 2.5 | 2.5 |
| 27 | 25 | " | 12.0 | 12.0 |
| 28 | 18 | " | 11.5 | 11.0 |
| 29 | 35 | Control-2 | 0 | 0 |
| 30 | 27 | " | 2.2 | 2.5 |
| 31 | 25 | " | 10.0 | 10.5 |
| 32 | 18 | " | 14.0 | 13.2 |

Table 2 clearly shows that the samples containing the magenta couplers of this invention exhibits the improvement in re-coloring inferiority ratio of cyan dye either when an accelerator (exemplified compound (1)) is contained or not. This improvement effect is not reduced even when the swelling rate (T ½) is changed in the extent indicated in this invention.

Other exemplified bleaching accelerators [(3), (8), and (9)] were also tested and a similar good result for improvement in re-coloring inferiority ratio was obtained.

[EXAMPLE 3]

Samples were prepared by using the same as example 1 but changing the magenta coupler and the swelling rate (T ½) as shown in Table 3. (The thickness of coating is 20 μm. The re-coloring inferiority ratio of cyan dye was measured after the same treatment. Bleach-fixing solutions containing various organic acid iron (III) complexes (0.3 mol) and the bleaching accelerator (exemplified compound (1)) (0.7 g/l) were prepared and tested. Result is shown in Table 3.

TABLE 3

| Amino-polycarboxylic acid iron (III) complex | Layer swelling rate (T ½) = 20 seconds | |
|---|---|---|
| | Magenta coupler | Re-coloring inferiority ratio (%) |
| Triethylenetetramininehexa-acetic acid | M-I-26 | 1.3 |
| (MW = 494.45) | M-I-29 | 2.4 |
| iron (III) complex | Control-1 | 18.6 |
| 0.3 mol | Control-2 | 17.3 |
| Diethylenethiaminepenta-acetic acid | M-I-26 | 2.3 |
| (MW = 393.27) | M-I-29 | 2.2 |
| iron (III) complex | Control-1 | 15.3 |
| 0.3 mol | Control-2 | 14.2 |
| Ethylenediaminetetra-acetic acid | M-I-26 | 1.5 |
| | M-I-29 | 1.9 |

TABLE 3-continued

| Amino-polycarboxylic acid iron (III) complex | Layer swelling rate (T ½) = 20 seconds | |
|---|---|---|
| | Magenta coupler | Re-coloring inferiority ratio (%) |
| (MW = 292.25) | Control-1 | 13.6 |
| iron (III) complex | Control-2 | 12.2 |
| 0.3 mol | | |
| Hydroxyethyliminodiacetic | M-I-26 | 1.8 |
| acid | M-I-29 | 2.3 |
| (MW = 177.16) | Control-1 | 12.0 |
| iron (III) complex | Control-1 | 11.3 |
| 0.3 mol | | |
| Methyliminodiacetic acid | M-I-26 | 1.6 |
| (MW = 147.13) | M-I-29 | 1.4 |
| iron (III) complex | Control-1 | 10.6 |
| 0.3 mol | Control-2 | 11.9 |

Table 3 shows that the improvement effect to reduce the cyan dye loss ratio by using the magenta couplers of this invention is exhibited even though the molecular weight of organic acid iron (III) complex is changed. When the magenta couplers not described in this invention are used the cyan dye loss ratio increases with the increase of the molecular weight of organic acid iron (III) complex salt.

[EXAMPLE 4]

Samples were prepared as follows. The amount of coated silver was made to uniform (about 47 mg/dm$^2$) by adjusting the thickness of coating (after drying) with the change of the amount of gelatine. The following recipes are the standard ones and the amount of gelatine is changeable.

Layer 1 . . . Silver nitrate was reduced by using hydroquinone as the reducing agent and the obtained black colloidal silver (0.9 g) was dispersed in gelatine (3 g) and it was coated as the halation protecting layer. Obtained black colloidal silver has a high obsorption in a wave-length range 400–700 nm.

Layer 2 . . . Intermediate layer composed of gelatine (thickness after drying: 0.8 μm)

Layer 3 . . . Low-sensitivity red-sensitive silver halide emulsion layer containing 2.0 g of low-sensitivity silver iodobromide emulsion (AgI: 6 mol %), 2.0 g of gelatine, 0.5 g of TCP dissolving 1.00 g of cyan coupler (C-1) and 0.030 g of colored cyan couper (CC-1).

Layer 4 . . . High-sensitivity red-sensitive silver halide emulsion layer containing 1.3 g of high-sensitivity red-sensitive silver iodobromide emulsion (AgI: 7 mol %), 1.4 g of gelatine and 0.18 g of TCP dissolving 0.39 g of cyan coupler (C-2) and 0.024 g of colored cyan coupler (CC-1).

Layer 5 . . . Intermediate layer containing 0.04 g of DBP dissolving 0.09 g of stain preventing agent (HQ-1) and 1.2 g of gelatine Layer 6 . . . Low-sensitivity green-sensitive silver halide emulsion layer containing 1.6 g of low-sensitivity green-sensitive silver iodobromide emulsion (AgI: 18 mol %), 1.7 g of gelatine and 0.3 g of TCP dissolving 0.44 g of 1-(2,4,6-trichlorophenyl)-3-[3-(2,4-di-t-amylphenoxyacetamido)benzenamido]-5-pyrazolone [hereinafter referred to magenta coupler (control-3)] and 0.064 g of colored magenta coupler (CM-1).

Layer 7 . . . High-sensitivity green-sensitive silver halide emulsion layer containing 1.5 g of high-sensitivity green-sensitive silver iodobromide emulsion (AgI: 11 mol %), 1.9 g of gelatin, and 0.12 g of TCP dissolving 0.137 g of magenta coupler (control-3), 0.51 g of magenta coupler (M-II-2) and 0.049 g of colored magenta coupler (CM-1 ).

Layer 8 . . . Yellow filter layer containing 0.3 g of yellow colloidal silver, 0.11 g of DBP dissolving 0.2 g of stain preventing agent (HQ-1) and 2.1 g of gelatin.

Layer 9 . . . Low-sensitivity blue-sensitive silver halide emulsion layer containing 1.02 g of low-sensitivity blue-sensitive silver iodobromide emulsion (AgI: 4 mol %), 1.9 g of gelatine and 0.93 g of DBP dissolving 1.84 g of yellow coupler (Y-1).

Layer 10 . . . High-sensitivity blue-sensitive silver halide emulsion layer containing 1.6 g of high-sensitivity monodispersed blue-sensitive silver iodobromide emulsion (AgI: 4 mol %), 2.0 g of gelatine and 0.23 g of DBP dissolving 0.46 g of yellow coupler (Y-1).

Layer 11 . . . Secondary protective layer of gelatine

Layer 12 . . . Primary protective layer containing 2.3 g of gelatine

Thickness (after drying) of the photographic composition layer of the prepared samples were 4 kinds (35, 25, 20 and 18 μm) (Samples No. 41–44, respectively).

Another group of samples (No. 45–56) was also prepared) by recipes as follows:

No. 45–48: the magenta couplers contained in the green-sensitive silver halide emulsion layers are changed to those used in control 1 (Example 1) in mol numbers same as in control 3. No. 49–52: the magenta couplers are changed to those exemplified magenta coupler M-II-5 of this invention No. 53–56: the magenta couplers are changed to M-II-44.

The swelling rate T ½ was 20 seconds. Treatment and treating solutions were same as those shown in Example 1.

Amount of residual silver in the green-sensitive emulsion layer was measured and compared by using spectral absorption at 1000 nm and fluorescent X-ray analyses. Measurement of spectral absorption was practiced by using optical densitometer equipped with interference filter of 1000 nm.

TABLE 4

| Sample No. | Thickness of coating (μm) | Diethylenetriaminepentaacetic acid iron (III) Complex 0.35 mol: Magenta coupler | Amount of residual silver mg/dm²: Spectral absorption | Amount of residual silver mg/dm²: Fluorescent X-ray |
|---|---|---|---|---|
| 41 | 35 | Control-3 | 0.47 | 0.57 |
| 42 | 25 | " | 0 | 0.27 |
| 43 | 20 | " | 0 | 0.27 |
| 44 | 18 | " | 0 | 0.20 |

TABLE 4-continued

| Sample No. | Thickness of coating (μm) | Diethylenetriaminepentaacetic acid iron (III) Complex 0.35 mol: Magenta coupler | Amount of residual silver mg/dm²: Spectral absorption | Amount of residual silver mg/dm²: Fluorescent X-ray |
|---|---|---|---|---|
| 45 | 35 | Control- 1 | 0.50 | 0.54 |
| 46 | 25 | " | 0 | 0.23 |
| 47 | 20 | " | 0 | 0.25 |
| 48 | 18 | " | 0 | 0.25 |
| 49 | 35 | M-II-5 | 0.49 | 0.55 |
| 50 | 25 | " | 0 | 0 |
| 51 | 20 | " | 0 | 0 |
| 52 | 18 | " | 0 | 0 |
| 53 | 35 | M-II-44 | 0.48 | 0.52 |
| 54 | 25 | " | 0 | 0 |
| 55 | 20 | " | 0 | 0 |
| 56 | 18 | " | 0 | 0 |

As shown in Table 4, among various necessary conditions of this invention a trace amount of residual silver cannot be diminished if the control magenta couplers are used even though other conditions such as the thickness of coating, swelling velocity T ½, amount of coated silver are satisfied.

(see samples 42, 43, 44, 46, 47, 48 in Table 4)

By the use of the Magenta couplers of this invention a marvelous result was obtained that the trace amount of residual silver could be removed completely (see samples 50, 51, 52, 54, 55, 56 in Table 4). Result also shows that this trace amount silver cannot be removed by decreasing the thickness of coating.

Experiments were also carried out by using the couplers of this invention M-II-7, M-II-18, M-II-23, M-II-41, M-II-59, M-II-100, M-II-104, M-II-116, and M-II-142. Trace amount of silver could not be detected either by absorption spectrometry or by X-ray fluorometry in the case when the thickness of coating was smaller than 25 μm.

[EXAMPLE 4]

Twenty-four kinds of samples were prepared by using emulsions whose compositions were same as those in Practical example 3 (samples 41 45, 49 and 53), by adjusting the amount of emulsions to 100 mg/dm², 70 mg/dm², and 30 mg/dm², and adjusting the swelling rate T ½. to 10 and 35 seconds by changing the amount of the hardening agent. Thickness of coating was settled to 20 μm and the residual amount of silvers was measured after the treatment same as described in Example 3 (bleach-fixing time: 3 minutes). Result is shown in Table 5.

TABLE 5

| Amount of residual silver (mg/dm²) | Magenta Coupler | T ½ = 10 seconds: Sample No. | Amount of residual silver: Spectral absorption (mg/dm²) | Amount of residual silver: Fluorescent X-ray (mg/dm²) | T ½ = 35 seconds: Sample No. | Amount of residual silver: Spectral absorption (mg/dm²) | Amount of residual silver: Fluorescent X-ray (mg/dm²) |
|---|---|---|---|---|---|---|---|
| 100 | Control-1 | 17 | 1.00 | 1.25 | 20 | 1.32 | 1.38 |
| 70 | " | 18 | 0.89 | 0.92 | 21 | 1.18 | 1.22 |
| 30 | " | 19 | 0 | 0.25 | 22 | 0.97 | 1.00 |
| 100 | Control-2 | 23 | 0.98 | 1.13 | 26 | 1.25 | 1.28 |
| 70 | " | 24 | 0.87 | 0.93 | 27 | 1.20 | 1.23 |
| 30 | " | 25 | 0 | 0.20 | 28 | 0.95 | 1.02 |
| 100 | M-II-5 | 29 | 0.97 | 1.09 | 32 | 1.27 | 1.33 |
| 70 | " | 30 | 0.88 | 0.90 | 33 | 1.16 | 1.20 |
| 30 | " | 31 | 0 | 0 | 34 | 0.98 | 1.05 |
| 100 | M-II-44 | 35 | 0.96 | 1.11 | 38 | 1.29 | 1.32 |
| 70 | " | 36 | 0.86 | 0.93 | 39 | 0.98 | 1.21 |

TABLE 5-continued

| Amount of residual silver (mg/dm²) | Magenta Coupler | T ½ = 10 seconds Sample No. | Amount of residual silver Spectral absorption (mg/dm²) | Fluorescent X-ray (mg/dm²) | T ½ = 35 seconds Sample No. | Amount of residual silver Spectral absorption (mg/dm²) | Fluorescent X-ray (mg/dm²) |
|---|---|---|---|---|---|---|---|
| 30 | " | 37 | 0 | 0 | 40 | 0.93 | 1.00 |

Table 5 shows that the trace amount of silver at the final stage of desilvering cannot be removed completely even though the magenta couplers of this invent is used in the case that the amount of coated silver and the swelling rate T ½ are different from those settled in this invention.

It is realized that the bleach-fixing time for practical use can remarkably be shortened by remarkable accelerating the bleach-fixing velocity and by completely removing the trace amount of residual silver only in the case when all the practical conditions of this invention is carried out satisfactorily.

[EXAMPLE 6]

Samples No. 43, 47, 51 and 55 shown in Example 3 (that is to say, samples having coating thickness of 20 μm) were taken and the effect of the organic acid iron (III) complex salts used in the bleach-fixing solution was compared. Result is shown in Table 6.

TABLE 6

| Organic acid iron (III) complex | Sample No. | Magenta Coupler | Amount of residual silver (mg/dm²) Spectral absorption | Flourescent X-ray |
|---|---|---|---|---|
| Triethylenetetramine-hexaacetic acid (MW = 494.45) iron (III) complex 0.35 mol | 43 | Control-1 | 0 | 0.24 |
| | 47 | Control-2 | 0 | 0.26 |
| | 51 | M-II-5 | 0 | 0 |
| | 55 | M-II-44 | 0 | 0 |
| Diethylenetriamine-pentaacetic acid (MW = 393.27) iron (III) complex 0.35 mol | 43 | Control-1 | 0 | 0.27 |
| | 47 | Control-2 | 0 | 0.25 |
| | 51 | M-II-5 | 0 | 0 |
| | 55 | M-II-44 | 0 | 0 |
| 1,2-Diaminopropane-tetraacetic acid (MW = 306.27) inron (III) complex 0.36 mol | 43 | Control-1 | 0 | 0.34 |
| | 47 | Control-2 | 0 | 0.33 |
| | 51 | M-II-5 | 0 | 0.01 |
| | 55 | M-II-44 | 0 | 0.02 |
| Ethylenediamine-tetraacetic acid (MW = 292.25) iron (III) complex 0.35 mol | 43 | Control-1 | 0 | 0.32 |
| | 47 | Control-2 | 0 | 0.34 |
| | 51 | M-II-5 | 0 | 0.02 |
| | 55 | M-II-44 | 0 | 0.01 |
| Hydroxyethylimino-diacetic acid (MW = 177.16) iron (III) complex 0.37 mol | 43 | Control-1 | 0 | 0.27 |
| | 47 | Control-2 | 0 | 0.26 |
| | 51 | M-II-5 | 0 | 0 |
| | 55 | M-II-44 | 0 | 0 |
| Methyliminodiacetic acid (MW = 147.13) iron (III) complex 0.35 mol | 43 | Control-1 | 0 | 0.25 |
| | 47 | Control-2 | 0 | 0.24 |
| | 51 | M-II-5 | 0 | 0 |
| | 55 | M-II-44 | 0 | 0 |

As shown in Table 6, the effect of the magenta couplers of this invention can be exhibited completely even when the kind and molecular weight of the organic acid iron (III) complex are changed variously. The effect is lowered in some extent and a very small amount of silver exists in the cases when 1.2-diaminopropanetetraacetic acid iron (III) complex and ethylenediaminetetraacetic acid iron (III) complex are used. This fact suggests the existence of some correlation between the molecular weight of organic acid iron (III) complex and the oxidizing power (de-silvering power). Its reasoning cannot be acquired yet.

There is no problem at all since the residual amount is very minute and this fact does not damage the value of this invention at all.

[EXAMPLE 7]

(Preparation of sample)

The samples were prepared whose layer configuration from the supporting body was as follows (various supplemental layers were also inserted among them):

(1) Anti-Halation layer
(2) Red-sensitive silver halide emulsion layer
(3) Green-sensitive silver halide emulsion layer
(4) Blue-sensitive silver halide emulsion layer
(5) Mono-dispersed highly-sensitive silver halide emulsion layer Samples were prepared with the undermentioned coating conditions. The total amount of coated silver was adjusted to 50 mg/dm².

Layer 1—Silver nitrate was reduced by using hydroquinone as the reducing agent and the obtained black colloidal silver (0.8 g ) was dispersed in gelatine (3 g) and it was coated as the halation preventing layer. Obtained black colloidal silver has a high absorption in a wave-length range 400–700 nm.

Layer 2—Intermediate layer composed of gelatine (thickness after drying: 0.8 μm).

Layer 3—Low-sensitivity red-sensitive silver halide emulsion layer containing 1.5 g or low-sensitivity red-sensitive silver iodobromide emulsion (AgI: 6 mol %), 1.9 g of gelatine and 0.4 g of Tricresylphosphate (hereinafter referred to TCP) dissolving 0.96 g of the control cyan coupler (indicated as C-1) and 0.028 g of colored cyan coupler (CC-1).

Layer 4—High-sensitivity red-sensitive silver halide emulsion layer containing 1.1 g of high-sensitivity red-sensitive silver iodobromide emulsion (AgI: 8 mol %), 1.8 g of gelatine and 0.15 g of TCP dissolving 0.41 g of the control cyan coupler (Cc-1), and 0.026 g of colored cyan coupler (CC-1).

Layer 5—Intermediate layer containing 0.04 g of DBP dissolving 0.08 g of stain preventing agent (HQ-1) and 1.2 g of gelatine.

Layer 6—Low-sensitivity green-sensitive silver halide emulsion layer containing 1.6 g of low-sensitivity green-sensitive silver iodobromide emulsion (AgI: 15 mol %), 1.7 g of gelatine and 0.3 of TCP dissolving 0.5 g of the control magenta coupler (Mc-1) and 0.066 g of colored magenta coupler (CM-1).

Layer 7—High-sensitivity green-sensitive silver halide emulsion layer containing 1.5 g of high-sensitivity green-sensitive silver iodobromide emulsion (AgI: 11 mol %), 1.9 of gelatine and 0.12 g of TCP dissolving 0.187 g of the control magenta coupler (Mc-1) and 0.049 g of colored magenta coupler (CM-1).

Layer 8—Yellow filter layer containing 0.2 g of yellow colloid silver, 0.11 g of DBP dissolving 0.2 g of stain preventing agent and 2.1 g of gelatine Layer 9—Low-sensitivity blue-sensitive silver halide emulsion layer containing 0.95 g of low-sensitivity blue-sensitive silver iodobromide emulsion (AgI: 6 mol %), 1.9 g of gelatine and 0.93 g of DBP dissolving 1.84 g of the control yellow coupler (Yc-1).

Layer 10—High-sensitivity blue-sensitive silver halide emulsion layer containing 1.2 g of high-sensitivity blue-sensitive silver iodobromide emulsion (AgI: 6 mol %), 1.9 g of gelatine and 0.23 g of DBP dissolving 0.46 g of the control yellow coupler (Yc-1).

Layer 11—Secondary protecting layer of gelatine

Layer 12—Primary protecting layer containing 2.3 g of gelatine

The multi-layered color photographic light-sensitive material was prepared by coating these layers so as to make the dry thickness of photograph-constituting layer 20 μm and the swelling velocity (T ½) 10 seconds (Sample 91).

Moreover, samples 92–98 were prepared by changing the amount of the coupler in each emulsion layer and the amount of high-boiling point solvent.

Sample 92: The control magenta coupler (Mc-1) used in layers 6 and 7 of Sample 1 is exchanged to the equal mol number of the control magenta coupler (Mc-2).

Sample 93: The control cyan coupler (Cc-1) used in layers 3 and 4 of Sample 91 is exchanged to the equal mol number of the cyan coupler of this invention (P-4)

Sample 94: The control magenta coupler (Mc-1) is exchanged to the equal mol number of the coupler of this invention (P-13).

Sample 95: The coupler is exchanged to the magenta coupler of this invention (P-20) similar to Sample 94.

Sample 96: The coupler is exchanged to the magenta coupler of this invention (P-24) similar to Sample 24.

Sample 97: The control yellow coupler (Y-1) used in layers 9 and 10 of Sample 91 is exchanged to the equal mol number of the yellow coupler of this invention (P-28).

Sample 98: The control yellow, magenta and cyan couplers are changed to P-28, P-13 and P-4 in similar manners to Samples 97, 94 and 93, respectively.

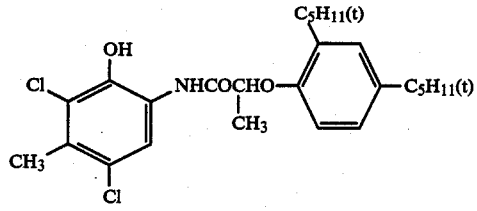

Control coupler Cc-1

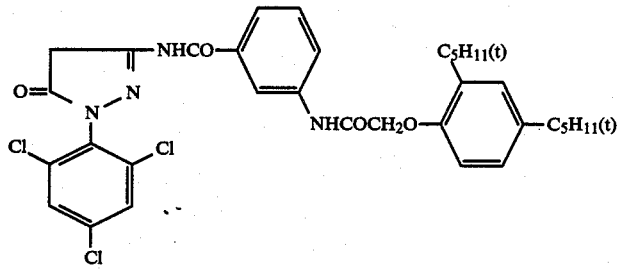

Control coupler Mc-1

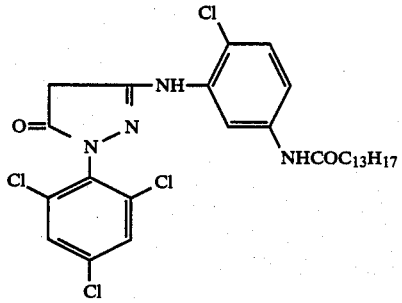

Control coupler Mc-2

-continued

Control coupler Yc-1

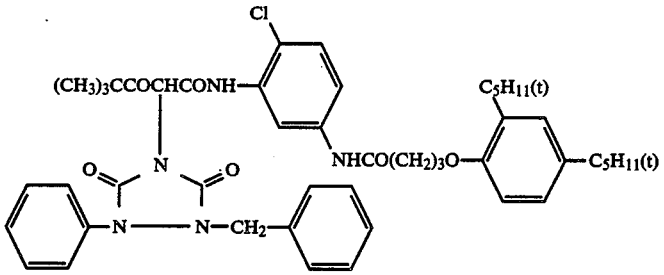

Recipes for various processing solutions and processing procedures are same as those shown in example 1 except the bleach-fixing solution.

| [Bleach-fixing solution] | |
|---|---|
| Ethylenediaminetetraacetic acid diammonium | 7.5 g |
| Aminopolycarboxylic acid iron (III) complex | 0.3 mol |
| Ammonium sulfite (50% solution) | 10.0 g |
| Ammonium thiosulfate (70% solution) | 200 g |

Total is made to 11 by adding water and pH is adjusted to 7.5

Ethylenediaminetetraacetic acid iron (III) complex salt is used as the aminopolycarboxylic acid contained in the bleach-fixing solution.

The above-mentioned treatment was practiced by using Samples 91, 92, 94, 95 and 96 and RMS and MTF of the blue-sensitive layer were measured. RMS and MTF were also measured after keeping these treated samples for 14 days under conditions of 70° C. and relative humidity 80%. Result is shown in Table 7.

RMS is a measure of granularity which is expressed by the standard deviation of density values measured by scanning with a micro-densitometer (at the concentration $D_{min+0,1}$ and the scanning diameter 25 μm). The less the RMS value is, the more the granularity of the picture is improved.

MTF (modulation transfer function) was also measured when the space frequency is 30 cycle/mm. The more this value is increased, the more the sharpness of the picture is improved.

TABLE 7

| Treatment | Sample No. | Magenta Coupler | RMS Immediately after the treatment | RMS After preservation | MTF Immediately after the treatment | MTF After preservation |
|---|---|---|---|---|---|---|
| Bleach-fixing treatment of this invention | 91 | Mc-1 (Control) | 30 | 49 | 62 | 42 |
| | 92 | Mc-2 (Control) | 28 | 47 | 74 | 49 |
| | 94 | P-13 (This invention) | 26 | 34 | 74 | 68 |
| | 95 | P-20 (This invention) | 24 | 30 | 69 | 59 |
| | 96 | P-24 (This invention) | 27 | 32 | 61 | 58 |

As shown in Table 7, samples containing control couplers exhibit the worsening of RMS and MTF values after the preservation. Especially the worsening of MTF is remarkable. By using the polymer-couplers of this invention, MTF and RMS values of the blue-sensitive layer are remarkably stabilized.

[EXAMPLE 8]

By using samples 91, 93 and 97 the treatment same as that of Practical example 1 was carried out and RMS and MTF values of the blue-sensitive layer are compared.

Result is shown in Table 8.

| Treatment | Sample No. | Yellow coupler | Cyan coupler | RMS Immediately after the treatment | RMS After preservation | MTF Immediately after the treatment | MTF After preservation |
|---|---|---|---|---|---|---|---|
| This invention | 91 | Yc-1 (Control) | Cc-1 (Control) | 30 | 49 | 62 | 42 |
| | 93 | Yc-1 (Control) | P-4 (This invention) | 28 | 35 | 68 | 67 |
| | 97 | P-28 (This invention) | Cc-1 (Control) | 32 | 38 | 70 | 63 |

Result of Table 8 also indicates that the differences of RMS or MTF values before and after preservation is decreased by the use of the couplers of this invention. Especially the effect on the cyan coupler is remarkable.

[EXAMPLE 9]

By using Samples 91 and 98, a color negative film was treated for 30 days and the change of RMS and MTF values by using the newly prepared solution and the fatigued solution were measured. The amount of treated film was 20 $m^2$ per day. Treated samples were kept for 14 days under conditions of 70° C. and relative humidity 80% and then RMS and MTF values were also measured. Result is shown in Table 9.

| [Color developing solution] | |
|---|---|
| Potassium carbonate | 30 g |
| Sodium hydrogencarbonate | 2.5 g |
| Potassium sulfite | 5 g |
| Sodium bromide | 1.3 g |
| Potassium iodide | 2 mg |
| Hydroxylamine sulfate | 2.5 g |
| Sodium chloride | 0.6 g |
| Sodium diethylenetriaminetetraacetate | 2.5 g |
| N—ethyl-N—β-hydroxyethyl-3-methyl-4-aminoaniline sulfate | 4.8 g |
| Potassium hydroxide | 1.2 g |

Total is made to 1 liter by adding water and pH is adjusted to 10.06 by using potassium hydroxide or 20% sulfuric acid.

| [Color-developing replenisher] | |
|---|---|
| Potassium carbonate | 35 g |
| Sodium hydrogencarbonate | 3 g |
| Potassium sulfite | 7 g |
| Sodium bromide | 0.9 g |
| Hydroxylamine sulfate | 3.1 g |
| Sodium deethylenetriaminepentaacetate | 3.2 g |
| N—ethyl-N—β-hydroxyethyl-3-methyl-4-aminoaniline sulfate | 5.4 g |
| Potassium hydroxide | 2 g |

Total is made to 1 liter by adding water and pH is adjusted to 10.12 by using potassium hydroxide or 20% sulfuric acid.

| [Bleach-fixing solution] | |
|---|---|
| Ethylenediaminetetraacetate iron (III) complex | 0.35 mol |
| Ammonium sulfite | 5 g |
| Ammonium thiosulfate | 150 g |
| Aqueous ammonia (28%) | 10 ml |

Total is made to 1 liter by adding water and the pH is adjusted to 7.5 by using acetic acid or aqueous ammonia.

| [Bleach-fixing replenisher] | |
|---|---|
| Ethylenediaminetetraacetate iron (III) complex | 0.4 mol |
| Ammonium sulfite | 10 g |
| Ammonium thiosulfate | 180 g |
| Aqueous ammonia (28%) | 10 ml |

Total is made to 1 liter by additing water and the pH is adjusted to 7.0 by using acetic acid or aqueous ammonia.

| [Stabilizer] | |
|---|---|
| Formaline (37% aqueous solution) | 2 ml |
| Konidax (produce of Konishiroku Photo Co.) | 5 ml |
| Total is made to 1 liter by adding water. | |
| [Stabilizer supplement solution] | |
| Formaline (37% aqueous solution) | 3 ml |
| Konidax (produce of Konishiroku Photo Co.) | 7 ml |
| Total is made to 1 liter by adding water. | |

The color-developing replenisher was used to replenish the color-developing bath at a rate of 15 ml/100 $cm^2$ of color negative film. The bleach-fixing replenisher was used to replenish the bleach-fixing bath at a rate of 10 ml/100 $cm^2$ of film. Water was run at a rate of 150 ml/100 $cm^2$ of the film.

TABLE 9

| | | New Solution | | | | Used Solution | | | |
|---|---|---|---|---|---|---|---|---|---|
| | | RMS | | MTF | | RMS | | MTF | |
| Treatment | Sample No. | Immediately after treatment | After preservation | Immediately after treatment | After preservation | Immediately after treatment | After preservation | Immediately after treatment | After preservation |
| This invention | 91 (Control) | 30 | 49 | 62 | 42 | 45 | 57 | 43 | 31 |
| | 98 (This invention) | 27 | 26 | 75 | 74 | 27 | 30 | 72 | 75 |

Result of Table 9 shows that Sample 9 (all kinds of used sensitive emulsions (blue, green and red) are those of this invention) exhibits the smallest deviations both in RMS and MTF and especially the deviation in the case of continuous treatment of bleach-fixing is remarkably improved. Moreover, the result shows that RMS and MTF are stabilized even though the treating solution has been fatigued. Especially it was beyond the expectation that the RMS and MTF values of the samples which were kept after treated by the fatigued solution are better than those of samples treated by the conventional bleaching and fixation treatment in stability.

[EXAMPLE 10]

Treating solutions which have been used continuously for a long period in Example 3 are used for the treatment of Samples 91, 93, 94 and 97 and the RMS and MTF values are compared with those for the treatment by newly-prepared solutions. Result is shown in Table 10.

TABLE 10

| | | | | | New solution | | Fatigued solution | |
|---|---|---|---|---|---|---|---|---|
| Treatment | Sample No. | Yellow coupler | Magenta coupler | Cyan coupler | RMS | MTF | RMS | MTF |
| This invention | 91 | Yc-1 (Control) | Mc-1 (Control) | Cc-1 (Control) | 30 | 62 | 45 | 43 |
| | 93 | Yc-1 (Control) | Mc-1 (Control) | P-4 (This | 28 | 68 | 34 | 60 |

TABLE 10-continued

| Treatment | Sample No. | Yellow coupler | Magenta coupler | Cyan coupler | New solution RMS | New solution MTF | Fatigued solution RMS | Fatigued solution MTF |
|---|---|---|---|---|---|---|---|---|
| | | | | invention) | | | | |
| | 94 | Yc-1 (Control) | P-13 (This invention) | Cc-1 (Control) | 26 | 74 | 30 | 69 |
| | 97 | P-28 (This invention) | Mc-1 (Control) | Cc-1 (Control) | 32 | 70 | 36 | 66 |

A remarkable result shows that the worsening of MTF values by using the fatigued solutions after continuous treatment can be improved by the use of the couplers of this invention.

What is claimed is:

1. A method of processing a silver halide color photographic light sensitive material comprising the steps of:

(a) developing an imagewise exposed silver halide color photographic material comprising a support and photographic component layers including a blue-sensitive silver halide photographic emulsion layer, a green-sensitive silver halide photographic emulsion layer and a red-sensitive silver halide photographic emulsion layer provided on one side of said support, at least one of said silver halide photographic emulsion layers comprising a silver iodobromide containing from 0.5 to 25 mol% of silver iodide, and at least one of said silver halide emulsion layers comprising at least one coupler selected from the group consisting of the couplers represented by the Formula C I, the couplers represented by the Formula C II and polymerized couplers, (b) maintaining the total dry-thickness of said photographic component layers within the range of 8 to 25 μm and the swelling rate $T_{\frac{1}{2}}$ of said photographic component layers at not more than 25 sec., and (c) bleach-fixing said developed photographic material with a bleach-fixing solution containing an organic acid ferric complex, wherein Formula C I and Formula C II compounds are as follows:

Formula C I

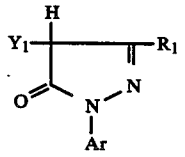

wherein Ar is a phenyl group which may be substituted, $Y_1$ is a group being capable of releasing upon the coupling reaction with an oxidized product of a color developing agent of an aromatic primary amine and $R_1$ is selected from the group consisting of an anilino, an ureido and an acylamino, the $R_1$ group may be substituted;

Formula C II

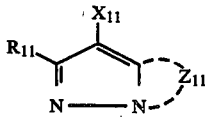

wherein $Z_{11}$ is a group of non-metallic atoms necessary to complete a nitrogen-containing heterocyclic ring which may be substituted, $X_{11}$ is a group being capable of releasing upon the coupling reaction with an oxidized product of a color developing agent of an aromatic primary amine and $R_{11}$ is a hydrogen atom or a substituent.

2. The method of claim 1, wherein said polymerized coupler is a polymer of the coupler monomer selected from the coupler monomers represented by the Formulae C III, C IV, C V, C VI, C VII or C VIII:

Formula CIII

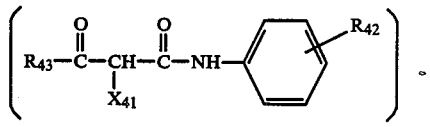

(b)

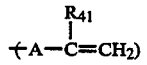

(a)

wherein $R_{41}$ is selected from a hydrogen atom and a methyl group, $R_{42}$ is selected from a hydrogen atom, a halogen atom, an alkyl having one to four carbon atoms, an alkoxy group, a sulfo group, a carboxy group, a sulfonamido group, a carbamoyl group, a sulfamoyl group and a cyano group, $R_{43}$ is selected from an alkyl group and an aryl group, $X_{41}$ is a group being capable of releasing upon the coupling reaction with an oxidized product of a color developing agent of an aromatic primary amine, (b) is a group containing a polymerizable vinyl group and at least one of it is combined with (a) at an arbitrary position of (a) as a substituent, A is a bonding group selected from —NHCO— of which the carbon atom is bonded with the vinyl group atom, —OCO— of which carbon atom is bonded with the vinyl group and —O—, Formula CIV

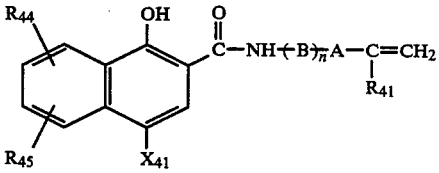

wherein $R_{41}$, A and $X_{41}$ are the same as in the Formula C III, $R_{44}$ and $R_{45}$ are the same as $R_{41}$ and $R_{42}$ of the Formula C III, respectively, B is a divalent organic group and n is 0 or 1, Formula CV

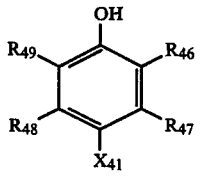

wherein $X_{41}$, $R_{47}$ and $R_{49}$ are the same as $X_{41}$, $R_{41}$ and $R_{42}$ of the Formula C III, respectively, $R_{46}$ and $R_{48}$ are independently selected from a hydrogen atom, an alkyl group having one to eight carbon atoms, an alkoxy group, a halogen atom, sulfo group, a carbamoyl group, a carboxy group, a sulfamoyl group, —NH—L, in which L is selected from an alkoxycarbonyl group and an alkylcarbamoyl group, R'CO—, $R'SO_2$ in which R' is selected from an aliphatic group, an aromatic group and a heterocyclic group and at least one of $R_{46}$ and $R_{48}$ has a group of the Formula C III as a substituent at the end of the group, Formula CVI

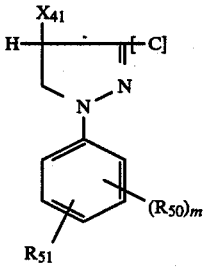

wherein $X_{41}$ and $R_{50}$ are the same as $X_{41}$ and $R_{42}$ of the Formula C III, respectively, $R_{51}$ is the same as $R_{46}$ and $R_{48}$ of the Formula C V, is selected from the groups represented by $R_{46}$, $R_{48}$ or the following formula:

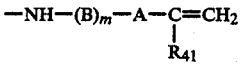

wherein $R_{41}$, A and B are the same as $R_{41}$, A and B of the Formula C IV, n is an integer 0 to 3 and at least one of [C] and $R_{51}$ has a polymerisable vinyl group represented by (a) of the Formula C III, Formula CVII

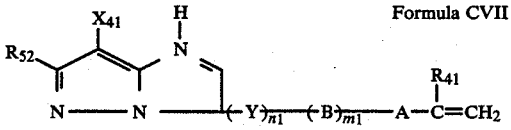

Formula CVIII

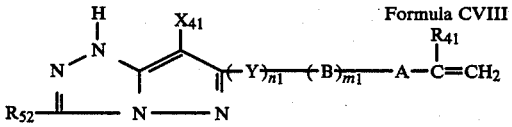

Wherein $X_{41}$ is the same as $X_{41}$ of the Formula C III, $R_{52}$ is selected from a hydrogen atom, a hydroxy group, an alkyl group, an aryl group, a five or six membered heterocyclic ring, an alkylamino group, an acylamino group, an anilino group, an alkoxycarbonyl group, an alkylcarbonyl group, an arylcarbonyl group, an alkylthio group, an arylthio group, a carbamoyl group, a sulfamoyl group and a sulfonamido group, A abd B are the same as that of the Formula C IV, Y is selected from —O—, —NH—, —SO—, $—SO_2—$, —CONH—, —COO—, —NHCO— and —NHCONH—, $m_1$ is 1 when $n_1$ is 1, $m_1$ is 0 or 1 when $n_1$ is 0 and m is an integer 0 to 3.

3. The method of claim 1, wherein said silver halide photographic material comprises an antihalation layer containing a black colloidal silver.

4. The method of claim 1, wherein the total amount of silver contained in said silver halide photographic emulsion layers is from 20 to 50 mg/dm$^2$.

5. The method of claim 1, wherein said swelling rate $T\frac{1}{2}$ of the photographic component layers is not more than 20 sec.

6. The method of claim 1, wherein said photographic material comprises at least one silver halide emulsion layer comprising a silver iodobromide containing from 2 to 25 mol% of silver iodide.

7. The method of claim 1, wherein said bleach-fixing solution contains a bleaching-accelerator selected from the compounds represented by General Formulae [I] to [VII]:

General Formula [I]

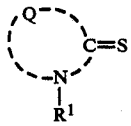

General Formula [II]

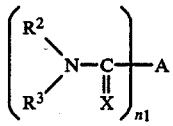

General Formula [III]

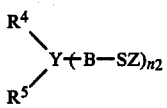

General Formula [IV]

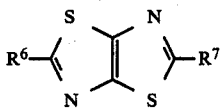

General Formula [V]

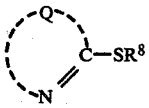

General Formula [VI]

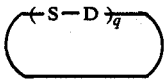

General Formula [VII]

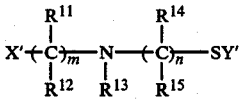

wherein Q represents a group of atoms necessary to complete a heterocyclic ring containing a nitrogen atom which may be condensed with at least one of five- to six-membered unsaturated rings, A is selected from the group consisting of

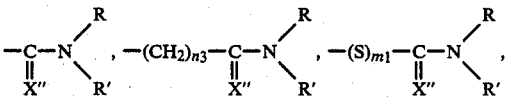

-continued

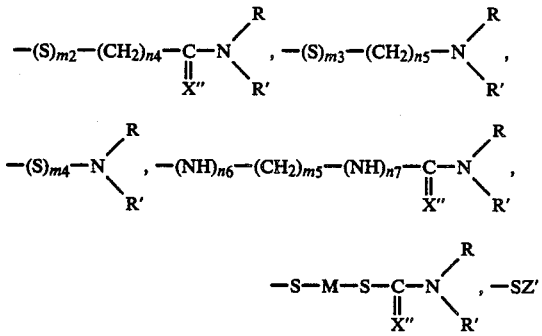

and a n-valent heterocyclic ring residue which may be condensed with at least one of five- or six-membered unsaturated rings, B is selected from the an alkylen group having from one to six carbon atoms, M is a divalent metal atom, X and X'' are independently selected from =S, =O and =NR'', R'' is selected from the group consisting of a hydrogen atom, an alkyl group having one to six carbon atoms, a cycloalkyl group, a heterocyclic ring residue which may be condensed with at least one of five- or six-membered unsaturated rings and amino group, Y is selected from =Y— and =CH—, Z is selected from the group consisting of a hydrogen atom, an alkali metal atom, ammonium group, amino group, a nitrogen-containing heterocyclic ring residue and

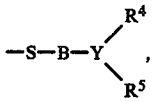

Z' is selected from the groups represented by Z and an alkyl group, R' is selected from the group consisting of a hydrogen atom, an alkyl group having one to six carbon atoms, a cycloalkyl group, an aryl group, a heterocyclic ring residue which may be condensed with at least one of five- or six-membered unsaturated rings and amino group, $R^2$, $R^3$, R and R' are independently selected from the group consisting of a hydrogen atom, an alkyl group having one to six carbon atoms, a hydroxy group, a carboxy group, an amino group, an acyl group having one to three carbon atoms, an aryl group and an alkenyl group, $R^4$ and $R^5$ are independently selected from the group consisting of a hydrogen atom, an alkyl group having one to six carbon atoms, a hydroxy group, a carboxy group, an amino group, an acyl group having one to three carbon atoms, an aryl group, an alkenyl group and —B—SZ, provided that R and R', $R^2$ and $R^3$ and $R^4$ and $R^5$ may respectively form a heterocyclic ring residue which may be condensed with at least one of five- or six-membered rings, $R^6$ and $R^7$ are independently selected from

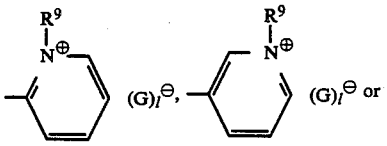

-continued

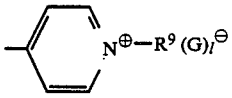

$R^9$ is selected from an alkyl and $—(CH_2)n_8SO_3\ominus$, l is 0 or 1 provided that $R^8$ is $—(CH_2)n_8SO_3\ominus$, $G\ominus$ is an anion, $m_1$, $m_2$, $m_3$, $n_1$, $n_2$, $n_3$, $n_4$, $n_5$, $n_6$, $n_7$ and $n_8$ are an integer 1 to 6, respectively, $m_5$ is an integer 0 to 6, $R^8$ is selected from a hydrogen atom, an alkali metal atom,

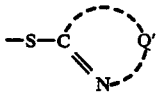

and an alkyl group, Q' is synonymous with Q, D is selected from an alkylen and a vinylen group having one to eight carbon atoms, q is an intger 1 to 10, the plurality of D may be the same or different as each other and a ring formed by D with S may be condensed with a five- or six-membered unsaturated ring, X' is selected from the group consisting of —COOM', —OH, $—SO_3M'$, $—CONH_2$, $—SO_2HN_2$, $—NH_2$, —SH, —CN, $—CO_2R^{16}$, $—SO_2R^{16}$, $—OR^{16}$, $—NR^{16}R^{17}$, $—SR^{16}$, $—SO_3R^{16}$, $—NHCOR^{16}$, $—NHSO_2R^{16}$, $—OCOR^{16}$, and $—SO_2R^{16}$, Y' selected from

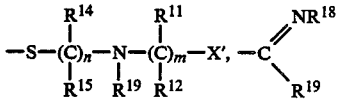

and a hydrogen atom, m and n are an integer 1 to 10, respectively, $R^{11}$, $R^{12}$, $R^{14}$, $R^{15}$, $R^{17}$ and $R^{18}$ are independently selected from the group consisting of a hydrogen atom, a lower alkyl group, an acyl group, and

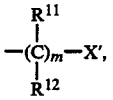

$R^{16}$ is a lower alkyl group, $R^{19}$ is selected from $—NR^{20}R^{21}$, $—OR^{22}$ and $SR^{22}$, $R^{20}$ and $R^{21}$ are selected from a hydrogen atom and a lower alkyl group, $R^{22}$ is a group of atoms necessary to complete a ring by conbining with $R^{18}$, $R^{20}$ or $R^{21}$ may combine with $R^{18}$ to form a ring and M' is selected from a hydrogen atom and a cation, provided that said compounds represented by the general formula [I] to [V] may be enolated or salt thereof.

8. The method of claim 1, wherein said method further comprises a step of prefixing, just before the step of the bleach-fixing, with a prefixing solution capable of fixing the silver halide color photographic material.

9. The method of claim 8, wherein said prefixing solution contains the bleach-accelerator selected from the compounds described in claim 7.

10. The method of claim 1, wherein all of the silver halide emulsion layers comprise a silver halide containing from 4 to 10 mol% of silver iodide, respectively.

11. The method of claim 1, wherein at least one of said silver halide photographic emulsion layers comprises a core/shell-type silver halide photographic emulsion.

12. The method of claim 1, wherein said organic acid of the organic acid ferric complex is selected from the group consisting of the following acids:

(a) Diethylenetriaminepentaacetic acid
(b) Cyclohexanediaminetetraacetic acid
(c) Triethylenetetraminehexaacetic acid
(d) Glycoletherdiaminetetraacetic acid
(e) 1,2-diaminopropanetetraacetic acid
(f) 1,3-diaminopropane-2-ol-tetraacetic acid
(g) Ethylenediamine-o-hydroxyphenylacetic acid
(h) Ethylenediaminetetraacetic acid
(i) Nitrylotriacetic acid
(j) Iminodiacetic acid
(k) Methyliminodiacetic acid
(l) Hydroxyethyliminoacetic acid
(m) Ethylenediaminetetrapropionic acid
(n) Dihydroxyethylglycine
(o) Nitrylotripropionic acid
(p) Ethylenediaminediacetic acid
(q) Ethylenediaminedipropionic acid.

* * * * *